US010259603B2

(12) United States Patent
Palumbo et al.

(10) Patent No.: US 10,259,603 B2
(45) Date of Patent: Apr. 16, 2019

(54) APPARATUS AND PROCESS FOR PACKAGING A PRODUCT

(71) Applicant: CRYOVAC, INC., Duncan, SC (US)

(72) Inventors: Riccardo Palumbo, Arona (IT); Jvanohe Rizzi, Milan (IT)

(73) Assignee: CRYOVAC, LLC, Charlotte, NC (US)

( * ) Notice: Subject to any disclaimer, the term of this patent is extended or adjusted under 35 U.S.C. 154(b) by 358 days.

(21) Appl. No.: 15/104,353

(22) PCT Filed: Dec. 15, 2014

(86) PCT No.: PCT/EP2014/077844
§ 371 (c)(1),
(2) Date: Jun. 14, 2016

(87) PCT Pub. No.: WO2015/091404
PCT Pub. Date: Jun. 25, 2015

(65) Prior Publication Data

US 2017/0029146 A1 Feb. 2, 2017

(30) Foreign Application Priority Data

Dec. 16, 2013 (EP) ..... 13197353

(51) Int. Cl.

| | |
|---|---|
| ***B65B 11/52*** | (2006.01) |
| ***B65B 31/02*** | (2006.01) |
| ***B65B 47/10*** | (2006.01) |
| ***B65B 41/12*** | (2006.01) |
| ***B65B 57/12*** | (2006.01) |
| ***B65B 61/06*** | (2006.01) |

(52) U.S. Cl.
CPC ..... *B65B 11/52* (2013.01); *B65B 31/028* (2013.01); *B65B 41/12* (2013.01); *B65B 47/10* (2013.01); *B65B 57/12* (2013.01); *B65B 61/06* (2013.01)

(58) Field of Classification Search
CPC ..... B65B 11/52
USPC ..... 53/433
See application file for complete search history.

(56) References Cited

U.S. PATENT DOCUMENTS

| | | | |
|---|---|---|---|
| 3,574,642 | A | 4/1971 | Weinke |
| 3,681,092 | A | 8/1972 | Titchenal |
| 3,694,991 | A | 10/1972 | Perdue |
| 3,713,849 | A | 1/1973 | Grindrod |
| 3,884,017 | A | 5/1975 | Butcher |
| 4,055,672 | A | 10/1977 | Hirsch |
| RE30,009 | E | 5/1979 | Perdue |
| 4,168,598 | A | 9/1979 | Omori |

(Continued)

FOREIGN PATENT DOCUMENTS

| | | | |
|---|---|---|---|
| DE | 102007011292 | A1 | 9/2008 |
| EP | 0314546 | B1 | 12/1990 |

(Continued)

*Primary Examiner* — Lori Baker
(74) *Attorney, Agent, or Firm* — Jon M. Isaacson

(57) ABSTRACT

A product arranged in a support can be packaged. A film is unrolled, a number of supports are progressively moved inside the packaging chamber of a packaging assembly, the packaging chamber is kept open for a time sufficient for a number of supports and for the film or for film sheets to properly position inside the packaging chamber, causing the film sheets or film portions to adapt to the shape of a cavity formed in the upper tool of the packaging assembly and the film sheets or film portions are sealed to respective supports. An apparatus can perform the above process.

22 Claims, 37 Drawing Sheets

(56) References Cited

U.S. PATENT DOCUMENTS

| | | | |
|---|---|---|---|
| 4,275,544 | A | 6/1981 | Hisazumi |
| 5,155,974 | A | 10/1992 | Garwood |
| 5,346,735 | A | 9/1994 | Logan |
| 5,514,392 | A | 5/1996 | Garwood |
| 7,600,358 | B2 | 10/2009 | Natterer |
| 7,712,289 | B2 | 5/2010 | von Seggern |
| 8,281,559 | B2 | 10/2012 | Sparakowski et al. |
| 8,381,497 | B2 | 2/2013 | Beckel et al. |
| 8,544,245 | B2 | 10/2013 | Ehrmann |
| 9,003,745 | B2 | 4/2015 | Capriotti et al. |
| 9,260,208 | B2 | 2/2016 | Muehlschlegel et al. |
| 9,266,635 | B2 | 2/2016 | Langer et al. |
| 9,919,819 | B2 | 3/2018 | Scolaro |
| 2005/0257501 | A1 | 11/2005 | Natterer |
| 2008/0152772 | A1 | 6/2008 | Bernig |
| 2010/0287893 | A1 | 11/2010 | Boekstegers et al. |
| 2011/0167762 | A1 | 7/2011 | Zeller et al. |
| 2012/0151875 | A1 | 6/2012 | Capriotti |
| 2012/0204516 | A1 | 8/2012 | Palumbo |
| 2012/0297729 | A1 | 11/2012 | Scolaro |
| 2012/0324835 | A1 | 12/2012 | Ickert |
| 2013/0255201 | A1 | 10/2013 | Holzem et al. |
| 2015/0367971 | A1 | 12/2015 | Ehrmann et al. |
| 2016/0068288 | A1 | 3/2016 | Palumbo |

FOREIGN PATENT DOCUMENTS

| | | | |
|---|---|---|---|
| EP | 0469296 | A1 | 2/1992 |
| FR | 1258357 | A | 4/1961 |
| FR | 1286018 | A | 3/1962 |
| FR | 2725692 | A1 | 4/1996 |
| GB | 1296013 | A | 11/1972 |
| JP | H111203 | A | 1/1999 |
| JP | 2006044732 | A | 2/2006 |

APPARATUS AND PROCESS FOR PACKAGING A PRODUCT

TECHNICAL FIELD

The present invention relates to an apparatus and to a process for packaging of a product. In accordance with certain aspects, the invention relates to an apparatus and process for skin packaging of a product.

BACKGROUND ART

Plastic containers are used for the packaging of items, such as food or other products. A plastic film or a lid may be bonded to the plastic container thereby obtaining a closed package containing the product.

In accordance with a first technique a lid may be applied to a container by heat bonding of the lid to the top rim of the container. For example, EP0469296 discloses an induction sealing apparatus configured for sealing a plastic lid to a plastic container. The apparatus includes a nest having a recess for holding a container to be sealed, and a movable sealing head configured for holding a precut and flat lid and for positioning the lid relative to an opening in the container. An induction coil mounted in the sealing head induces a heating electrical current in the lid to seal the lid to the container. This solution is not adequate to packaging of products protruding above the top rim of the container because the lid is flat and the apparatus is configured to handle flat lids only.

A second technique, known as vacuum skin packaging is employed for packaging food products. Vacuum skin packaging is described for instance in FR 1 258 357, FR 1 286 018, AU 3 491 504, U.S. Pat. No. RE 30 009, U.S. Pat. No. 3,574,642, U.S. Pat. No. 3,681,092, U.S. Pat. No. 3,713,849, U.S. Pat. No. 4,055,672, U.S. Pat. No. 5,346,735 and WO2011/012652.

Vacuum skin packaging is basically a thermoforming process. In particular, the product is placed on a support (such as a tray, a bowl or a cup) and then the support with the product placed thereon is put in a vacuum chamber, where a film of thermoplastic material, held by vacuum in a position above the product placed on the support, is heated to soften it. The space between the support and the film is then evacuated and finally vacuum above the film is released to cause the film to drape down all around the product and seal to the surface of the support not covered by the product, thus forming a tight skin around the product and on the support.

In the case of a product protruding above the edge of the tray, the film holder may be concave and e.g. shaped as a dome in order to host the protruding portion of the product during application of the plastic skin.

For instance, in order to package a bulky product having a portion protruding from the tray top rim, US 2005/0257501 shows a device consisting of an upper tool and a lower tool. The upper tool comprises an internal space in which a forming device with a concave opening facing the lower tool is fixedly mounted. A sealing tool is provided which is movable from the retracted position into the sealing position and a cutting blade which is surrounding the sealing device and which is also pneumatically movable from the retracted position to the cutting position as shown in and back is provided. After film and tray positioning, an evacuating is performed above the upper film having the consequence of the upper film being sucked to the inner wall of the forming device and thus being stretched. After the upper film is sucked to the internal surface of the forming device, the sealing tool is moved into the sealing position and thereby the edge of the tray and the upper film are sealed hermetically. Subsequently, the cutting blade is operated and thereby the completed package is separated from the upper film layer. Although this apparatus may be used for packaging products protruding above the top rim of the tray, it should be noted that the described apparatus is suitable for products of a same standardized size.

In US3694991 a vacuum skin packaging apparatus capable of packaging products above a flat board is described; according to this document the product on the flat board is placed in a vacuum chamber and a sheet of thermoplastic film is placed above the product. A portion of the film is drawn against the concave interior surface of the upper portion of a vacuum chamber; the film is then heated by surface contact; and then, after evacuation of the chamber, air pressure is used to blow the film down over the product and against the flat board. The height of the chamber may be adjusted before execution of the above cycle by locating an adapter between the upper and the lower portions of the vacuum chamber. Although the described apparatus allows packaging of different products, adjusting the height of the vacuum chamber is not practical and, additionally, the specific design of this apparatus is not adapted to packaging of products in trays, let alone of bulky products.

Thus it is an object of the invention conceiving a packaging process and a packaging apparatus which can overcome the limitations of the known solutions described above.

In particular, it is a main object of the invention, to offer a packaging process and a packaging apparatus which may effectively adapt to packaging of products protruding above the support or tray and still be able to effectively package products not emerging above the respective support or tray.

A further object of the invention is a packaging process and a packaging apparatus configured to packaging products of different sizes and degrees of protrusion above the respective support or tray.

In particular, it is an object of the invention to provide a packaging process and a packaging apparatus adapted to packaging of products having a high degree of protrusion above the support or tray.

An ancillary object of the invention is a packaging process and a packaging apparatus capable of adapting to product protrusions of various geometries and in particular to products having protrusions located in the vicinity of tray or support top rim.

Another auxiliary object of the invention is to offer a packaging process and a packaging apparatus having the ability to reduce imperfections, such are plies or wrinkles, on the film applied to the product and thus improve the appearance of the final packaged product.

Moreover, it is another object of the invention to offer a packaging process and a packaging apparatus adapted for skin packaging of products.

Another object is that of offering a process and an apparatus capable of increasing productivity, without negatively impacting on the quality and reliability of the packaging.

SUMMARY OF THE INVENTION

One or more of the objects specified above are substantially achieved by a process and by an apparatus according to any one of the appended claims Aspects of the invention are here below disclosed.

A 1st aspect concerns an apparatus (1) for packaging a product (P) arranged on a support (4), said apparatus (1) comprising:

a film supplying assembly (5) configured for supplying at least one film (10*a*);

a packaging assembly (8) configured for tightly closing said one or more supports (4) with said film (10*a*), the packaging assembly (8) including:

at least one lower tool (22) comprising a prefixed number of seats (23) for receiving said one or more supports (4), and at least one upper tool (21; 21', 21") cooperating with the lower tool (22) and configured for holding at least a portion (10*b*; 18*a*) of said film;

wherein the upper tool (21; 21', 21") and the lower tool (22) are configured to be movable the one relative to the other between at least a first operating condition, where the lower tool and the upper tool allow positioning of the one or more supports (4) at said seats (23), and a second operating condition, where the lower tool and the upper tool delimit a packaging chamber (24);

wherein the upper tool (21; 21', 21") comprises:

a head (36) having a respective active surface (37) facing the one or more supports (4) and configured for receiving the film portion (10*b*; 18*a*) of said film, holding means (38) associated to the head (36) and configured for attracting the film portion (10*b*; 18*a*) of film towards said active surface (37), a peripheral body (90) positioned around the head (36), the head and the peripheral body being mounted for relative motion the one with respect to the other among a plurality of relative positions and being configured for defining a cavity (40) delimited by said active surface (37) and by an inner wall (92) of said peripheral body.

It should be noted that the active surface (37) of the head (36) may for instance be flat or dome shaped (i.e. concave with concavity facing the lower tool when the upper and lower tools are in sad second operating condition). In both cases the final shape and the volume of the cavity (40) is defined by the relative position taken by the peripheral body and the head.

In a 2nd aspect according to the 1st aspect, the packaging apparatus further comprises a control unit (100) connected to the packaging assembly (8) and configured for executing a film deformation procedure comprising the steps of:

commanding the relative motion of the peripheral body (90) with respect to the head (36) in order to define said cavity (40), activating the holding means (38), wherein said steps of commanding the relative motion and activating the holding means are coordinated by the control unit (100) such as to cause said film portion (10*b*; 18*a*) to move from a substantially flat configuration to a substantially tri-dimensional configuration inside said cavity (40).

In a 3rd aspect according to any one of the preceding aspects, the lower tool is configured for receiving at least one of said supports (4) having a base wall (4*a*) and a side wall (4*b*), with a product (P) hosted therein and protruding above a top rim of said side wall (4*b*).

In a 4th aspect according to any one of the preceding two aspects said commanding the relative motion comprises commanding relative motion of the peripheral body (90) with respect to the head (36) from an end stroke position, where a terminal surface (95) of the peripheral body is aligned or substantially aligned with the active surface (37) of the head (36), to an operating position, where the terminal surface (95) of the peripheral body (90) is displaced from the active surface (37) by a distance (Hc) (which in the case of a flat active surface represents the height of said cavity (40)), the cavity having a volume (V) the size of which is depending upon the relative positioning of the peripheral body with respect to the holding head.

Alternatively, in case the active surface is dome shaped, said commanding the relative motion comprises commanding relative motion of the peripheral body (90) with respect to the head (36) from an end stroke position, where a terminal surface (95) of the peripheral body is aligned or substantially aligned with the peripheral edge of the active surface (37) of the head (36), to an operating position, where the terminal surface (95) of the peripheral body (90) is displaced from the peripheral edge of the active surface (37) by a distance (Hc), the cavity having a volume (V) the size of which is depending upon the relative positioning of the peripheral body with respect to the holding head.

In both alternatives the distance Hc, i.e. the relative stroke between peripheral body (90) and head (36), greater than 5 mm, optionally greater than 10 mm, more optionally greater than 20 mm, even more optionally greater than 30 mm. The maximum value of Hc, i.e. the maximum value of said relative stroke, may reach 100 mm or even up to 200 mm.

In a 5th aspect according to any one of the preceding three aspects wherein the control unit (100) is configured for first commanding the relative motion and then activating the holding means (38) such that said cavity (40) is formed before causing said film portion (10*b*; 18*a*) to move from a substantially flat configuration to a substantially tri-dimensional configuration inside said cavity.

In a 6th aspect according to any one of aspects from the 2nd to the 4th, wherein the control unit (100) is configured for commanding the relative motion after or contemporaneously with activating the holding means (38) such that said cavity (40) is formed together with causing said film portion (10*b*; 18*a*) to move from a substantially flat configuration to a substantially tri-dimensional configuration inside said cavity.

In a 7th aspect according to any one of the preceding aspects wherein said peripheral body (90) is slidingly and tightly guided along a side surface (37*a*) of said head.

In a 8th aspect according to any one of the preceding aspects wherein the apparatus comprises a dedicated actuator (94) carried by the upper tool (21; 21', 21") and mounted to act on one or both the peripheral body and the head to determine said relative motion, said control unit (100) being configured for controlling the dedicated actuator (94) to bring and stably keep the peripheral body (90) and the head (36) in one of said relative positions defining said cavity.

In a 9th aspect according to any one of the preceding aspects, wherein elastic means (94') is interposed between the peripheral body and the upper tool, the elastic means being positioned and configured to normally bias the peripheral body at an end stroke position, where a terminal surface (95) of the peripheral body is aligned or substantially aligned with the active surface (37) of the head (36).

In a 10th aspect according to the preceding aspect a main actuator (33) is active on said upper tool (21; 21', 21") under the control of the control unit (100), said control unit (100) being configured for controlling the main actuator (23) to bring and stably keep the peripheral body (90) and the head (36) in one of said relative positions defining said cavity.

In an 11th aspect according to any one of the preceding aspects the control unit (100) is configured to at least control activation of the holding means (38) such as to cause pulling of said film portion (10*b*; 18*a*) inside said cavity (40) and shaping of said film portion to the shape of the cavity.

In a 12$^{th}$ aspect according to any one of the preceding aspects the head (36) comprises a flat active surface (37) and a prismatic or cylindrical side surface (37*a*) extending perpendicular to the active surface, and wherein the peripheral body (90) comprises an inner wall (92) which surface is shaped as the head side surface (37*a*) thereby defining a cavity of cylindrical or prismatic shape.

In a 13$^{th}$ aspect according to any one of the preceding aspects the apparatus is further comprising at least one sensor (50) communicating with said control unit (100) and configured to detect a value taken by at least one parameter in the group of:

the extent of protrusion (Hp) of a product beyond a top of said support, a parameter from which the extent of protrusion (Hp) can be determined such as the height of the product hosted in a support, or the total height product+support, and to issue a signal for said control unit linked to a detected value for the parameter.

In a 14$^{th}$ aspect according to the preceding aspect the control unit is configured to:

receive said signal, and command the relative motion of the peripheral body with respect to the head by a distance (Hc) equal to or greater than said extent of protrusion (Hp), in order to define said cavity with a height at least sufficient to host a protruding portion of said product.

In a 15$^{th}$ aspect according to any one of the preceding aspects wherein said holding means (38) comprises:

a plurality of suction apertures (39) leading to the active surface, at least one vacuum source (41) controlled by the control unit (100) and connected to the suction apertures, and at least one valve (42; 42*a*, 42*b*), also controlled by the control unit (100), configured for selectively connecting said suction apertures either to said vacuum source (41) or to a vent line (43).

In a 16$^{th}$ aspect according to any one of the preceding aspects wherein the packaging assembly (8) further comprises:

a main actuator (33) active on at least one of said upper and lower tool (21; 22), the main actuator (33) being controlled by the control unit (100), the control unit (100) being configured for acting on the main actuator (33) and causing relative movement of the upper and lower tool (21; 22) between said first operating condition, where the upper tool (21) is spaced apart from the lower tool (22), and said second operating condition, where a closure surface (34) of the upper tool (21) or the terminal surface (95) of the peripheral body (90) tightly abuts against a closure surface (35) of the lower tool (22) to close said packaging chamber (24) with respect to an atmosphere outside the apparatus (1).

In a 17$^{th}$ aspect according to any one of the preceding aspects wherein the packaging assembly (8) further comprises:

a cinematic structure (150) active on at least one of said upper and lower tool (21, 21', 22'; 22), the cinematic structure (150) being controlled by the control unit (100), the control unit (100) being configured for acting on the main actuator (33) and causing relative movement of the upper and lower tool (21; 21', 21"; 22) between said first operating condition, where the upper tool (21; 21', 21") is spaced apart from the lower tool (22), and said second operating condition, where a closure surface (34) of the upper tool (21; 21', 21") or the terminal surface (95) of the peripheral body (90) tightly abuts against a closure surface (35) of the lower tool (22) to close said packaging chamber (24) with respect to an atmosphere outside the apparatus (1).

In a 18$^{th}$ aspect according to any one of the preceding aspects comprising the heating means is configured to heat at least the active surface (37) of the head (36) and controlled by the control unit (100).

In a 19$^{th}$ aspect according to the preceding aspect, the control unit (100) is configured for controlling the heating means such that the active surface of the head (36) is brought at least to an operating temperature comprised between 150° C. and 260° C.

In a 20$^{th}$ aspect according to the preceding aspect the control unit (100) is configured for controlling the heating means such that the active surface of the head (36) is brought at least to an operating temperature comprised between 180-240° C.

In a 21$^{st}$ aspect according to the preceding aspect the control unit (100) is configured for controlling the heating means such that the active surface of the head (36) is brought at least to an operating temperature comprised between 200-220° C.

In a 22$^{nd}$ aspect according to any one of the preceding four aspects, the heating means is configured to also heat the terminal surface (95) to allow heat bonding of the film portion (10*b*; 18*a*) to the support or tray (4).

In a 23$^{rd}$ aspect according to the preceding aspect the control unit (100) is configured for controlling the heating means such that the terminal surface (95) of the peripheral body is kept at a temperature or temperatures equal or below the operating temperature of said active surface (37).

In a 24$^{th}$ aspect according to any one of the preceding aspects from the 18$^{th}$ to the 23$^{rd}$ the heating means (60) comprises a heating structure (61) conductively connected to the head (36) and/or heaters integrated into the head body.

In a 25$^{th}$ aspect according to any one of the preceding aspects from the 19$^{th}$ to the 24$^{th}$ the control unit is configured to bring the active surface (37) at said operating temperature before causing said film portion to move to said substantially tri-dimensional configuration inside said cavity.

In a 26$^{th}$ aspect according to any one of the preceding aspects from the 19$^{th}$ to the 25$^{th}$ the control unit is configured to bring the active surface (37) at said operating temperature before initiating said film deformation procedure.

In a 27$^{th}$ aspect according to any one of the preceding aspects from the 19$^{th}$ to the 26$^{th}$, the control unit is configured to keep the active surface (37) at said operating temperature across a plurality of packaging cycles.

In a 28$^{th}$ aspect according to any one of the preceding aspects the apparatus further comprises:

a film supplying assembly (5) configured for supplying a continuous film, a film cutting assembly (6) active on the continuous film (10*a*) and configured for cutting film sheets (18) of prefixed length from said continuous film (10*a*), wherein the film cutting assembly (6) is located outside said packaging chamber (24);

a backing structure (16) having a flat holding surface (17) adapted for receiving the at least one or more of said film sheets (18) cut by the cutting assembly (6), and a displacement mechanism (25) active on the packaging assembly (8) and configured for displacing the upper tool (21; 21', 21") between a first position, where the upper tool (21; 21', 21") is positioned in correspondence of the backing structure (16) and configured to pick up from the backing structure (16) the one or more cut film sheets (18), and at least a second position, where the upper tool (21; 21', 21") is aligned to the lower tool (22) and configured to position at least one film sheet (18) above said support (4), and a vacuum arrangement (27) connected to the packaging chamber (34), wherein the control unit (100) is further configured for:

activating the displacement mechanism (25) for positioning the upper tool (21; 21', 21") at said first position in correspondence of the backing structure (16), commanding the relative motion of the peripheral body (90) with respect to the head (36) in order to define said cavity (40) and trap a peripheral edge (18*b*) of said cut film sheet between the terminal surface (95) of the peripheral body (90) and the holding surface (17) of the backing structure (16), activating the holding means (38) and pulling the portion (18*a*) of the cut film sheet inside the cavity conferring said tri-dimensional configuration to said cut film sheet, activating the displacement mechanism (25) for positioning the upper tool holding the cut film sheet at said second position such that the at least one cut film sheet (18) having the tridimensional configuration is brought above the respective support (4), causing the upper and lower tools (20, 21; 21', 21") to move to the second operating condition and trapping the peripheral edge of said cut film sheet between a support and said terminal surface (95) of the peripheral body, operating the vacuum arrangement (27) to cause a prefixed level of vacuum being formed in the packaging chamber and the cut film sheet to drape down and form a skin onto the support and onto the product.

In a 29$^{th}$ aspect according to the preceding aspect the control unit is further configured to control the heating means to warm the cut film sheet or at least the peripheral edge of the cut film sheet and heat bond this latter to the support, optionally to the support top rim.

In a 30$^{th}$ aspect according to any one of the preceding aspects from the 1$^{st}$ to the 27$^{th}$, the apparatus is further comprising:

a film supplying assembly (5) configured for supplying a continuous film (10*a*), a film cutting assembly (6) located inside said packaging chamber (24) and presenting a blade (14) positioned radially outside said peripheral body (90);

a stopper frame (110) interposed between the upper and the lower tools (20, 21) and configured to move relative to the upper tool from a release condition, where the continuous film (10*a*) is allowed to move, and a stop condition, where the stopper frame blocks the continuous film against an abutting surface of the upper tool and stops said film portion (10*b*) above at least one respective support (4); and a vacuum arrangement (27) connected to the packaging chamber (24);

wherein the control unit (100) is further configured for:

positioning the stopper frame (110) in said stop condition, commanding the relative motion between the peripheral body (90) and the head in order to define said cavity (40), activating the holding means (28) and pulling at least part of said portion (10*b*) of film inside the cavity conferring said tri-dimensional configuration, causing the upper and lower tools (20, 21) to move to the second operating condition, trapping a film section (10*d*), located peripherally to said film portion (10*b*), between a support top rim (4*c*) and said terminal surface (95) of the peripheral body (90), operating the vacuum arrangement (27) to cause a prefixed level of vacuum being formed in the packaging chamber and the film portion to drape down and form a skin onto the support and onto the product, operating the film cutting assembly (6) to cause cutting of the film portion from the continuous film.

In a 31$^{st}$ aspect according to the preceding aspect the control unit is further configured to control the heating means to warm the film portion or at least the film section (10*d*) and heat bond this latter to the support, optionally to the support top rim.

In a 32$^{nd}$ aspect according to any one of the preceding aspects from the 1$^{st}$ to the 27$^{th}$, the apparatus is further comprising:

a film supplying assembly (5) configured for supplying a continuous film (10*a*);

a tray supply assembly (140) configured for supplying a continuous web (141) including a plurality of thermoformed supports (4) in the form of interconnected trays; and a vacuum arrangement (27) connected to the packaging chamber (24);

wherein the control unit (100) is further configured for:

causing the tray supply assembly (140) to move a portion of the continuous web (141) having a prefixed number of supports (4) defined therein into the packaging assembly (8), between the upper tool and lower tool, causing the film supply assembly (5) to move said portion (10*b*) of the continuous film (10*a*) into the packaging assembly (8), between the upper tool (21) and lower tool (22), bringing the upper tool (21) in contact with the continuous film (10*a*), commanding the relative motion between the peripheral body (90) and the head (36) in order to define said cavity (40), activating the holding means (38) and pulling at least said portion of film (10*b*) inside the cavity conferring said tri-dimensional configuration, causing the upper and lower tools (20, 21) to move to the second operating condition, trapping a section (10*d*) of the film (10*a*) located at the periphery of said film portion (10*b*) and a corresponding portion (141*c*) of said web between the terminal surface (95) of the peripheral body (90) and an opposite closure surface (35) of the lower tool (22), operating the vacuum arrangement (27) to cause a prefixed level of vacuum being formed in the packaging chamber and the film portion to drape down and form a skin onto the prefixed number of supports.

In a 33$^{rd}$ aspect according to the preceding aspect said portion of the continuous web (141) moved into the packaging assembly (8) comprises a plurality of supports (4) and wherein the portion of the continuous film (10*a*) moved into the packaging assembly (8) is configured at an acute angle (a) with respect to the horizontal, further wherein the step of bringing the upper tool (21) in contact with the continuous film (10*a*) comprises bringing the upper tool first in contact with a leading section (10*c*) of the continuous film closer to the film supply assembly and then said portion (10*b*).

In a 34$^{th}$ aspect according to the preceding aspect the control unit is further configured to control the heating means to warm the film portion or at least the film section (10*d*) and heat bond this latter to the support, optionally to the support top rim.

In a 35$^{th}$ aspect according to any one of the preceding aspects from the 1$^{st}$ to the 27$^{th}$, the apparatus is further comprising:

a film supplying assembly (5) configured for supplying a continuous film, a film cutting assembly (6) active on the continuous film (10*a*) and configured for cutting film sheets (18) of prefixed length from said continuous film (10*a*), wherein the film cutting assembly (6) is located outside said packaging chamber (24); and a backing structure (16) having a flat holding surface (17) adapted for receiving the at least one or more film sheets (18) cut by the cutting assembly (6);

a transfer mechanism (19) active on the backing structure (16) and configured for relative movement of the backing structure (16) with respect to the packaging assembly (8) between a first position, where the baking structure (16) is positioned at the cutting assembly (6) and at least a second position, where the backing structure (16) is positioned inside said packaging chamber (24) and configured to place the at least one film sheet (18) in front of said active surface of the head;

a vacuum arrangement (27) connected to the packaging chamber (24);

wherein the control unit (100) is further configured for:

activating the transfer mechanism (19) for positioning the backing structure (16) in said second position bringing the least one cut film sheet (18) inside the packaging chamber (24) and above the respective support (4), commanding the relative motion between the peripheral body (90) and the head (36) in order to define said cavity and trap a peripheral edge of said cut film sheet (18) between the terminal surface (95) of the peripheral body (90) and the holding surface (17) of the backing structure, activating the holding means (38) and pulling a portion (18*a*) of the cut film sheet (18) inside the cavity to take said tri-dimensional configuration, activating the transfer mechanism (19) to move the backing structure (16) back to the first position, causing the upper and lower tools (20, 21) to move to the second operating condition and trapping the peripheral edge of said cut film sheet (18) between a support top rim (4*c*) and said terminal surface (95) of the peripheral body, operating the vacuum arrangement (27) to cause a prefixed level of vacuum being formed in the packaging chamber and the film sheet (18) to drape down and form a skin onto the support and onto the product.

In a 36$^{th}$ aspect according to the preceding aspect the control unit is further configured to control the heating means to warm the cut film sheet or at least the peripheral edge of the cut film sheet and heat bond this latter to the support, optionally to the support top rim.

In a 37$^{th}$ aspect according to any one of aspects from the 28$^{th}$ to the 36$^{th}$ the vacuum arrangement (27) connected to the packaging chamber (24) and configured for removing gas from said packaging chamber (24) comprises at least one vacuum pump (28) and at least one evacuation pipe (29) connecting the inside of said packaging chamber (24) to the vacuum pump (28), said control unit (100) being further configured to control the vacuum arrangement (27) to withdraw gas from said packaging chamber (24) at least when the packaging assembly (8) is in said second operating condition with said packaging chamber (24) hermetically closed.

In a 38$^{th}$ aspect according to any one of the preceding aspects the lower tool (22) is provided with multiple seats (23), each seat configured for hosting a corresponding support (4) and wherein the upper tool (21).

A 39$^{th}$ aspect concerns a process of packaging a product (P) arranged on a support (4) comprising the following steps:

supplying a plastic film (10*a*), supplying a prefixed number of supports (4) to a packaging assembly, each support (4) hosting or supporting a product (P) which has a portion protruding above the support side, the packaging assembly (8) having:

a lower tool (22) comprising a prefixed number of seats (23) for receiving one or more supports (4), and an upper tool (21; 21', 21") movable relative to the lower tool (22) between at least a first operating condition, where the lower tool and the upper tool are spaced apart, optionally distanced the one from the other or angularly spaced the one from the other, and allow positioning of the one or more supports (4) at said seats, and a second operating condition, where the lower tool and the upper tool define a packaging chamber (24);

wherein the upper tool (21) comprises:

a head (36) with a respective active surface (37) configured for contacting at least a portion of the film (10*a*), a peripheral body (90) positioned around the head (36), the head and the peripheral body being mounted for relative motion the one with respect to the other among a plurality of relative positions;

relatively moving one of the peripheral body (90) and the head (36) with respect to the other, in order to form or define a cavity (40) delimited by said active surface and by an inner wall of said peripheral body;

pulling the film portion (10*b*; 18*a*) of said film inside the cavity to confer a tridimensional shape to said pulled film portion;

moving the upper and lower tool (21; 21', 21" and 22) to the second operating condition and closing the packaging chamber (24) with the product protruding portion being received inside said cavity (40) below the pulled film portion;

withdrawing gas from the packaging chamber (24) and causing at least the film portion to drape down and form a plastic skin onto product and the support (4) and/or injecting a gas mixture of prefixed composition into the packaging chamber;

heat bonding at least the film portion (10*b*; 18*a*) to the one or more supports (4) to form one or more packages;

moving the one or more packages out of the packaging assembly (8).

In a 40$^{th}$ aspect according to the preceding aspect the support (4) comprises at least one tray having a base wall (4*a*) and a side wall (4*b*) and a top rim (4*c*).

In a 41$^{st}$ aspect according to any one of the preceding two aspects, said process uses an apparatus (1) according to any one of the preceding aspects from the 1$^{st}$ to the 38$^{th}$.

In a 42$^{nd}$ aspect according to any one of the preceding three aspects the process comprises comprising cutting of the film (10*a*) into film sheets (18) outside the packaging chamber (24) at a station remote from the location where the film sheets are coupled to the supports, wherein supplying the film to the packaging assembly comprises supplying cut film sheets (18), further wherein the support (4) comprises a rim (4*c*) radially emerging from said side wall (4*b*) and delimiting a mouth of the support (4), and wherein the film sheet (18) is cut to a size to tightly close the mouth of the support (4) and sealingly engage the rim (4*c*) top surface.

In a 43$^{rd}$ aspect according to any one of the preceding four aspects, the process comprises heating the active surface (37) of said head (36) to cause heating of said film portion at least before pulling the same film portion inside said cavity.

In a 44$^{th}$ aspect according to the preceding aspect heating the active surface comprises bringing the active surface of the head (36) at least to an operating temperature comprised between 150° C. and 260° C., more optionally between 180-240° C., even more optionally between 200-220° C.

In a 45$^{th}$ aspect according to the any one of the preceding aspects from the 39$^{th}$ to the 44$^{th}$ the step of relatively moving the peripheral body with respect to the head in order to define the cavity comprises displacing the peripheral body with respect to the head from an end stroke position, where a terminal surface (95) of the peripheral body is aligned or substantially aligned with the active surface (37) of the head, to an operating position, where the terminal surface of the peripheral body is displaced from the active surface by a distance which represents the height of said cavity.

In a 46$^{th}$ aspect according to the any one of the preceding aspects from the 39$^{th}$ to the 45$^{th}$ the step of causing said film portion to move from a substantially flat configuration to a substantially tri-dimensional configuration inside said cavity takes place after or contemporaneously with formation of said cavity.

In a 47$^{th}$ aspect according to the any one of the preceding aspects from the 39$^{th}$ to the 46$^{th}$ the process comprises detecting or calculating one of:

the overall height of the product hosted in a support, the height (Hp) of the protruding portion of said product (P), and forming said cavity (40) with a height (Hc) equal to or greater than the height (Hp) of said protruding portion.

In a 48$^{th}$ aspect according to the any one of the preceding aspects from the 39$^{th}$ to the 47$^{th}$ after formation of said cavity (40), the same cavity is kept unchanged at least until heat sealing of the film portion to the support.

In a 49$^{th}$ aspect according to the any one of the preceding aspects from the 39$^{th}$ to the 48$^{th}$ said film portion (10*b*) during or at least at the end of said deformation contacts the inside wall of said cavity and optionally takes the same shape of the cavity (40).

In a 50$^{th}$ aspect according to the any one of the preceding aspects from the 39$^{th}$ to the 49$^{th}$ the step of supplying a plastic film (10*a*) comprises supplying a continuous plastic film (10*a*), further wherein the process comprises:

cutting the continuous film into film sheets (18) of prefixed length at a cutting station (6) located outside of the packaging chamber (24);

positioning the upper tool (21; 21', 21") in correspondence of the cutting station (6);

forming said cavity (40);

pulling the portion (10*b*) of the cut film sheet inside the cavity conferring said tri-dimensional configuration to said cut film sheet;

positioning the upper tool (21; 21', 21") holding the cut film sheet at the packaging assembly (8) such that the at least one cut film sheet (18) having the tridimensional configuration is brought above the respective support (4);

causing the upper and lower tools (20, 21; 21', 21") to move to the second operating condition, and trapping the peripheral edge of said cut film sheet between a support top and said terminal surface (95) of the peripheral body;

bonding, in particular heat bonding the peripheral edge of said cut film sheet to the support top, and causing a prefixed level of vacuum being formed in the packaging chamber for the cut film sheet to drape down and form a skin onto the support and onto the product and/or alternatively injecting a predetermined gas mixture in the packaging chamber.

In a 51$^{st}$ aspect according to the any one of the preceding aspects from the 39$^{th}$ to the 49$^{th}$ the step of supplying a plastic film comprises supplying a continuous plastic film, further wherein the process comprises:

blocking the continuous film (10*a*) against an abutting surface (121) of the upper tool and stopping said film portion (10*b*) above at least one respective support (4);

forming said cavity (40), pulling said portion of film (10*b*) inside the cavity conferring said tri-dimensional configuration, causing the upper and lower tools (20, 21) to move to the second operating condition, bonding, in particular heat bonding, the peripheral edge of said film portion (10*b*) to the support top, and causing a prefixed level of vacuum being formed in the packaging chamber (40) for the film portion (10*b*) to drape down and form a skin onto the support and onto the product and/or alternatively injecting a predetermined gas mixture in the packaging chamber, after vacuum formation and/or after the gas mixture injection, cutting the film portion (10*b*) from the continuous film.

In a 52$^{nd}$ aspect according to the any one of the preceding aspects from the 39$^{th}$ to the 49$^{th}$ the step of supplying a plastic film comprises supplying a continuous plastic film (10*a*) between the upper and lower tools; the process including:

supplying a prefixed number of supports (4) by supplying a continuous web (141) including a plurality of thermoformed supports in the form of interconnected trays;

bringing the upper tool (20) in contact with the continuous film;

forming said cavity (40), pulling said portion of film (10*b*) inside the cavity conferring said tri-dimensional configuration, causing the upper and lower tools (20, 21) to move to the second operating condition, trapping a peripheral edge (10*d*) of said film portion (10*b*) between a support top rim (4*c*) and said terminal surface of the peripheral body (95), bonding, in particular heat bonding, the peripheral edge (10*d*) of said film portion to the support top rim (4*c*), and causing a prefixed level of vacuum being formed in the packaging chamber (24) for the film portion to drape down and form a skin onto the supports and onto the products and/or alternatively injecting a predetermined gas mixture in the packaging chamber.

In a 53$^{rd}$ aspect according to the any one of the preceding aspects from the 39$^{th}$ to the 49$^{th}$ the step of supplying a plastic film (10*a*) comprises:

supplying a continuous film (10*a*);

cutting the continuous film into film sheets (18) of prefixed length at a cutting station located outside of the packaging chamber (24);

placing at least one film sheet (18) in front of said active surface (37) of the head (36) and above the respective support (4);

and wherein the process further comprises:

forming said cavity (40);

pulling a portion (18*b*) of the cut film sheet (18) inside the cavity to take said tri-dimensional configuration, causing the upper and lower tools (20, 21) to move to the second operating condition and trapping the peripheral edge of said cut film sheet between a support top and said terminal surface of the peripheral body (95), bonding, in particular heat bonding, the peripheral edge of said film portion (10*b*) to the support top rim (4*c*), and causing a prefixed level of vacuum being formed in the packaging chamber for the film sheet to drape down and form a skin onto the support and onto the product and/or alternatively injecting a predetermined gas mixture in the packaging chamber.

In a 54$^{th}$ aspect in accordance with any one of aspects from the 35$^{th}$ to the 53$^{rd}$ the transfer mechanism (300) configured for positioning the cut film sheets (18) inside the packaging assembly and above the respective support (4) is further configured to act on a backing structure (16) having a flat holding surface (17) adapted for receiving the at least one or more film sheets (18) cut by blade (14).

The transfer mechanism may include a transfer actuator (301), e.g. carried by frame (2), active on the backing structure (16) and configured for relatively moving the backing structure (16) with respect to the packaging assembly (8) between a first position, where the baking structure (16) is positioned by the cutting device e.g. immediately downstream the blade (14) with respect to the movement imposed to film (10*a*), and at least a second position, where the backing structure (16) is positioned inside packaging assembly (8).

In a 55$^{th}$ aspect according to the preceding aspect the transfer actuator (301) is configured to be active on the backing structure (16) and configured for pushing and pulling the backing structure along a path suitable for achieving the displacement between said first and second positions: for example, the transfer actuator may displace the backing structure along a direction parallel to an horizontal direction. The transfer actuator stroke is such that the backing structure positions at least one film sheet (18) above said support (4) inside the packaging assembly (8) just in front of a central portion of the upper tool (21). The transfer actuator 301 may comprise at least one electric, pneumatic or hydraulic actuator.

In a 56$^{th}$ aspect according to any one of the preceding two aspects the transfer actuator is controlled by the control unit (100), which is also configured to control a positioning system (302), e.g. comprising a vacuum system connected to one or more channels (303) present in the backing structure and leading to apertures located one holding surface (17), of the transfer mechanism for maintaining the cut film sheet or sheets in proper position above the backing structure (16) at least until the upper tool holding means picks the cut film sheet from the backing structure (16).

In a 57$^{th}$ aspect according to the preceding aspect the control unit is configured to coordinate the actuation of transfer actuator (301), the actuation of the positioning system (302), the actuation of the holding means (38) and, optionally, that of the cutting assembly (6) such that:

while the cutting assembly (6) is commanded to cut the film sheet(s), the transfer actuator (301) is kept in the first position and the positioning system (302) controlled to keep the film adhering to the backing structure (16), after the film sheet(s) have been cut, the transfer actuator (301) is controlled to move to the second position, with the positioning system (302) controlled to keep the film adhering to the backing structure (16), when the backing structure (16) has reached the second position, the transfer actuator (301) is kept at the second position for a short time interval, the positioning system (302) is commanded to release the cut film sheet(s) and the holding means (38) are controlled to pick the cut film sheet(s) from the backing structure, and then the transfer actuator is controlled to go back to the first position.

It is to be noted that the transfer mechanism (300) may also include further actuators and, in a variant, cause the backing structure to move back and forth between the first and the second position following a nonlinear trajectory.

In a 58$^{th}$ aspect according to anyone of the preceding aspects the head and the peripheral body are mounted for relative motion the one with respect to the other among a plurality of relative positions and being configured for defining a cavity (40) delimited by said active surface (37) and by an inner wall (92) of said peripheral body: the maximum stroke of said relative motion being greater than 5 mm.

In a 59$^{th}$ aspect according to anyone of the preceding aspects the head and the peripheral body are mounted for relative motion the one with respect to the other among a plurality of relative positions and being configured for defining a cavity (40) delimited by said active surface (37) and by an inner wall (92) of said peripheral body: the maximum stroke of said relative motion being greater than 10 mm.

In a 60$^{th}$ aspect according to anyone of the preceding aspects the head and the peripheral body are mounted for relative motion the one with respect to the other among a plurality of relative positions and being configured for defining a cavity (40) delimited by said active surface (37) and by an inner wall (92) of said peripheral body: the maximum stroke of said relative motion being greater than 20 mm.

In a 61$^{st}$ aspect according to anyone of the preceding aspects the head and the peripheral body are mounted for relative motion the one with respect to the other among a plurality of relative positions and being configured for defining a cavity (40) delimited by said active surface (37) and by an inner wall (92) of said peripheral body: the maximum stroke of said relative motion being greater than 30 mm and may reach 100 mm or even up to 200 mm.

BRIEF DESCRIPTION OF THE DRAWINGS

Aspects of the present invention are disclosed in the following detailed description, given by way of example and not of limitation, to be read with reference to the accompanying drawings, wherein.

DEFINITIONS AND CONVENTIONS

Figure 1:
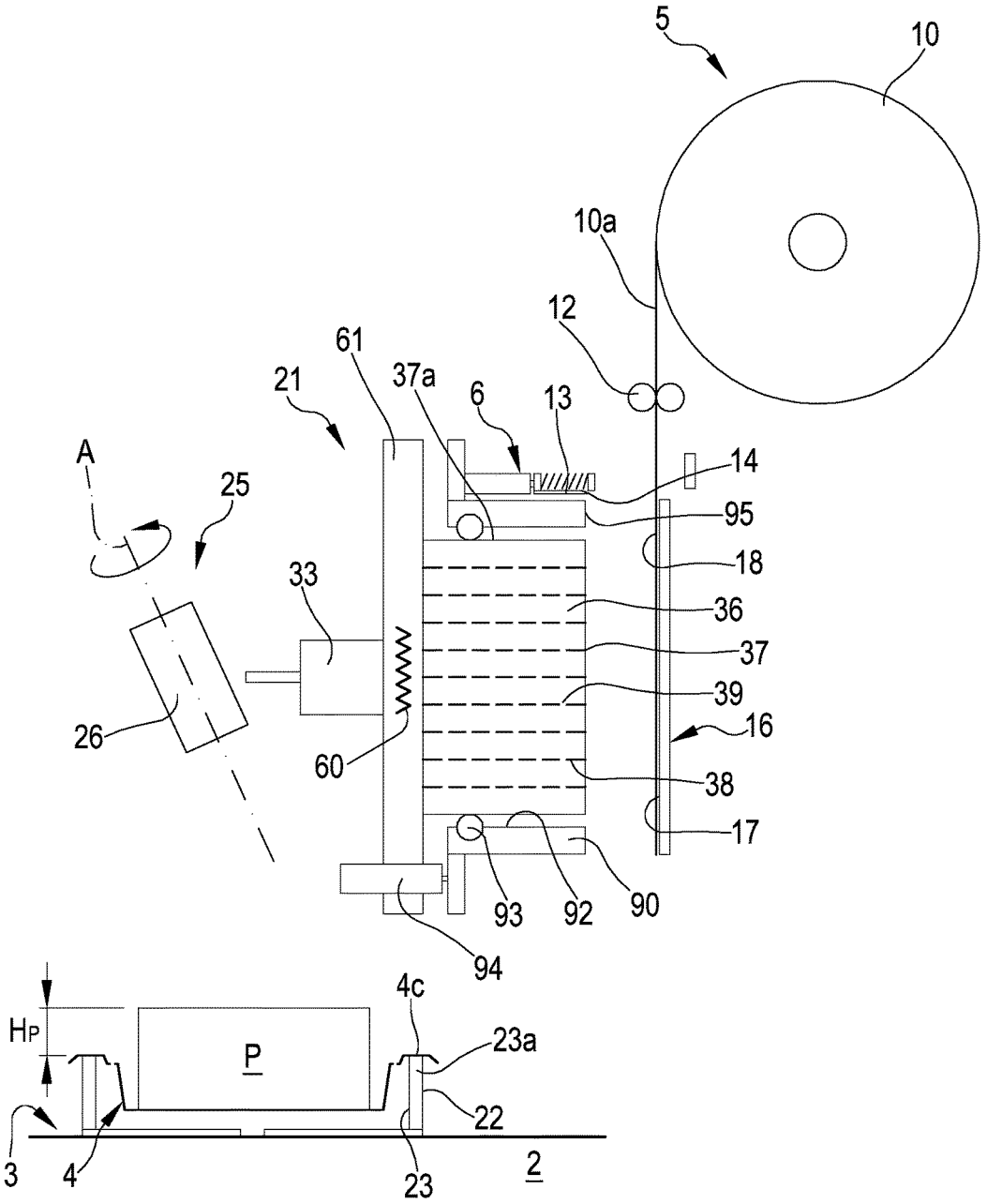
FIGS. 1-7 are schematic side views relating to a first embodiment of a packaging apparatus according to aspects of the invention. In these figures consecutive phases of a packaging process operated by the apparatus of the first embodiment are shown.
Figure 2:
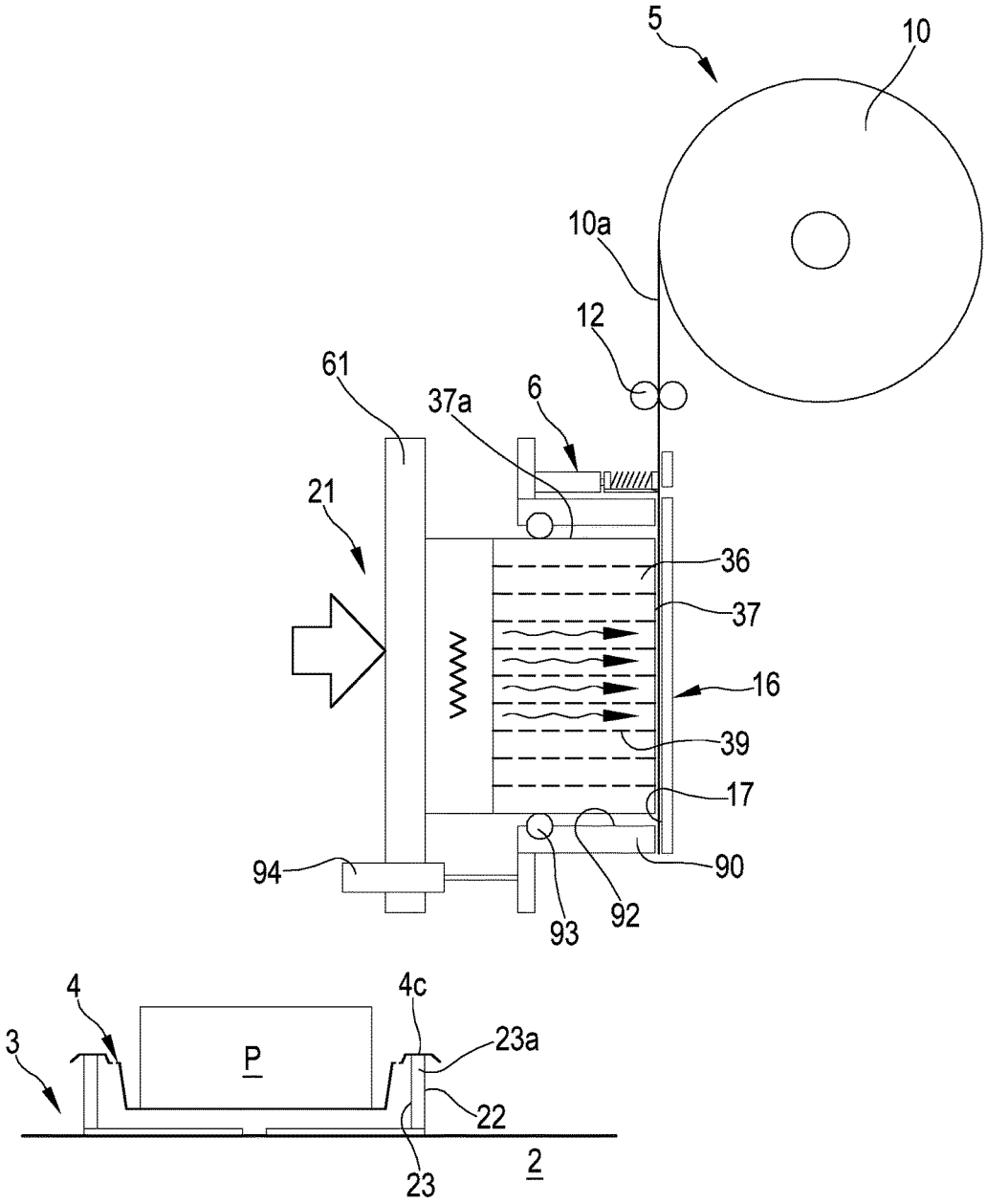

It should be noted that in the present detailed description corresponding parts shown in the various figures are indicated with the same reference numeral through the figures. Note that the figures are not in scale and thus the parts and components shown therein are schematic representations.

In the following description and claims the apparatus and process refer to packaging of a product inside a support: the product may be a food product or not.

The Trays or Supports

As used herein support 4 means a container of the type having a base wall 4*a*, a side wall 4*b* and optionally a top rim 4*c* radially emerging from the side wall 4*b*; alternatively the support or tray may be flat and may be made either in plastic material or in cardboard.

Note that for the purpose of the present description tray and support have the same meaning and are interchangeably used. The tray or supports 4 may have a rectangular shape or any other suitable shape, such as round, square, elliptical and other. Trays or supports with a side wall may be manufactured by thermoforming or injection molding or in—case of flat supports—they may be extruded, co-extruded, laminated and then the cut to size.

The trays or supports 4 described and claimed herein may be made of a single layer or of a multi-layer polymeric material.

In case of a single layer material suitable polymers are for instance polystyrene, polypropylene, polyesters, high density polyethylene, poly(lactic acid), PVC and the like, either foamed or solid.

Preferably the tray 4 is provided with gas barrier properties. As used herein such term refers to a film or sheet of material which has an oxygen transmission rate of less than 200 cm3/m2-day-bar, less than 150 cm3/m2-day-bar, less than 100 cm3/m2-day-bar as measured according to ASTM D-3985 at 23° C. and 0% relative humidity. Suitable materials for gas barrier monolayer thermoplastic trays 4 are for instance polyesters, polyamides and the like.

In case the tray 4 is made of a multi-layer material, suitable polymers are for instance ethylene homo- and co-polymers, propylene homo- and co-polymers, polyamides, polystyrene, polyesters, poly(lactic acid), PVC and the like. Part of the multi-layer material can be solid and part can be foamed.

For example, the tray 4 may comprises at least one layer of a foamed polymeric material chosen from the group consisting of polystyrene, polypropylene, polyesters and the like.

The multi-layer material may be produced either by co-extrusion of all the layers using co-extrusion techniques or by glue- or heat-lamination of, for instance, a rigid foamed or solid substrate with a thin film, usually called "liner".

The thin film may be laminated either on the side of the tray 4 in contact with the product P or on the side facing away from the product P or on both sides. In the latter case the films laminated on the two sides of the tray 4 may be the same or different. A layer of an oxygen barrier material, for instance (ethylene-co-vinyl alcohol) copolymer, is optionally present to increase the shelf-life of the packaged product P.

Gas barrier polymers that may be employed for the gas barrier layer are PVDC, EVOH, polyamides, polyesters and blends thereof. The thickness of the gas barrier layer will be set in order to provide the tray with an oxygen transmission rate suitable for the specific packaged product.

The tray may also comprise a heat sealable layer. Generally, the heat-sealable layer will be selected among the polyolefins, such as ethylene homo- or co-polymers, propylene homo- or co-polymers, ethylene/vinyl acetate copolymers, ionomers, and the homo- and co-polyesters, e.g. PETG, a glycol-modified polyethylene terephthalate. Additional layers, such as adhesive layers, to better adhere the gas-barrier layer to the adjacent layers, may be present in the gas barrier material for the tray and are preferably present depending in particular on the specific resins used for the gas barrier layer.

In case of a multilayer material used to form the tray 4, part of this structure may be foamed and part may be un-foamed. For instance, the tray 4 may comprise (from the outermost layer to the innermost food-contact layer) one or more structural layers, typically of a material such as foam polystyrene, foam polyester or foam polypropylene, or a cast sheet of e.g. polypropylene, polystyrene, poly(vinyl chloride), polyester or cardboard; a gas barrier layer and a heat-sealable layer.

The tray 4 may be obtained from a sheet of foamed polymeric material having a film comprising at least one oxygen barrier layer and at least one surface sealing layer laminated onto the side facing the packaged product, so that the surface sealing layer of the film is the food contact layer the tray. A second film, either barrier or non-barrier, may be laminated on the outer surface of the tray.

Specific tray 4 formulations are used for food products which require heating in conventional or microwave oven before consumption. The surface of the container in contact with the product, i.e. the surface involved in the formation of the seal with the lidding film, comprises a polyester resin. For instance the container can be made of a cardboard coated with a polyester or it can be integrally made of a polyester resin. Examples of suitable containers for the package of the invention are CPET, APET or APET/CPET containers. Such container can be either foamed or not-foamed.

Trays 4 containing foamed parts, have a total thickness lower than 8 mm, and for instance may be comprised between 0.5 mm and 7.0 mm and more frequently between 1.0 mm and 6.0 mm.

In case of rigid tray not containing foamed parts, the total thickness of the single-layer or multi-layer thermoplastic material is preferably lower than 2 mm, and for instance may be comprised between 0.1 mm and 1.2 mm and more frequently between 0.2 mm and 1.0 mm.

The Film or Film Material

The film or film material 10*a* described and claimed herein may be applied to the tray or support 4 to form a lid onto the tray (e.g. for MAP—modified atmosphere packaging) or a skin associated to the tray and matching the contour of the product.

The film for skin applications may be made of a flexible multi-layer material comprising at least a first outer heat-sealable layer, an optional gas barrier layer and a second outer heat-resistant layer. The outer heat-sealable layer may comprise a polymer capable of welding to the inner surface of the supports carrying the products to be packaged, such as for instance ethylene homo- or co-polymers, like LDPE, ethylene/alpha-olefin copolymers, ethylene/acrylic acid copolymers, ethylene/methacrylic acid copolymers, and ethylene/vinyl acetate copolymers, ionomers, co-polyesters, e.g. PETG. The optional gas barrier layer preferably comprises oxygen impermeable resins like PVDC, EVOH, polyamides and blends of EVOH and polyamides. The outer heat-resistant layer may be made of ethylene homo- or copolymers, ethylene/cyclic-olefin copolymers, such as ethylene/norbornene copolymers, propylene homo- or co-polymers, ionomers, (co)polyesters, (co)polyamides. The film may also comprise other layers such as adhesive layers or bulk layers to increase thickness of the film and improve its abuse and deep drawn properties. Particularly used bulk layers are ionomers, ethylene/vinyl acetate copolymers, polyamides and polyesters. In all the film layers, the polymer components may contain appropriate amounts of additives normally included in such compositions. Some of these additives are preferably included in the outer layers or in one of the outer layers, while some others are preferably added to inner layers. These additives include slip and anti-block agents such as talc, waxes, silica, and the like, antioxidants, stabilizers, plasticizers, fillers, pigments and dyes, cross-linking inhibitors, cross-linking enhancers, UV absorbers, odour absorbers, oxygen scavengers, bactericides, antistatic agents and the like additives known to those skilled in the art of packaging films.

One or more layers of the film can be cross-linked to improve the strength of the film and/or its heat resistance. Cross-linking may be achieved by using chemical additives or by subjecting the film layers to an energetic radiation treatment. The films for skin packaging are typically manufactured in order to show low shrink when heated during the packaging cycle. Those films usually shrink less than 15% at 160° C., more frequently lower than 10%, even more frequently lower than 8% in both the longitudinal and transversal direction (ASTM D2732). The films usually have a thickness comprised between 20 microns and 200 microns, more frequently between 40 and 180 microns and even more frequently between 50 microns and 150 microns.

The skin packages are usually "easy-to-open", i.e. they are easily openable by manually pulling apart the two webs, normally starting from a point like a corner of the package where the upper web has purposely not been sealed to the support. To achieve this feature, either the film or the tray can be provided with a suitable composition, allowing easy opening of the package, as known in the art. Typically, the sealant composition and/or the composition of the adjacent layer of the tray and/or the film are adjusted in order to achieve the easy opening feature.

Various mechanisms can occur while opening an easy-to-open package.

In the first one ("peelable easy opening") the package is opened by separating the film and the tray at the seal interface.

In the second mechanism ("adhesive failure") the opening of the package is achieved through an initial breakage through the thickness of one of the sealing layers followed by delamination of this layer from the underlying support or film.

The third system is based on the "cohesive failure" mechanism: the easy opening feature is achieved by internal rupture of a seal layer that, during opening of the package, breaks along a plane parallel to the layer itself.

Specific blends are known in the art to obtain such opening mechanisms, ensure the peeling of the film from the tray surface, such as those described in EP1084186.

On the other hand, in case the film 10*a* is used for creating a lid on the tray or support 4, the film material may be obtained by co-extrusion or lamination processes. Lid films may have a symmetrical or asymmetrical structure and can be monolayer or multilayer.

The multilayer films have at least 2, more frequently at least 5, even more frequently at least 7 layers. The total thickness of the film may vary frequently from 3 to 100 micron, in particular from 5 to 50 micron, even more frequently from 10 to 30 micron.

The films may be optionally cross-linked. Cross-linking may be carried out by irradiation with high energy electrons at a suitable dosage level as known in the art. The lid films described above may be heat shrinkable or heat-set. The heat shrinkable films typically show free shrink value at 120° C. measured according to ASTM D2732 in the range of from 2 to 80%, more frequently from 5 to 60%, even more frequently from 10 to 40% in both the longitudinal and transverse direction. The heat-set films usually have free shrink values lower than 10% at 120° C., preferably lower than 5% in both the longitudinal and transversal direction (ASTM D 2732). Lid films usually comprise at least a heat sealable layer and an outer skin layer, which is generally made up of heat resistant polymers or polyolefin. The sealing layer typically comprises a heat-sealable polyolefin which in turn comprises a single polyolefin or a blend of two or more polyolefins such as polyethylene or polypropylene or a blend thereof. The sealing layer can be further provided with antifog properties by incorporating one or more antifog additives into its composition or by coating or spraying one or more antifog additives onto the surface of the sealing layer by technical means well known in the art. The sealing layer may further comprise one or more plasticisers. The skin layer may comprises polyesters, polyamides or polyolefin. In some structures, a blend of polyamide and polyester can advantageously be used for the skin layer. In some cases, the lid films comprise a barrier layer. Barrier films typically have an OTR (evaluated at 23° C. and 0% R.H. according to ASTM D-3985) below 100 $cm^3/(m^2 \cdot day \cdot atm)$ and more frequently below 80 $cm^3/(m^2 \cdot day \cdot atm)$. The barrier layer is usually made of a thermoplastic resin selected among a saponified or hydrolyzed product of ethylene-vinyl acetate copolymer (EVOH), an amorphous polyamide and a vinyl-vinylidene chloride and their admixtures. Some materials comprise an EVOH barrier layer, sandwiched between two polyamide layers. The skin layer typically comprises polyesters, polyamides or polyolefin.

In some packaging applications, the lid films do not comprise any barrier layer. Such films usually comprise one or more polyolefin are herein defined.

Non-barrier films typically have an OTR (evaluated at 23° C. and 0% R.H. according to ASTM D-3985) from 100 $cm^3/(m^2 \cdot day \cdot atm)$ up to 10000 $cm^3/(m^2 \cdot day \cdot atm)$, more typically up to 6000 $cm^3/(m^2 \cdot day \cdot atm)$.

Peculiar compositions polyester-based are those used for tray lidding of ready-meals packages. For these films, the polyester resins can make up at least 50%, 60%, 70%, 80%, 90% by weight of the film. These films are typically used in combination with polyester-based supports.

For instance the container can be made of a cardboard coated with a polyester or it can be integrally made of a polyester resin. Examples of suitable containers for the package are CPET, APET or APET/CPET containers, either foamed or not-foamed.

Usually, biaxially oriented PET are used as the lid film due to its high thermal stability at standard food heating/cooking temperatures. Often biaxially oriented polyester films are heat-set, i.e. non-heat-shrinkable. To improve the heat-sealability of the PET lidding film to the container a heat-sealable layer of a lower melting material is usually provided on the film. The heat-sealable layer may be coextruded with the PET base layer (as disclosed in EP-A-1,529,797 and WO2007/093495) or it may be solvent- or extrusion-coated over the base film (as disclosed in U.S. Pat. No. 2,762,720 and EP-A-1,252,008).

Particularly in the case of fresh red meat packages, twin lidding film comprising an inner, oxygen-permeable, and an outer, oxygen-impermeable, lidding film are advantageously used. The combination of these two films significantly prevents the meat discoloration also when the packaged meat extends upwardly with respect to the height of the tray walls, which is the most critical situation in barrier packaging of fresh meat.

These films are described for example in EP1848635 and EP0690012, the disclosures of which are herein incorporated by reference.

The lid film can be monolayer. Typical composition of monolayer films comprise polyesters as herein defined and their blends or polyolefins as herein defined and their blends. Double or multiple layer films may however also be used.

In all the film layers herein described, the polymer components may contain appropriate amounts of additives normally included in such compositions. Some of these additives are preferably included in the outer layers or in one of the outer layers, while some others are preferably added to inner layers. These additives include slip and anti-block agents such as talc, waxes, silica, and the like, antioxidants, stabilizers, plasticizers, fillers, pigments and dyes, cross-linking inhibitors, cross-linking enhancers, UV absorbers, odor absorbers, oxygen scavengers, bactericides, antistatic agents, anti-fog agents or compositions, and the like additives known to those skilled in the art of packaging films.

The films suitable for lidding application can advantageously be perforated, in order to allow the packaged food to breath.

Those films may be perforated by using different technologies available in the art, through laser or mechanical means such as rolls provided with several needles.

The number of perforations per unit area of the film and their dimensions affect the gas permeability of the film.

Microperforated films are usually characterized by OTR value (evaluated at 23° C. and 0% R.H. according to ASTM D-3985) from 2500 $cm^3/(m^2 \cdot day \cdot atm)$ up to 1000000 $cm^3/(m^2 \cdot day \cdot atm)$.

Macroperforated films are usually characterized by OTR (evaluated at 23° C. and 0% R.H. according to ASTM D-3985) higher than 1000000 $cm^3/(m^2 \cdot day \cdot atm)$.

Furthermore, the films herein described for lidding applications can be formulated to provide strong or peelable sealing onto the support. A method of measuring the force of a peelable seal, herein referred to as "peel force" is described in ASTM F-88-00. Acceptable peel force values fare in the range from 100 g/25 mm to 850 g/25 mm, from 150 g/25 mm to 800 g/25 mm, from 200 g/25 mm to 700 g/25 mm.

The desired seal strength is achieved specifically designing the tray and the lid formulations.

In general, one or more layers of the lid film can be printed, in order to provide useful information to the consumer, a pleasing image and/or trademark or other advertising information to enhance the retail sale of the packaged product. The film may be printed by any suitable method, such as rotary screen, gravure or flexographic techniques mass known in the art.

Definitions and Conventions Concerning Materials

PVDC is any vinylidene chloride copolymers wherein a major amount of the copolymer comprises vinylidene chloride and a minor amount of the copolymer comprises one or more unsaturated monomers copolymerisable therewith, typically vinyl chloride, and alkyl acrylates or methacrylates (e.g. methyl acrylate or methacrylate) and the blends thereof in different proportions. Generally a PVDC barrier layer will contain plasticisers and/or stabilizers as known in the art.

As used herein, the term EVOH includes saponified or hydrolyzed ethylene-vinyl acetate copolymers, and refers to ethylene/vinyl alcohol copolymers having an ethylene comonomer content preferably comprised from about 28 to about 48 mole %, more preferably, from about 32 to about 44 mole % ethylene, and even more preferably, and a saponification degree of at least 85%, preferably at least 90%.

The term "polyamides" as used herein is intended to refer to both homo- and co- or ter-polyamides. This term specifically includes aliphatic polyamides or co-polyamides, e.g., polyamide 6, polyamide 11, polyamide 12, polyamide 66, polyamide 69, polyamide 610, polyamide 612, copolyamide 6/9, copolyamide 6/10, copolyamide 6/12, copolyamide 6/66, copolyamide 6/69, aromatic and partially aromatic polyamides or co-polyamides, such as polyamide 6I, polyamide 6I/6T, polyamide MXD6, polyamide MXD6/MXDI, and blends thereof.

As used herein, the term "copolymer" refers to a polymer derived from two or more types of monomers, and includes terpolymers. Ethylene homopolymers include high density polyethylene (HDPE) and low density polyethylene (LDPE). Ethylene copolymers include ethylene/alpha-olefin copolymers and ethylene/unsaturated ester copolymers. Ethylene/alpha-olefin copolymers generally include copolymers of ethylene and one or more comonomers selected from alpha-olefins having from 3 to 20 carbon atoms, such as 1-butene, 1-pentene, 1-hexene, 1-octene, 4-methyl-1-pentene and the like.

Ethylene/alpha-olefin copolymers generally have a density in the range of from about 0.86 to about 0.94 g/cm3. The term linear low density polyethylene (LLDPE) is generally understood to include that group of ethylene/alpha-olefin copolymers which fall into the density range of about 0.915 to about 0.94 g/cm3 and particularly about 0.915 to about 0.925 g/cm3. Sometimes linear polyethylene in the density range from about 0.926 to about 0.94 g/cm3 is referred to as linear medium density polyethylene (LMDPE). Lower density ethylene/alpha-olefin copolymers may be referred to as very low density polyethylene (VLDPE) and ultra-low density polyethylene (ULDPE). Ethylene/alpha-olefin copolymers may be obtained by either heterogeneous or homogeneous polymerization processes.

Another useful ethylene copolymer is an ethylene/unsaturated ester copolymer, which is the copolymer of ethylene and one or more unsaturated ester monomers. Useful unsaturated esters include vinyl esters of aliphatic carboxylic acids, where the esters have from 4 to 12 carbon atoms, such as vinyl acetate, and alkyl esters of acrylic or methacrylic acid, where the esters have from 4 to 12 carbon atoms.

Ionomers are copolymers of an ethylene and an unsaturated monocarboxylic acid having the carboxylic acid neutralized by a metal ion, such as zinc or, preferably, sodium.

Useful propylene copolymers include propylene/ethylene copolymers, which are copolymers of propylene and ethylene having a majority weight percent content of propylene, and propylene/ethylene/butene terpolymers, which are copolymers of propylene, ethylene and 1-butene.

As used herein, the term "polyolefin" refers to any polymerized olefin, which can be linear, branched, cyclic, aliphatic, aromatic, substituted, or unsubstituted. More specifically, included in the term polyolefin are homo-polymers of olefin, co-polymers of olefin, co-polymers of an olefin and an non-olefinic co-monomer co-polymerizable with the olefin, such as vinyl monomers, modified polymers thereof, and the like. Specific examples include polyethylene homo-polymer, polypropylene homo-polymer, polybutene homo-polymer, ethylene-alpha-olefin co-polymer, propylene-alpha-olefin co-polymer, butene-alpha-olefin co-polymer, ethylene-unsaturated ester co-polymer, ethylene-unsaturated acid co-polymer, (e.g. ethylene-ethyl acrylate co-polymer, ethylene-butyl acrylate co-polymer, ethylene-methyl acrylate co-polymer, ethylene-acrylic acid co-polymer, and ethylene-methacrylic acid co-polymer), ethylene-vinyl acetate copolymer, ionomer resin, polymethylpentene, etc.

The term "polyester" is used herein to refer to both homo- and co-polyesters, wherein homo-polyesters are defined as polymers obtained from the condensation of one dicarboxylic acid with one diol and co-polyesters are defined as polymers obtained from the condensation of one or more dicarboxylic acids with one or more diols. Suitable polyester resins are, for instance, polyesters of ethylene glycol and terephthalic acid, i.e. poly(ethylene terephthalate) (PET). Preference is given to polyesters which contain ethylene units and include, based on the dicarboxylate units, at least 90 mol %, more preferably at least 95 mol %, of terephthalate units. The remaining monomer units are selected from other dicarboxylic acids or diols. Suitable other aromatic dicarboxylic acids are preferably isophthalic acid, phthalic acid, 2,5-, 2,6- or 2,7-naphthalenedicarboxylic acid. Of the cycloaliphatic dicarboxylic acids, mention should be made of cyclohexanedicarboxylic acids (in particular cyclohexane-1,4-dicarboxylic acid). Of the aliphatic dicarboxylic acids, the (C3-Ci9)alkanedioic acids are particularly suitable, in particular succinic acid, sebacic acid, adipic acid, azelaic acid, suberic acid or pimelic acid. Suitable diols are, for example aliphatic diols such as ethylene glycol, diethylene glycol, triethylene glycol, propylene glycol, 1,3-butane diol, 1,4-butane diol, 1,5-pentane diol, 2,2-dimethyl-1,3-propane diol, neopentyl glycol and 1,6-hexane diol, and cycloaliphatic diols such as 1,4-cyclohexanedimethanol and 1,4-cyclohexane diol, optionally heteroatom-containing diols having one or more rings.

Co-polyester resins derived from one or more dicarboxylic acid(s) or their lower alkyl (up to 14 carbon atoms) diesters with one or more glycol(s), particularly an aliphatic or cycloaliphatic glycol may also be used as the polyester resins for the base film. Suitable dicarboxylic acids include aromatic dicarboxylic acids such as terephthalic acid, isophthalic acid, phthalic acid, or 2,5-, 2,6- or 2,7-naphthalenedicarboxylic acid, and aliphatic dicarboxylic acids such as succinic acid, sebacic acid, adipic acid, azelaic acid, suberic acid or pimelic acid. Suitable glycol(s) include aliphatic diols such as ethylene glycol, diethylene glycol, triethylene glycol, propylene glycol, 1,3-butane diol, 1,4-butane diol, 1,5-pentane diol, 2,2-dimethyl-1,3-propane diol, neopentyl glycol and 1,6-hexane diol, and cycloaliphatic diols such as 1,4-cyclohexanedimethanol and 1,4-cyclohexane diol. Examples of such copolyesters are (i) copolyesters of azelaic acid and terephthalic acid with an aliphatic glycol, preferably ethylene glycol; (ii) copolyesters of adipic acid and terephthalic acid with an aliphatic glycol, preferably ethylene glycol; and (iii) copolyesters of sebacic acid and terephthalic acid with an aliphatic glycol, preferably butylene glycol; (iv) co-polyesters of ethylene glycol, terephthalic acid and isophthalic acid. Suitable amorphous co-polyesters are those derived from an aliphatic diol and a cycloaliphatic diol with one or more, dicarboxylic acid(s), preferably an aromatic dicarboxylic acid. Typical amorphous copolyesters include co-polyesters of terephthalic acid with an aliphatic diol and a cycloaliphatic diol, especially ethylene glycol and 1,4-cyclohexanedimethanol.

DETAILED DESCRIPTION

The support shown in the figures of all embodiments is in the form of a tray 4 which presents a base wall 4*a*, a side wall 4*b* emerging from the base wall and delimiting a space where a product P can be housed, and a top rim 4*c* radially protruding from the side wall 4*b*. In the examples shown the top rim 4*c* has a horizontal flat portion defining an optimal sealing surface for tightly fixing a plastic film.

The product P to be packaged is housed inside the tray 4 and protrudes by a height Hp above the top rim 4*c* of the tray. The apparatuses and processes according to below description and according to any one of the appended claims are adapted for efficiently packaging supports or trays of the type described above housing a protruding product P. Note, however, that the apparatuses and processes herein disclosed and claim are also adequate for the packaging of products which are not protruding above the top rim 4*c*.

First Embodiment of the Apparatus 1

FIGS. 1-7 and 18 show an apparatus 1 for packaging of a product P arranged on a support or tray 4. The apparatus 1 is adapted for vacuum skin packaging of the product P, where a thin film of plastic material, such as film sheet 18 described below, is draped down on the product P and intimately adheres to a top rim 4*c* and to the inner surface of the support 4 as well as to the product surface thus leaving a minimum, if any, amount of air within the packaging. The apparatus 1 may however also be used in case a film sheet is applied to a tray or support with modified atmosphere previously created in the tray. The apparatus may also be used for packaging of products on flat supports.

As it will become apparent from below description, the apparatus 1 of FIGS. 1-7 and 18 is designed for cutting a continuous film 10*a* into discrete film sheets 18 at a location (cutting station) spaced from and positioned outside a packaging assembly 8 and for then transporting the cut film sheets into the packaging assembly 8, where the film sheets 18 are bonded to the respective supports or trays 4.

The apparatus 1 comprises a frame 2, a transport assembly 3 for displacing the support or tray 4, a film supplying assembly 5, a film cutting assembly 6, and at least one packaging assembly 8. A device for transferring the cut film sheet or sheets from the cutting assembly to a position above the tray is also present; however, how the cut film sheet is transported to the packaging assembly and above the respective tray or support is not relevant: non-limiting examples of suitable transfer devices are provided herein below.

The frame 2 defines a base body of the apparatus 1 and serves to carry and support various parts of the apparatus 1 as herein described.

The transport assembly 3 comprises a displacement plane 20 (which may be a physical plane where the trays or support are lying and slide or an ideal plane along which the trays are guided e.g. by means of railways or guides). The plane 20 is defined on a top area of the frame and a conveyor 46 is arranged in correspondence of the plane 20. In the example shown, the transport assembly 3 is carried by, e.g. fixed to, the frame 2 so that the plane 20 is substantially horizontal and the conveyor 46 moves the trays or supports 4 according to the horizontal direction indicated by the arrow A1 shown in FIG. 18. The transport assembly 3 arranged on the frame 2 is configured for displacing the support or tray 4 along a predefined path from a loading station (not shown), where supports or trays 4 which may already be filled with the respective product(s) P are positioned, to the packaging assembly 8 where a film sheet 18 is tightly fixed to each support or tray 4, as it will be explained here below in detail. The conveyor 46 displaces the trays, e.g. a prefixed number of trays per time, inside the packaging assembly 8 in proper position for receiving the cut film sheets 18. For instance, a control unit 100 (operation of which will be further described herein after) may control the conveyor 46 to displace a prefixed number of trays or supports 4 per time from a region outside the packaging assembly to a region inside the packaging assembly where the tray or trays are in vertical alignment to the film sheets. The conveyor 46 may for instance include a first transfer tool 46*a* (such as the belt shown in FIG. 18), configured for bringing the trays in close proximity to the packaging assembly 8, and a second transfer tool 46*b*, adapted to pick one or more of said trays 4 and bring them into the packaging assembly 8. The second transfer tool 46*b* may for instance include arms acting on the sides of the trays or supports 4 such as to pick the supports from the first transfer tool, bring them into the packaging assembly and then return to the first transfer tool to pick a new set of trays or supports 4. Alternatively, the conveyor 46 may include pushers (e.g. in the form of bars extending transverse to said direction A1) acting on the trays and pushing the trays inside the packaging assembly. The pushers may be moved by chains or belts and may be moved into the packaging assembly to properly position a number of trays, and then be retracted from the packaging assembly, once the trays have reached their proper position inside this latter. According to a further alternative, the conveyor 46 may include housings (e.g. in the form of plates provided with cavities for receiving a number of trays) which are moved along said direction A1 and which are moving inside the packaging station together with the supports or trays 4: according to this last alternative the housings are properly shaped in order to be hosted inside the packaging station during the application of the film 10*a* to the tray or support 4. Note that the products P may be positioned on the support or tray 4 either upstream the loading station or in any location between the loading station and the packaging assembly 8. The transport assembly 3 further comprises a motor 9, e.g. a stepping motor unit, for operating the conveyor belt 46 with step-by-step movement. Although several alternatives have been described for conveying the supports or trays into the packaging assembly, any other convenient means adapted to position the supports or trays in the packaging assembly may be used as the specific structure and design of the transport assembly 3 is not relevant.

The film supply assembly 5 may comprise a film roll 10 which supplies a continuous film 10*a*. The film supplying assembly 5 may further comprise an arm 11 (represented in dashed lines in FIG. 1) fixed to the frame 2 and suitable for supporting the roll 10. Further, the film supplying assembly 5 may comprise film punching devices (not show as per se known) configured essentially to provide the correct profile to the film edges to match, when transversally cut in the cutting station by cutting assembly 6, the shape of the tray 4 mouth with rounded corners. The punching devices may also help to keep an unrolled portion of film pulled from the film roll 10 aligned according to a prefixed direction. The film supplying assembly 5 also comprises pinch rollers 12 and/or other means for pulling the film from the roll 10 and properly position it at the cutting station, in correspondence of the film cutting assembly 6 (for instance said means may comprise pincers acting on the side of the film and/or pincers acting on the front edge of the film and configured to pull the film). The film 10*a* rolled on the film roll 10 may be made and have the structure disclosed in the above section dedicated to the film, depending upon the specific need.

Figure 18:
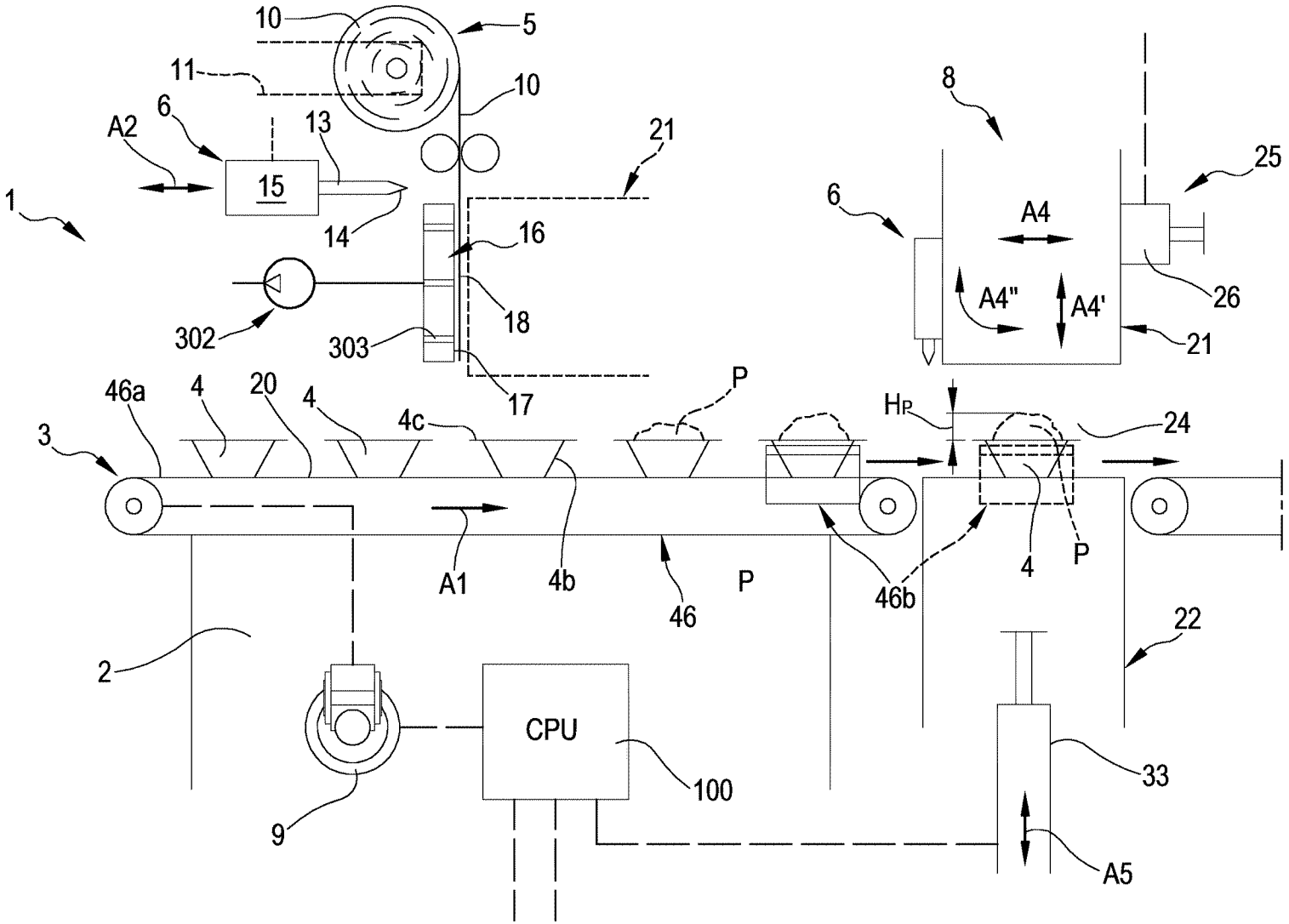
FIG. 18 is a schematic side view layout of an apparatus according to aspects of the invention. The layout of the apparatus of FIG. 18 may be adopted in the first and second embodiments described herein.
Figure 19:
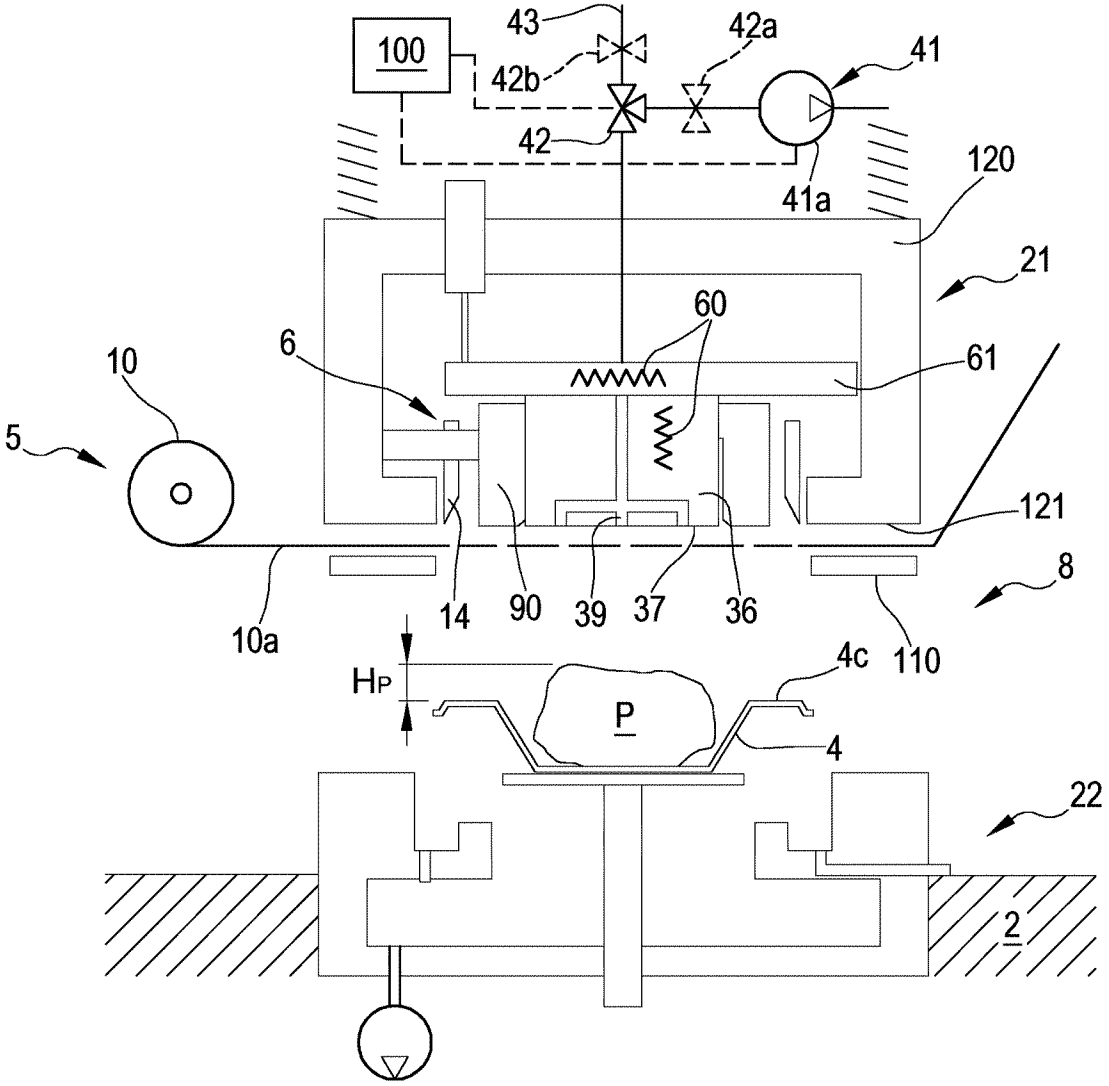
FIG. 19-28 are schematic side views relating to a third embodiment of a packaging apparatus according to aspects of the invention. In these figures consecutive phases of a packaging process operated by the apparatus of the third embodiment are shown.
Figure 20:
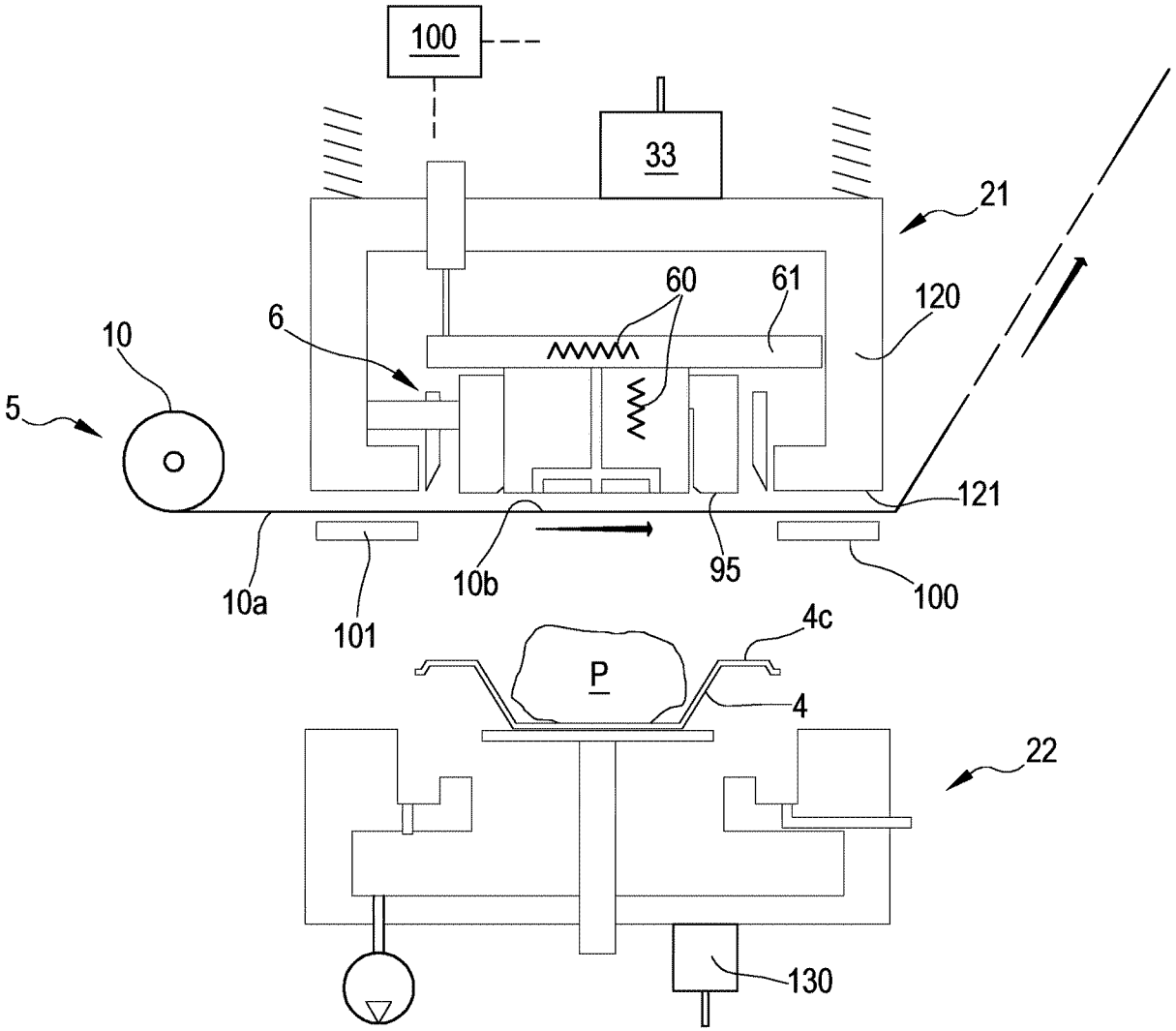
Figure 21:
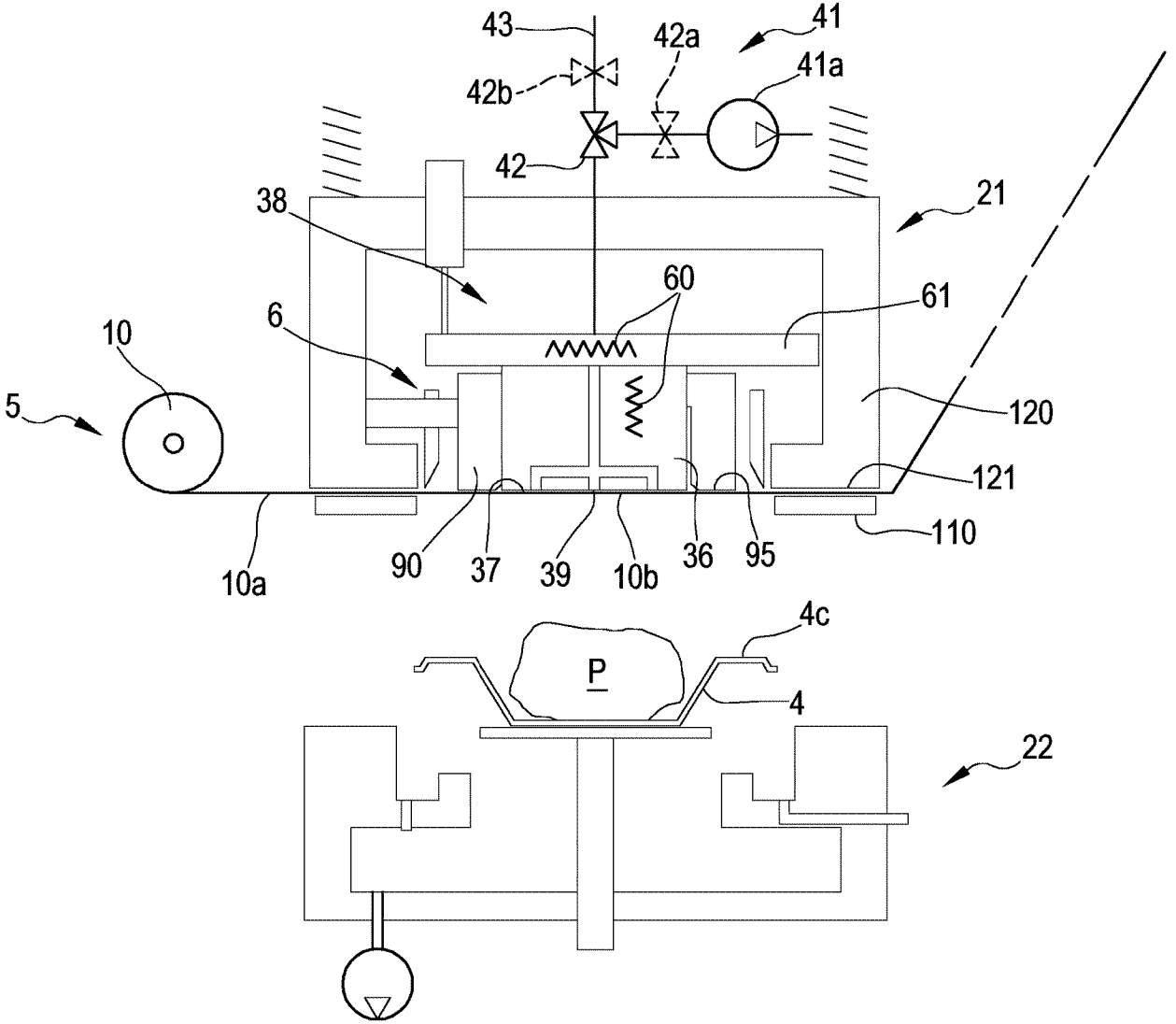

The film cutting assembly 6 may be separate from the upper tool 21 and located at the cutting station (see FIG. 18) or it may be carried by the upper tool 21 (FIGS. 1-7 shows this second alternative while FIG. 18 only schematically shows a cutting assembly carried by upper tool 21). The cutting assembly 6 comprises a cutting device 13 with a blade 14 and a blade piston 15. This piston 15 may be replaced by any other kind of electric, pneumatic or hydraulic linear actuator. The blade piston 15 is preferably fixed to the frame 2 and is connected to the cutting device 13 so as to push and pull it in a direction transverse to the unrolled portion of the film 10*a*, as indicated by the double arrow A2 shown in FIG. 1. Note that the film may be unrolled in a vertical direction with the cutting device moving horizontally. Also note that the cutting assembly and thus the cutting device, with the blade and the blade piston may be carried by the upper tool as shown e.g. in FIGS. 1-7.

The packaging assembly 8, which is only very schematically shown in FIG. 18, is configured for tightly fixing the film sheets 18 to said supports 4; the packaging assembly 8 includes a lower tool 22 and an upper tool 21. The lower tool 22 comprises a prefixed number of seats 23 for receiving said one or more supports 4, while the upper tool 21 is configured for holding at least a portion of the film 10*a*. The upper tool and the lower tool are configured to be movable the one relative to the other between at least a first operating condition, where the lower tool and the upper tool are spaced apart and allow positioning of the one or more supports 4 at said seats 23, and a second operating condition, where the lower tool and the upper tool are approached the one against the other such as to define or contribute to define a packaging chamber 24. In one aspect, the packaging chamber 24 may be hermetically closed with respect to the outside atmosphere, meaning that the packaging chamber 24 may be brought to a condition where it cannot freely communicate with the atmosphere outside the same chamber and gas may only be supplied or withdrawn from the chamber via appropriate supply or discharge channels under the control of the apparatus 1.

As schematically shown in FIG. 18, the cut film sheets 18 may be moved into the packaging chamber 24 of the assembly 8 by means of a transfer device. The transfer device may be of any suitable kind.

For instance, in accordance with a 1$^{st}$ possible alternative—the transfer device may include a transfer mechanism acting on the cut film sheet(s) may be used for transporting the cut film sheet from the cutting station where the cutting assembly cuts the film sheets 18 into the packaging assembly 8.

In accordance with a possible alternative—the transfer device may include a displacement mechanism 25 may be configured to move the upper tool 21 from the packaging assembly 8 to the position outside where the cutting assembly 6 effects the cutting of the film sheets; in this way the upper tool is allowed to pick the cut film sheet(s) 18 and return to the packaging assembly 8 in alignment with the lower tool 22, thereby bringing the cut film sheet(s) into the packaging chamber 24 and above the trays.

Note that other ways could be envisaged for transfer of a pre-cut film sheet or sheets inside the packaging assembly 8, without departing from the scope of the invention: in practice any solution adapted to pick the film sheet and transfer it into the packaging assembly may be suitable.

In accordance with the $1^{st}$ alternative, a transfer mechanism 300 may be configured for positioning the cut film sheets 18 inside the packaging assembly and above the respective support 4. The transfer mechanism 300 may act on a backing structure 16 having a flat holding surface 17 adapted for receiving the at least one or more film sheets 18 cut by blade 14: FIG. 18 shows that the blade 14 has cut the continuous film 10*a* and one or more film sheets 18 is/are positioned in correspondence of the flat holding surface 17 and located apart from the packaging chamber and thus apart from the packaging assembly 8 where the upper and lower tool are positioned the one facing the other. The backing structure 16 may hold the cut film sheet 18 using positioning system e.g. comprising a vacuum system 302 connected to one or more channels 303 present in the backing structure and leading to apertures located one holding surface 17. Alternatively, the backing structure may use mechanical holders, such as pincers, clamps or the like, adhesive systems, for instance comprising adhesive portions associated to the holding surface 17, heating systems, for instance comprising heatable portions associated to the backing structure causing heating of the holding surface 17 and thus of the film sheet 18 in order to increase stickiness of the film sheet to the holding surface 17, electric systems charging the holding surface 17 with a polarity different from that typical of the plastic sheet 18. The transfer mechanism may include a transfer actuator 301, e.g. carried by frame 2, active on the backing structure 16 and configured for relatively moving the backing structure 16 with respect to the packaging assembly 8 between a first position, where the baking structure 16 is positioned by the cutting device e.g. immediately downstream the blade 14 with respect to the movement imposed to film 10*a*, and at least a second position, where the backing structure 16 is positioned inside packaging assembly 8. The transfer actuator may for instance be active on the backing structure 16 and configured for pushing and pulling the backing structure 16 along a path suitable for achieving the displacement between said first and second positions: for example, the transfer actuator may displace the backing structure along a direction parallel to said horizontal direction A1. The transfer actuator stroke is such that the backing structure positions at least one film sheet 18 above said support 4 inside the packaging assembly 8 just in front of a central portion of the upper tool 21. The transfer actuator 301 may comprise at least one electric, pneumatic or hydraulic actuator. The transfer actuator 301 is controlled by the control unit 100, which is also configured to control the positioning system 302 in order to maintain the cut film sheet or sheets in proper position above the backing structure 16 at least until the upper tool holding means 38 (here below further described) picks the cut film sheet from the backing structure 16. In other words the control unit is configured to coordinate the actuation of transfer actuator 301, the actuation of the positioning system 302, the actuation of the holding means 38 and, optionally, that of the cutting assembly 6 such that:

while the cutting assembly 6 is commanded to cut the film sheet(s), the transfer actuator 301 is kept in the first position and the positioning system 302 controlled to keep the film adhering to the backing structure 16, after the film sheet(s) have been cut, the transfer actuator 301 is controlled to move to the second position, with the positioning system 302 controlled to keep the film adhering to the backing structure 16, when the backing structure 16 has reached the second position, the transfer actuator 301 is kept at the second position for a short time interval, the positioning system 302 is commanded to release the cut film sheet(s) and the holding means 38 are controlled to pick the cut film sheet(s) from the backing structure, and then the transfer actuator is controlled to go back to the first position.

It is to be noted that the transfer mechanism 300 may also include further actuators and cause the backing structure to move back and forth between the first and the second position following a non linear trajectory.

In accordance with the $2^{nd}$ alternative—which is schematically shown in FIG. 18 and further detailed in FIGS. 1-7—the upper tool 21 moves to the cutting assembly, picks the cut film sheet 18 up, and then moves back to the packaging assembly 8. For example, the displacement mechanism 25, e.g. carried by frame 2, may be active on the packaging assembly 8 and configured for displacing the upper tool 21 between a first position, where the upper tool 21 is positioned in correspondence of the backing structure 16 and configured to pick up from the backing structure 16 holding surface 17 the one or more cut film sheets 18, and at least a second position, where the upper tool 21 is aligned to the lower tool 22 (see FIGS. 5-8) and configured to position at least one film sheet 18 above said support 4. In order to achieve the above movement the mechanism may displace the upper tool 21 along any suitable path: for example in FIG. 18 it is schematically shown that the mechanism 25 may include a displacement actuator 26 configured for pushing and pulling the upper tool 21 along a direction parallel to said horizontal direction A1 as indicated by double arrow A4 in FIG. 18. As an alternative (see FIGS. 1 and 4) the mechanism 25 may cause rotation of the upper tool around a pivoting axis A; as a further alternative the mechanism 25 may cause both a pivoting movement and a translational displacement in order to move the upper tool from said respective first and second positions, as indicated by arrows A4, A4' and A4". The displacement mechanism may therefore include one or more actuators 26, depending upon the desired type of motion, which may include a linear actuator and/or a rotating actuator: the actuators may be electric, pneumatic or hydraulic. In FIGS. 1-7 it is shown an example where the apparatus 1 only includes displacement mechanism 25 having rotating actuator 26, configured for pivoting the upper tool 21 around pivoting axis A inclined by 45° with respect to the horizontal, and a linear actuator or main actuator 33, which is capable of linearly displacing the entire upper tool 21. Thus, when the upper tool is in the position of FIG. 1, the main actuator 33 causes an horizontal movement of the upper tool, while when the rotating actuator has displaced the upper tool to the position of FIG. 4 or 5, the main actuator 33 causes vertical movement of the upper tool 21. The combined movement of the rotating actuator 26 and of the main actuator 33 allows the displacement mechanism 25 to position the upper tool in a position (FIGS. 1, 2 and 3) where the upper tool may pick a vertically extending cut film sheet 18 and then to move the upper tool 21 in a horizontal position above the lower tool 22 (FIGS. 4-7) where the upper tool and the lower tool may cooperate to define the packaging assembly 8 and allow coupling of the cut film sheet 18 to the support or tray 4 as it is further explained herein below.

Figure 3:
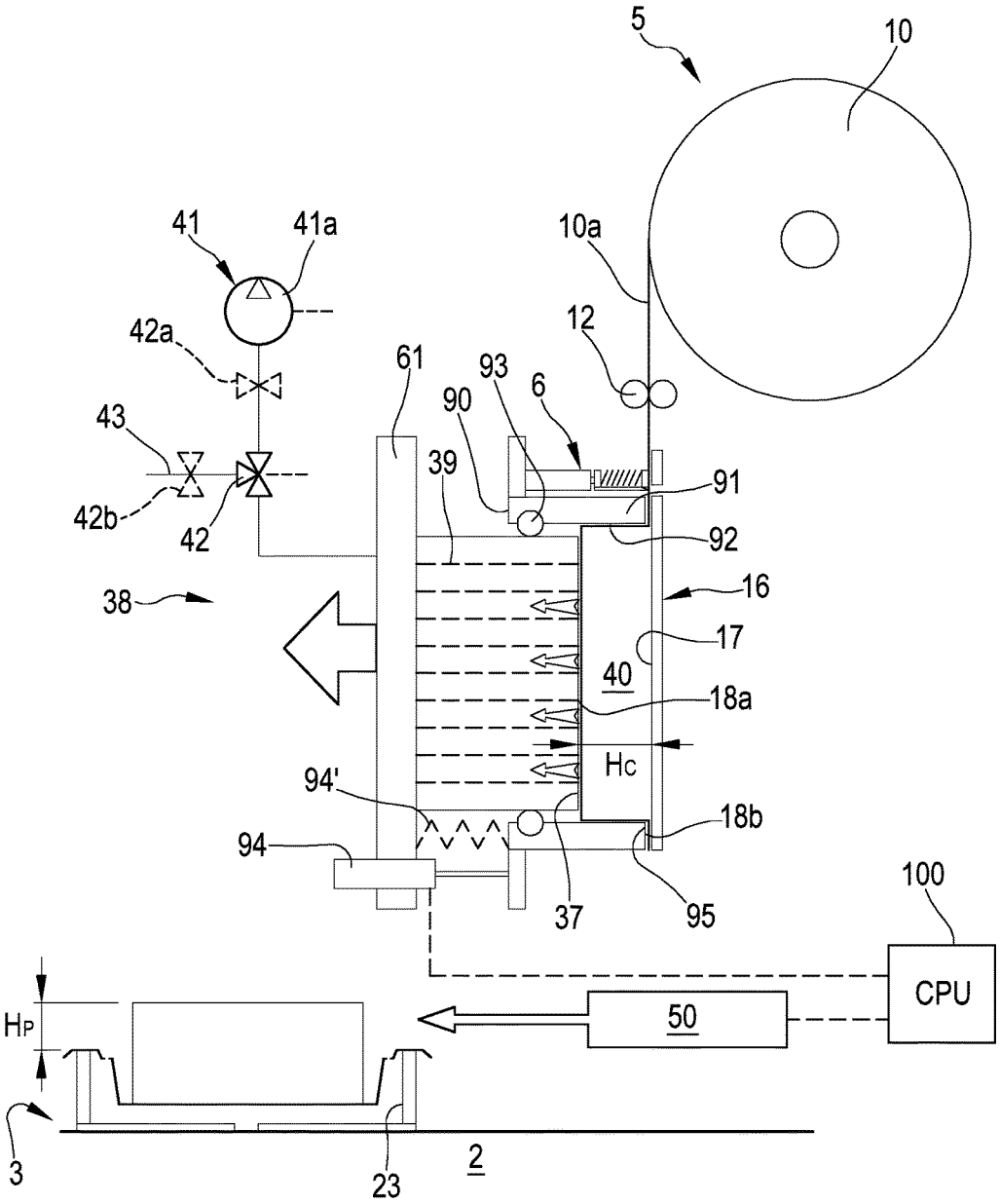
Figure 4:
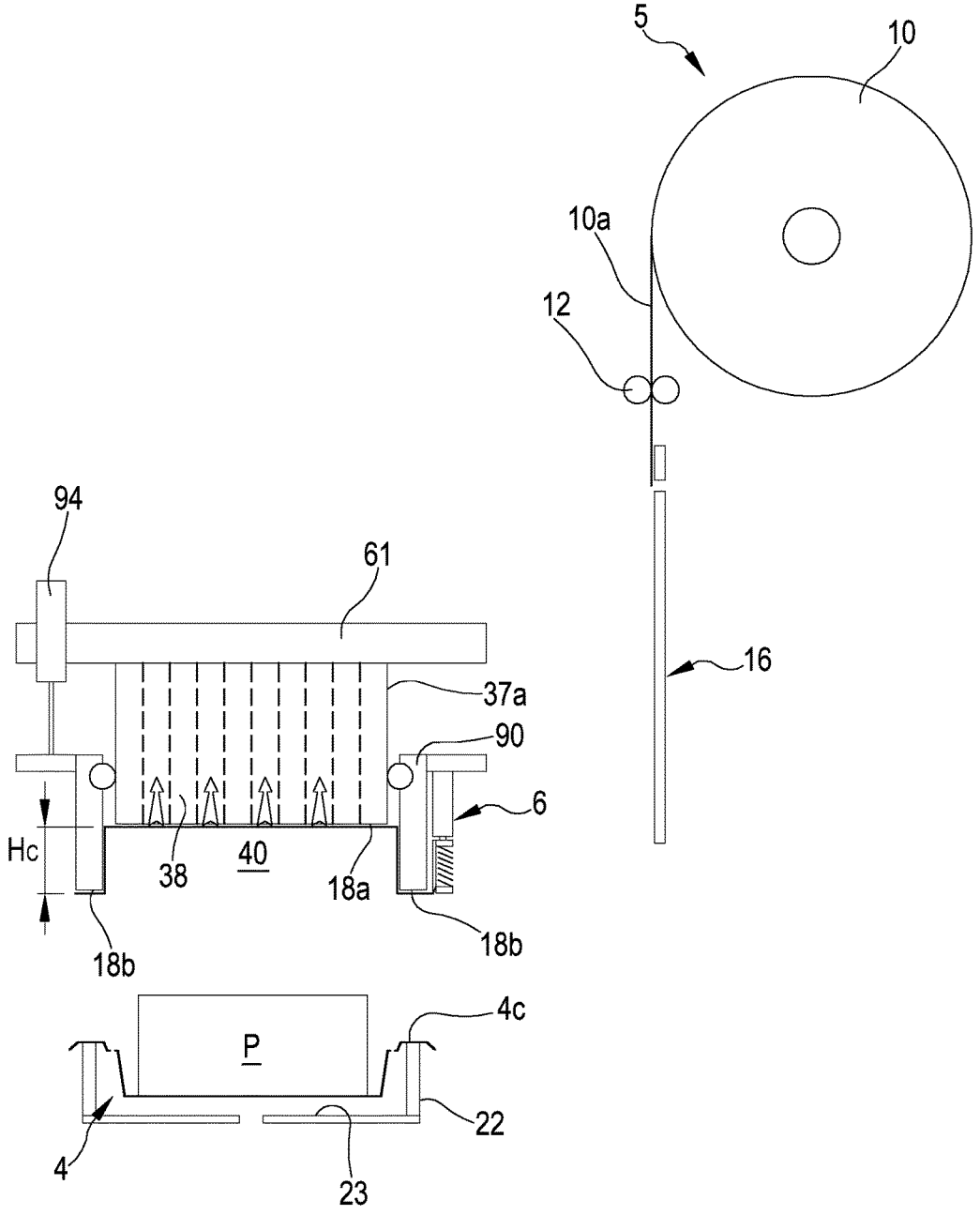
Figure 5:
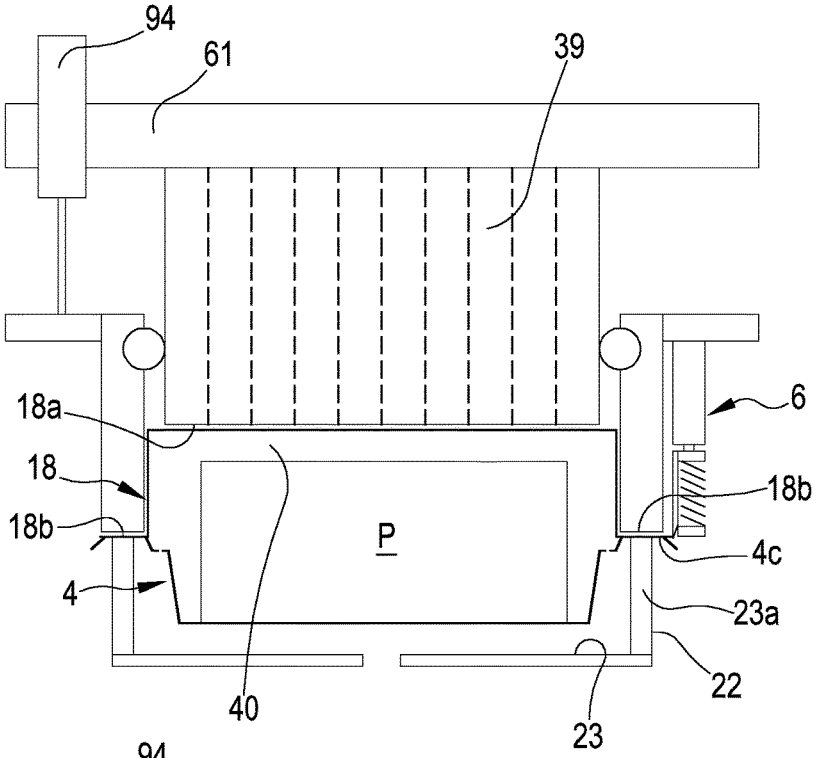
Figure 6:
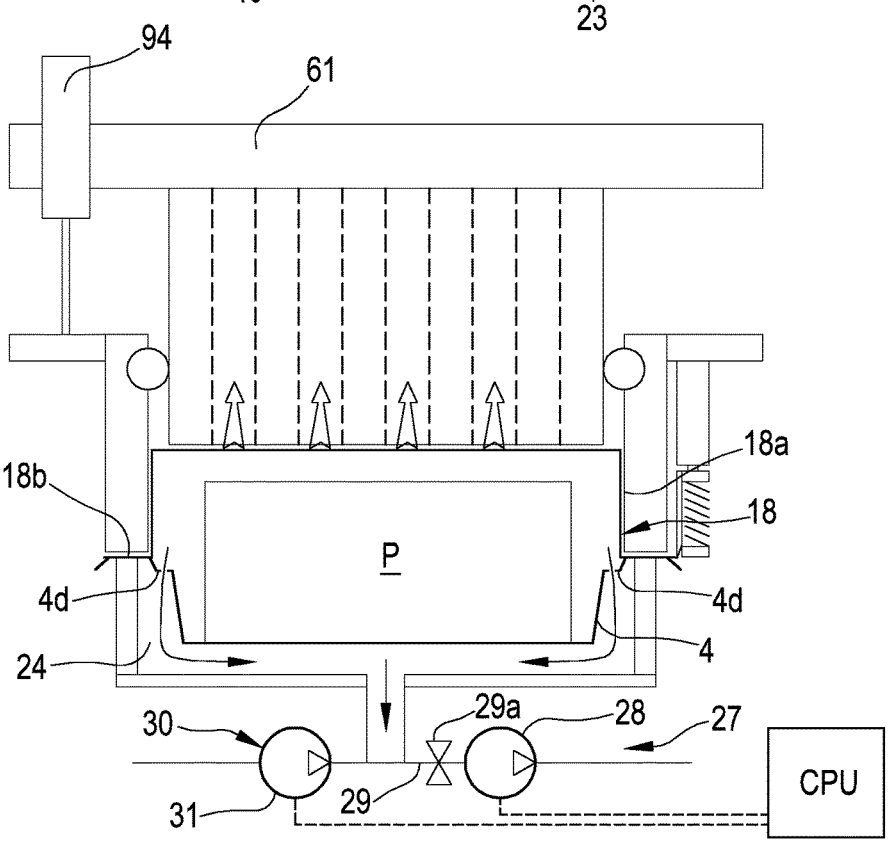

In accordance with one aspect (see FIGS. 1-7), the upper tool 21 comprises a head 36 having a respective active surface 37 configured for receiving the film portion 18*a* of said film 10 and particularly of said cut film sheet 18. Holding means 38 are associated to the head 36 and are configured for attracting the film portion 18*a* towards the active surface 37. Furthermore, a peripheral body 90 is positioned around the head 36. The peripheral body 90 may present an annular conformation and is mounted to the head 36 such that the head 36 and the peripheral body 90 may move one relative to the other. In practice, the peripheral body 90 may take a plurality of relative positions with respect to the head 36 so that at least a portion 91 of the peripheral body 90 protrudes beyond the active surface 37 and defines a cavity 40 (FIGS. 3, 4). More in detail, the cavity 40 is at least delimited by said active surface 37 and by an inner wall 92 of the protruding portion 91 of the peripheral body 90: the cavity 40 has therefore a volume V which size is depending upon the relative positioning of the peripheral body 90 with respect to the holding head 36. It should be noted that the peripheral body 90 is slidingly and tightly guided along a side surface: for instance an O-ring 93 (a plurality of O rings or other sealing organs may be alternatively used) may be interposed between the external or sided surface 37*a* of the head 36 and the inner wall 92 of the peripheral body 90. The movement of the peripheral body 90 relative to the head may be determined by a dedicated actuator 94 carried by the upper tool 21 and acting on one or both the peripheral body and the head. In FIGS. 1-7 the dedicated actuator 94 is interposed between the head 36 (or a part rigidly connected to the head 36) and the peripheral body 90. In the example shown the dedicated actuator 94 alone, or in cooperation with an appropriate movement of the main actuator 33, determines the retraction of the head 36 with respect to the peripheral body 90 and thus the formation of cavity 40. Alternatively, elastic means 94' (see dashed lines in FIGS. 2 and 3) may be interposed between the peripheral body and the upper tool (e.g. in the form of one or more helicoidally shaped springs, one or more leaf springs, or one or more pneumatic springs or combinations thereof). The elastic means are positioned and configured to normally bias the peripheral body at a position, where a terminal surface 95 of the peripheral body is aligned or substantially aligned with the active surface 37 of the head 36; a main actuator 33 active on said upper tool 21) under the control of the control unit is caused to bring and stably keep the peripheral body 90 and the head 36 in one of said relative positions defining said cavity.

As already mentioned, the apparatus also includes the control unit 100 which is configured for commanding the dedicated actuator, or the main actuator 33 and the dedicated actuator 94, and thus cause the relative motion of the peripheral body 90 with respect to the head 36 in order to define said cavity: for instance the control unit may control the dedicated actuator, or the main actuator and the dedicated actuator, to bring and stably keep for several seconds the peripheral body and the head in one of said relative positions such that the cavity 40 is formed and kept unchanged for the time necessary to apply the film sheet 18 to the respective tray or support 4. The control unit 100 is also configured for activating the holding means 38 and is capable of coordinating the relative motion between peripheral body and head with the activation of the holding means 38 such as to cause said film portion 18*a* to move from a substantially flat configuration outside said cavity to a substantially tri-dimensional configuration inside said cavity 40.

In accordance with an aspect of the invention, the control unit 100 is configured for commanding—e.g. by controlling the dedicated actuator or by controlling both the dedicated actuator and the main actuator—the movement of the head 36 relative to the peripheral body 90 from an end stroke position, where a terminal surface 95 of the peripheral body 90 is aligned or substantially aligned with the active surface 37 of the head 36 (FIGS. 1 and 2), to an operating position, where the terminal surface 94 of the peripheral body is displaced from the active surface 37 (or from a peripheral edge of said active surface 37 in case of a dome shaped active surface) by a distance which represents the height Hc of said cavity 40 (FIG. 4). In practice, when the peripheral body 90 has the terminal surface 95 aligned with the active surface 37 of the head (or with the peripheral edge of said active surface 37 in case of a dome shaped active surface), then there is no cavity (or only the cavity formed by the dome) and the terminal surface 95 of the peripheral body 90 is positioned in prosecution to the active surface 37 defining, in case of a flat active surface 37, an overall flat backing, while when the peripheral body or the head are relatively moved (see e.g. FIGS. 3 and 4) a cavity 40 is formed and the terminal surface of the peripheral body is no longer aligned with the active surface of head 36.

In the example shown in FIGS. 1-7, the holding means 38 comprises a plurality of suction apertures 39 leading to the active surface 37, at least one vacuum source 41, e.g. comprising a vacuum pump 41*a*, controlled by the control unit 100 and connected to the suction apertures 39, and at least one selector valve 42, also controlled by the control unit 100, selectively connecting said suction apertures 39 either to said vacuum source 41 or to a vent line 43. The control unit may be configured to activate the holding means 38 by switching the selector valve to a position where the valve connects the suction apertures to the vacuum source thereby causing suction of gas through the apertures. Alternatively, two valves 42*a*, 42*b* (see dashed lines in FIG. 3) may be used which may selectively be opened and closed to determine a fluid connection between said apertures either to the vacuum source or to the vent line. Note that in addition or in alternative to vacuum source 39 the holding means 38 may include one or more of the following:

- mechanical holders, such as pincers, clamps or the like,
- adhesive systems, for instance comprising adhesive portions associated to the active surface 37,
- heating systems, for instance comprising heatable portions—controlled by control unit 100—associated to the holding means for causing heating of the active surface 37 and thus of the film sheet 18 in order to increase stickiness of the film sheet to the active surface 37,
- electric systems, for instance the active surface 37 may be charged with a polarity different from that typical of the plastic sheet 18. In this case the control unit may be connected to a voltage generator and may control the electric charging of surface 37.

As shown in FIG. 3, the control unit 100 is configured for first positioning the upper tool 21 in correspondence of the film 10*a*, by operating the rotating actuator 26 and the main actuator 33. Note that in FIGS. 1-7, the cutting assembly 6 is carried by the upper tool and under the control of the control unit: the cutting assembly 6—once the upper tool has moved in proper position in front of backing structure 16, cuts film sheets 18 of appropriate length. Then the control unit 100 commands the relative motion of the head 36 with respect to the peripheral body (motion to the left in the drawings) after or contemporaneously with activating the holding means 38: in practice suction via the apertures 39 is activated before or contemporaneously with forming of the cavity 40 such that, while the cavity is formed, the film portion 18*a* is pulled and stretched by the holding means moving from a substantially flat configuration to a substantially tri-dimensional configuration inside said cavity. Alternatively, the control unit 100 may be configured for first commanding the relative motion of the head 36 with respect to the peripheral body 90 and then—once the cavity 40 is partially or totally formed—activating the holding means 38, such that first said cavity is formed and then the film portion is forced to move from a substantially flat configuration to a substantially tri-dimensional configuration inside said cavity.

Note that—during pulling of the film portion inside the cavity—the terminal surface 95 of the peripheral body 90 constrains a peripheral edge 18*b* of the film sheet 18 against an abutment surface. In examples 1-7, the displacement mechanism 25 is configured for positioning the upper tool 21 in front of baking structure 16 and urge the terminal surface 95 of the peripheral body against the holding surface 17 which acts as abutment surface constraining the peripheral edge 18*b* of the cut film sheet, which can thereafter be stretched and deformed with no risk of losing its proper position with respect to the upper tool.

Thus, the control unit 100 may control activation of the holding means 38 such as to cause pulling of said film portion 18*a* inside said cavity 40 and shaping of said film portion 18*a* to the shape of the cavity 40, conferring a quite pronounced deformation to the interested film portion. For example, the head 36 may comprise a flat active surface 37 and a prismatic or cylindrical side surface 37*a* perpendicular to the active surface 37: consequently, as the peripheral body 90 is configured to slide along the head 36, the peripheral body comprises an inner wall 92 with a surface which is shaped as the side surface 37*a* of the head 36, thereby defining a cavity of cylindrical or prismatic shape. Thus, the portion of film sheet undergoing deformation may be compelled to take exactly the shape of the cavity and is therefore substantially stretched and deformed particularly in the area of the film sheet close to terminal surface 95 of the peripheral body.

According to a further aspect, the apparatus 1 comprises one or more sensors 50, which may be located on the frame 2 and which communicate with the control unit 100. Sensor 50 is configured to detect a value of a parameter which may be the height of the product hosted in a support or directly the extent of protrusion Hp of a product beyond a top rim 4*c* of support 4 (in case of support with side wall and top rim), or the total height of the product and the support. The sensor 50 is configured to issue a signal for the control unit linked to the detected value of the mentioned parameter and the control unit is configured to receive said signal, and command the relative motion of the peripheral body 90 with respect to the head 36 by distance Hc equal to or greater than said extent of protrusion Hp, in order to configure the cavity 40 with a height at least sufficient to host the protruding portion of the product P. Hc is typically greater than 5 mm, more typically greater than 10 mm, and even greater values as peripheral body and the head are mounted to offer a stroke of the relative motion between head and peripheral body which may be bigger than 5 mm, or bigger than 10 mm or bigger than 20 mm or 30 mm or take even bigger values such as up to 100 or 200 mm to offer the ability to adapt to basically any type of protruding product.

According to another aspect, the apparatus 1 includes heating means 60 configured to heat at least the active surface 37 of the head 36. The heating means may include resistances or inductances (e.g. in the form of printed circuits) or other type of heater(s) located inside the head 36 or in proximity of the active surface 37 (such has heating irradiators) and capable of at least directly or indirectly heating the active surface. The heating means are controlled by the control unit 100 which is configured for regulating the heating means such that the active surface of the head 36 is brought at least to an operating temperature comprised between 150° C. and 260° C., optionally between 180-240° C., more optionally between 200-220° C. One or more temperature sensors or one or more thermal switches may be positioned in correspondence or in proximity of head 36 in order to provide the control unit with a feedback signal and allow control of the active surface temperature within the above ranges. In accordance with a presently preferred aspect, the control unit controls the heating means such that the active surface is kept at said operating temperature during the whole packaging cycle such that as soon as the film touches the active surface it gets immediately and uniformly warmed. In an aspect the control unit 100 is configured for controlling the heating means such that the terminal surface 95 of the peripheral body 90 is kept at a temperature which is always below the operating temperature of said active surface 37: this has the advantage of setting the surface at a temperature which is appropriate for plastic deformation of the film sheet portion 18*a* and at the same time setting the terminal surface at a temperature which is optimal for heat sealing the peripheral edge 18*b* to the tray rim 4*c* or to the support without compromising the integrity thereof. In a variant, as shown in FIGS. 1-7, the heating means may also or alternatively comprise a main heating body 61 (which may take any appropriate shape and a sufficiently big thermic mass and may host a heat source) conductively connected to the head 36 such that the control unit may heat the main heating body which on its turn heats the head 36. The main heating body may be associated to a side of the head opposite the active surface 37, or it may be otherwise thermally connected to the head 36.

The control unit is configured to bring the active surface 37 of head 36 at said operating temperature before initiating the deformation process of the film sheet. In other words, before causing the film portion 18*a* to move inside the cavity 40 and take the said substantially tri-dimensional configuration, the control unit activates the heating means and brings the active surface to the operating temperature appropriate to the film structure and material under deformation. Heating of the film increases the ability of the film to receive pronounced deformation and causes at least the peripheral film portion to stick to the terminal surface 95. As the active surface is kept at a uniform and substantially constant temperature, the film is uniformly heated and brought to optimal conditions for deformation.

Once the film portion 18*a* has been properly deformed and brought inside the cavity 40, then displacement mechanism 25 may cause—under the control of control unit 100—movement of the upper tool 21 to the position shown in FIG. 4 by imposing a displacement of the upper tool 21 apart from backing structure 16 and then a rotation of the upper tool by 90°. Then, main actuator 33 acts onto the upper tool 21 under the control of control unit 100 and lowers the upper tool to the lower tool 22 causing movement between said first operating condition (FIG. 4), where the upper tool 21 is spaced apart from the lower tool 22 and said packaging assembly 8 is open to receive one or more of said film sheets 18 and one or more trays or supports 4, and said second operating condition (FIGS. 5 and 6), where a closure surface of the upper tool 21 tightly abuts against a closure surface of the lower tool 22 to form said packaging chamber 24 which is preferably hermetically closed with respect to an atmosphere outside the apparatus.

Figure 7:
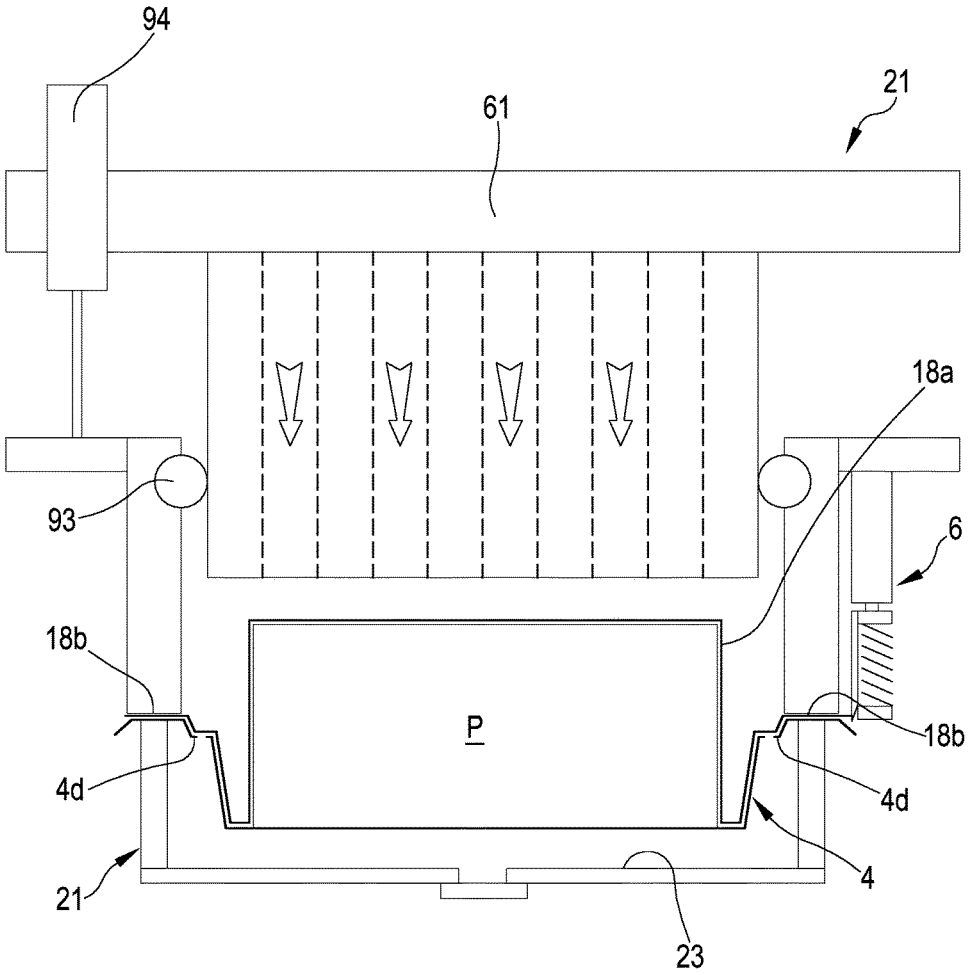
Figure 8:
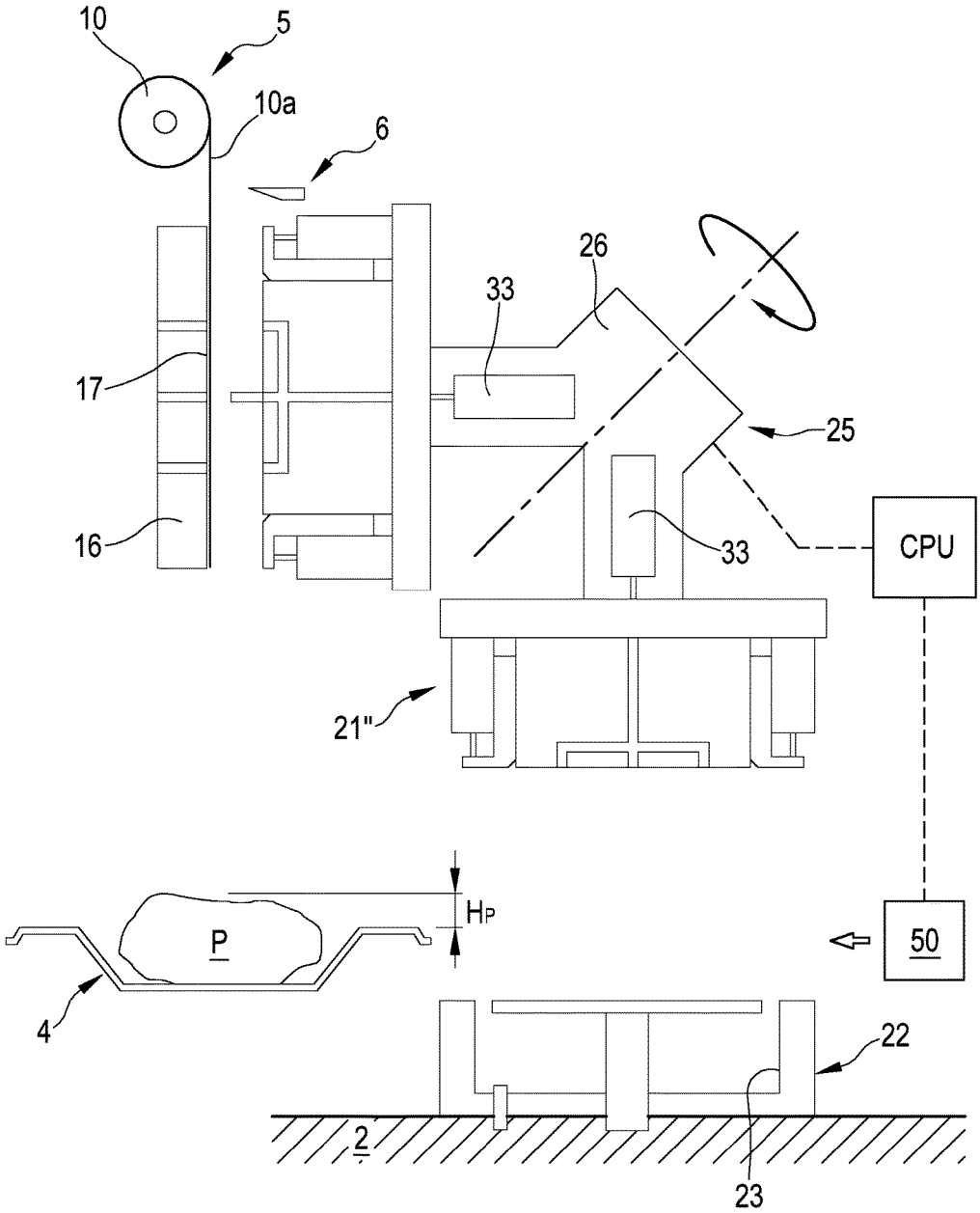
FIG. 8-17 are schematic side views relating to a second embodiment of a packaging apparatus according to aspects of the invention. In these figures consecutive phases of a packaging process operated by the apparatus of the second embodiment are shown.
Figure 9:
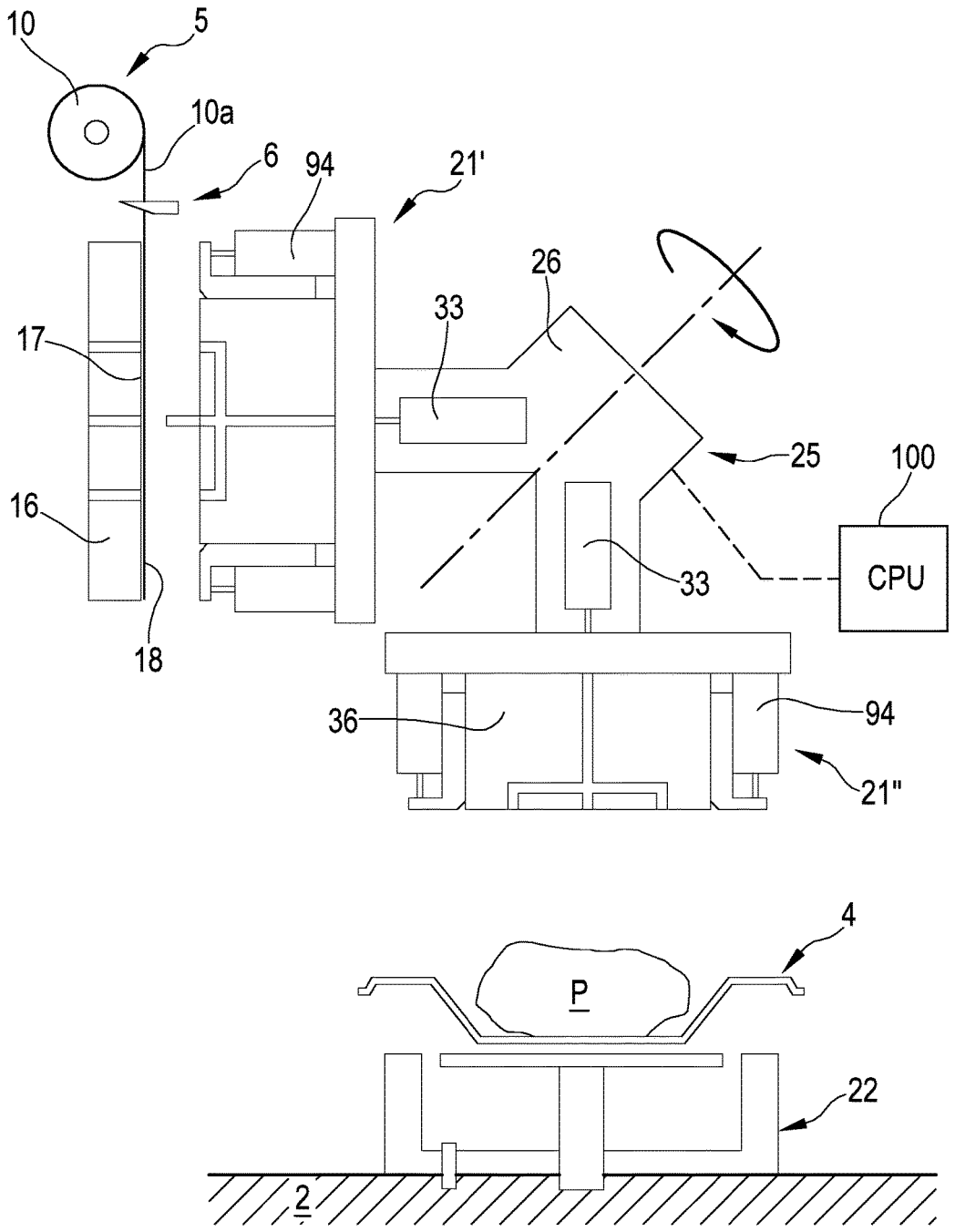

Once the chamber 24 has been closed, a vacuum arrangement 27 may be operated by the control unit (FIG. 7). Vacuum arrangement 27 is connected to the packaging chamber 24 and configured for removing gas from inside said packaging chamber; the vacuum arrangement 27 comprises at least one vacuum pump 28 and at least one evacuation pipe 29 connecting the inside of said chamber 24 to the vacuum pump; at least one valve 29*a* may also be provided for selectively opening and closing pipe 29; the control unit 100 controls the vacuum pump 28 and/or the valve 29*a* to withdraw gas from said packaging chamber 24 at least when the packaging assembly is in said second operating condition, i.e. with said packaging chamber hermetically closed. In the example shown, the support 4 includes holes 4*d* located in its side wall which facilitate gas withdrawal from a volume above the tray and under the film sheet 18. Should the tray include no holes then, in order to create a state of vacuum inside the chamber 24 and inside the tray volume, the film sheet 18 is kept separate from the tray or support 4 in one or more points 8 (e.g. by keeping peripheral portion 18*b* slightly apart from tray rim 4*c* when the vacuum chamber is already hermetically closed) while vacuum arrangement 27 is active.

In a further aspect, the control unit may be configured to create a vacuum in the packaging chamber 24 (by controlling the vacuum pump 28 to withdraw gas from said packaging chamber 24) until a sufficiently low pressure has been reached (e.g. below 100 mbar or below 50 mbar or below 10 mbar). This pressure level is sufficiently low but not too low so that detachment of the film sheet from the head 36 is avoided (at least during a first phase) as the control unit also creates a pressure level in correspondence of the suction holes 39, by acting on vacuum source 41, below the pressure level reached in the packaging chamber. Once a desired state of vacuum is reached inside the chamber 24, and after the peripheral portion of the film sheet has been sealingly fixed to the support or to the tray rim 4*c*, the control unit 100 commands the holding means 38 to release the film portion 18*a*: this may be achieved by commanding selector valve 42 (or valves 42*a*, 42*b*) to switch to the vent line 43. The vacuum causes the film 18 to drape down to the tray and to form a skin around the product also attaching to the tray surface not occupied by the product. At this point the control unit may control again the displacement mechanism 25 and lift the upper tool 21 thereby allowing extraction of the packaged product.

The cycle described above may then be repeated.

The apparatus 1 may also, or may alternatively, include a controlled atmosphere arrangement 30 connected to the packaging chamber 24 and configured for injecting a gas stream into said packaging chamber; the controlled atmosphere arrangement comprises at least one injection device including an injection pump and/or one injection valve 31 connecting the inside of said chamber 24 to a source of gas (not shown) which may be located remotely from the apparatus 1; the control unit 100 may be configured to control opening and closing of the injection valve (or activation of the injection pump) to inject said stream of gas at least when the packaging assembly 8 is in said second operating condition, i.e. with said packaging chamber 24 hermetically closed.

Although the apparatus 1 may have one or both the vacuum arrangement 27 and the controlled atmosphere arrangement 30, it is to be understood that the control unit 100 of the apparatus 1 may also be configured to tightly engage the film sheets 18 to the trays without activating the vacuum arrangement or the controlled atmosphere arrangement and thus leaving the normal environment atmosphere within the tray. This may be for instance the case for non perishable products. Thus in a version, the apparatus 1 may be designed without vacuum arrangement and without modified atmosphere arrangement.

Second Embodiment

The second embodiment is similar to the first embodiment and only differences will be re-described in detail. The frame 2 structure and the way trays 4 are moved to a the seats 23 may be same as described above in connection with the first embodiment and FIG. 18 also schematically reflects a possible overall design of the apparatus 1 according to the second embodiment.

In the second embodiment the cutting assembly 6 is located at a cutting station, e.g. immediately downstream the film supply assembly 5, and is separate from the upper tool 21. Moreover, the apparatus includes two (or more) upper tools 21' and 21" which are contemporaneously controlled such that once one of the two upper tools is applying the film sheet to the respective tray, the other of the two upper tools is brought at the cutting assembly to pick the cut film sheet up.

The displacement mechanism 25, e.g. carried by frame 2, is configured for alternately displacing the two upper tools 21' and 21" between a respective first position, where the upper tools are positioned in correspondence of the backing structure 16 and configured to pick up from the backing structure 16 holding surface 17 the one or more cut film sheets 18 (as e.g. upper tool 21' in FIGS. 8-13), and at least a second position, where the upper tools are aligned to the lower tool 22 (see e.g. upper tool 21' in FIGS. 13-16) and configured to position at least one film sheet 18 above said support 4. In practice, the control unit 100 controls the displacement mechanism 25 such that when one of the upper tools is in the first position the other of the upper tools is in the second position and viceversa. In order to achieve the above movement, the mechanism 25 may displace the upper tools along any suitable path: for example in FIGS. 8-17 it is schematically shown that the mechanism 25 may include a main actuator 33 for each one of the upper tools configured for pushing and pulling the respective upper tool along a straight trajectory and a rotating actuator 26 configured for pivoting the upper tools 21' and 21" around pivoting axis A inclined by 45° with respect to the horizontal.

Thus, for the upper tool facing the backing structure, the respective main actuator 33 causes an horizontal movement of the upper tool, while for the upper tool facing the lower tool the respective main actuator 33 causes a vertical up and down movement. The combined movement of the rotating actuator 26 and of the main actuators 33 allows the displacement mechanism 25 to configure each one of the upper tools alternatively in a position, where the upper tool may pick a vertically extending cut film sheet 18, and in a position, where the upper tool may cooperate with the lower tool 22 to define the packaging assembly 8. When one of the upper tools 21' or 21" is in the position where it is cooperating—at the packaging assembly 8—with the lower tool, the upper and lower tools allow coupling of the cut film sheet 18 to the support or tray 4 as it is further explained herein below.

Each upper tool 21' and 21" is designed and configured like the upper tool 21 of the first embodiment and comprises the same components (which are not described again in detail):

- a head 36 having a respective active surface 37 configured for receiving the film portion 18*a* of the cut film sheet 18,
- holding means 38 associated to the head 36 and configured for attracting the film portion 18*a* towards the active surface 37,
- a peripheral body 90 positioned around the head 36,
- a dedicated actuator 94 carried by the upper tool and acting on one or both the peripheral body and the head,
- heating means 60.

Figure 10:
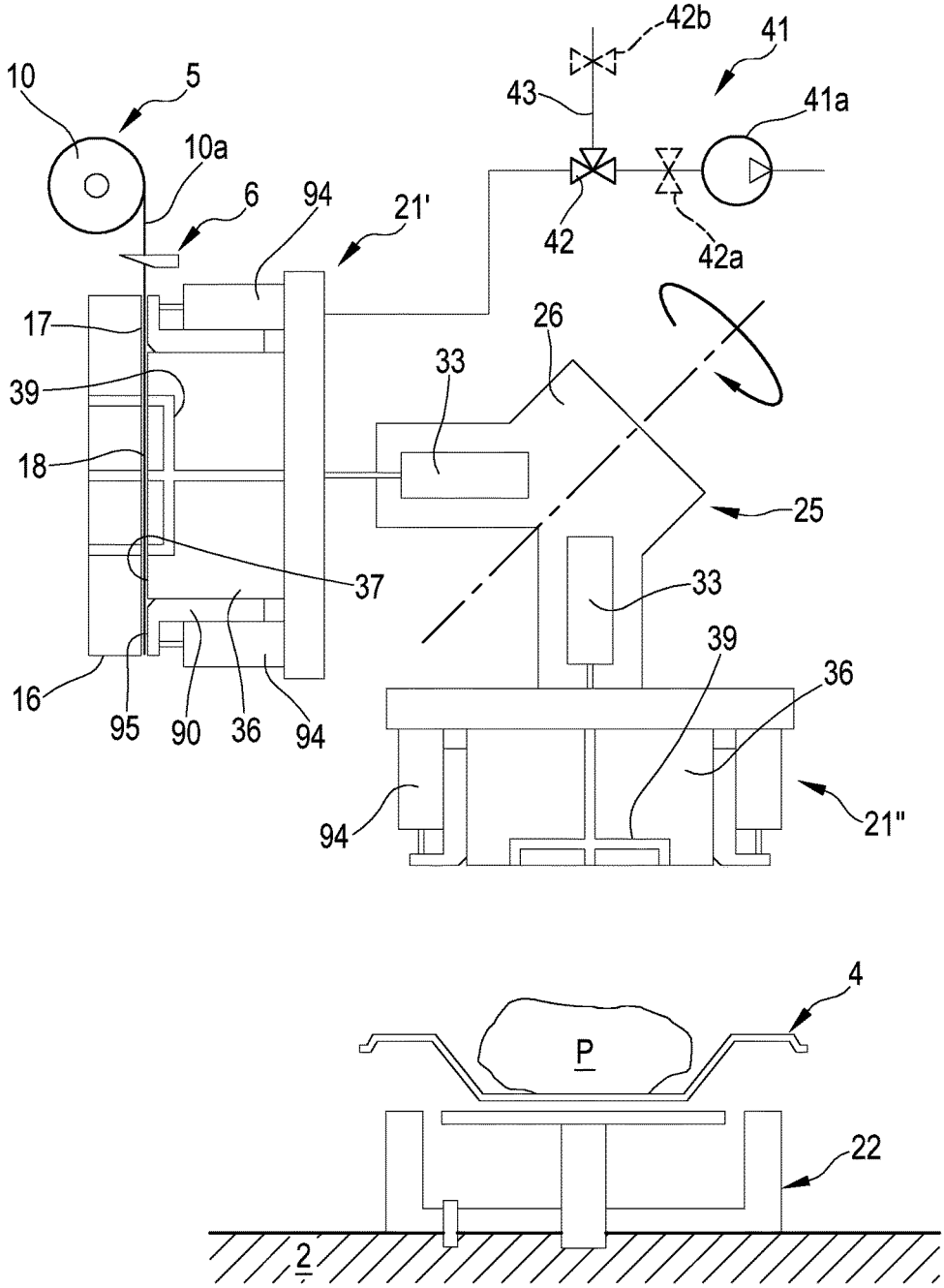

As already mentioned, one of the two upper tools, namely upper tool 21', is brought in a position facing the backing structure 16 (FIG. 8) while the other upper tool 21" is in a position facing the lower tool 22 thus defining or contributing to define the packaging assembly 8. As shown in FIG. 10, the cutting assembly 6 cuts a film sheet 18 from the film 10*a*. At the same time, the tray or support 4 with a product P inside (or positioned above) moves into the packaging assembly 8 defined by the upper tool 21" and by the lower tool 22.

Figure 11:
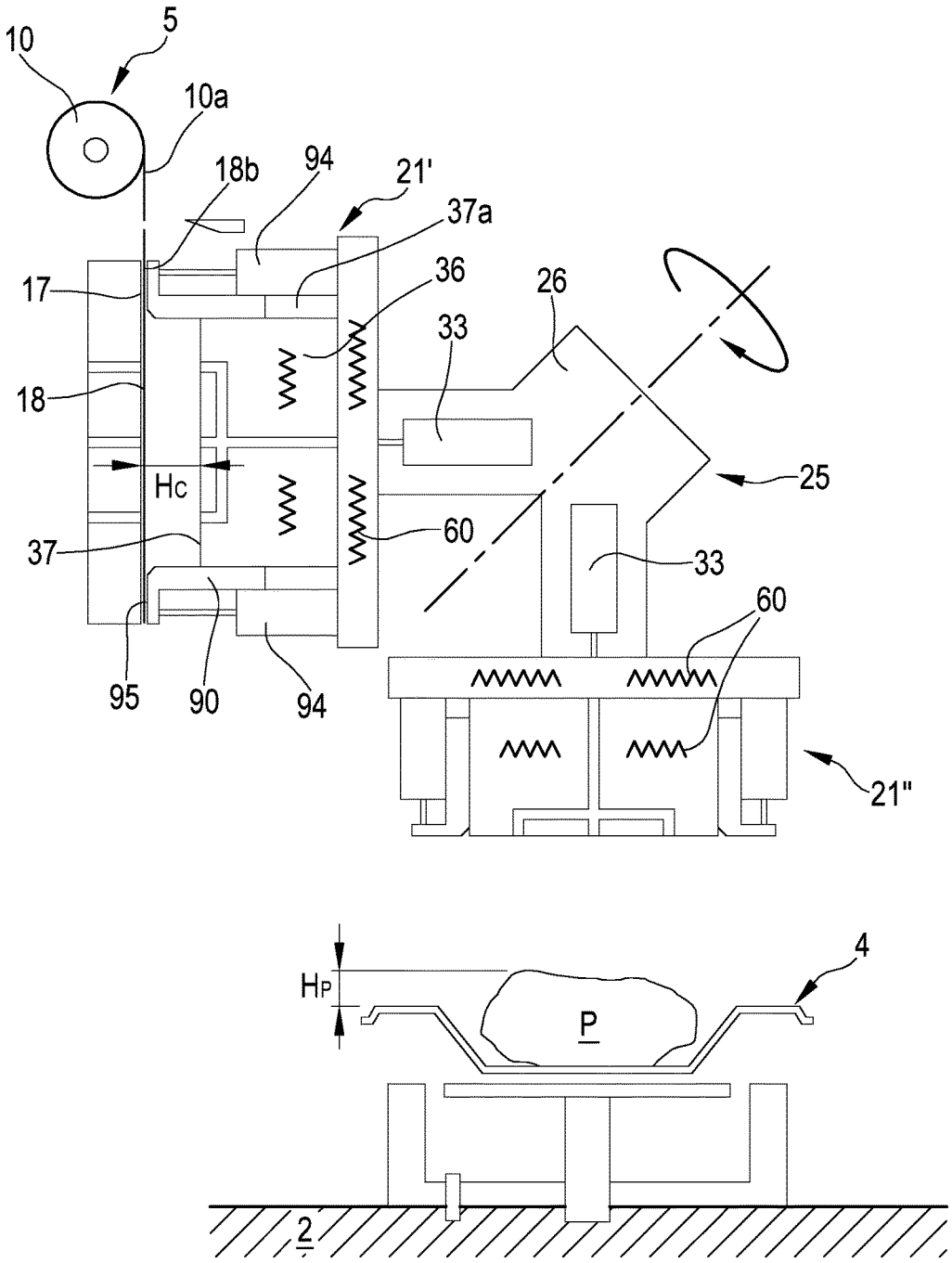
Figure 12:
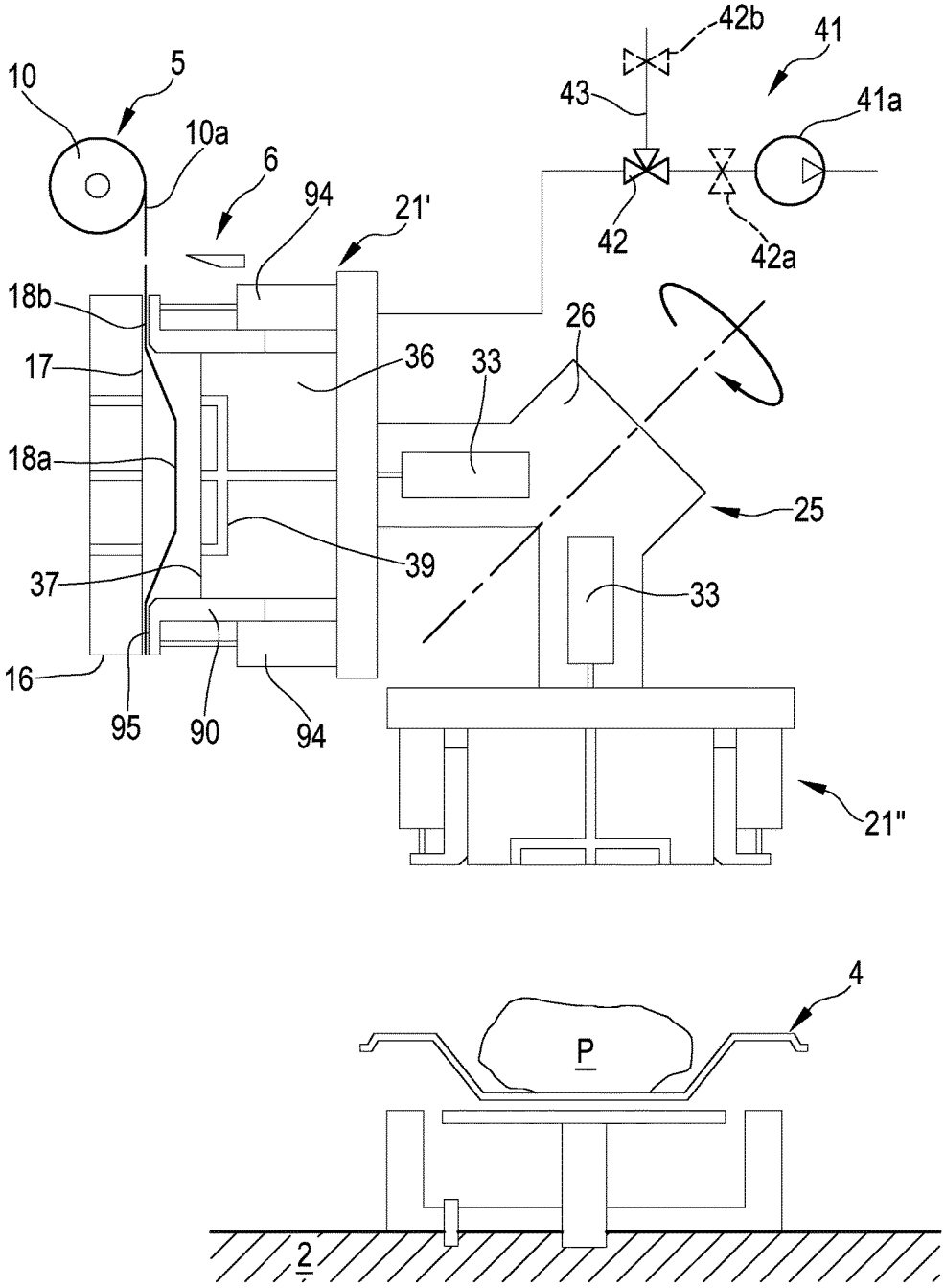
Figure 13:
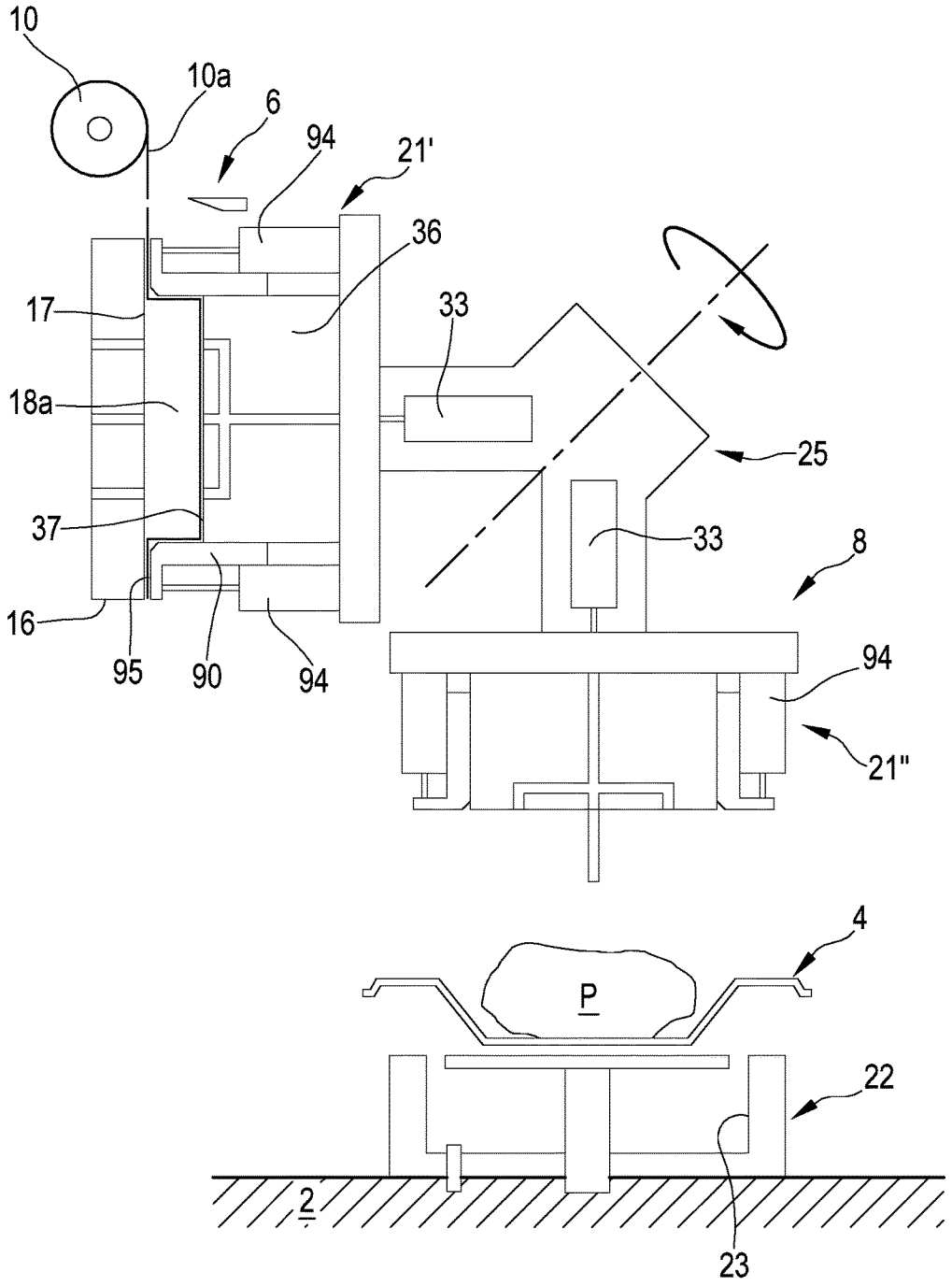
Figure 14:
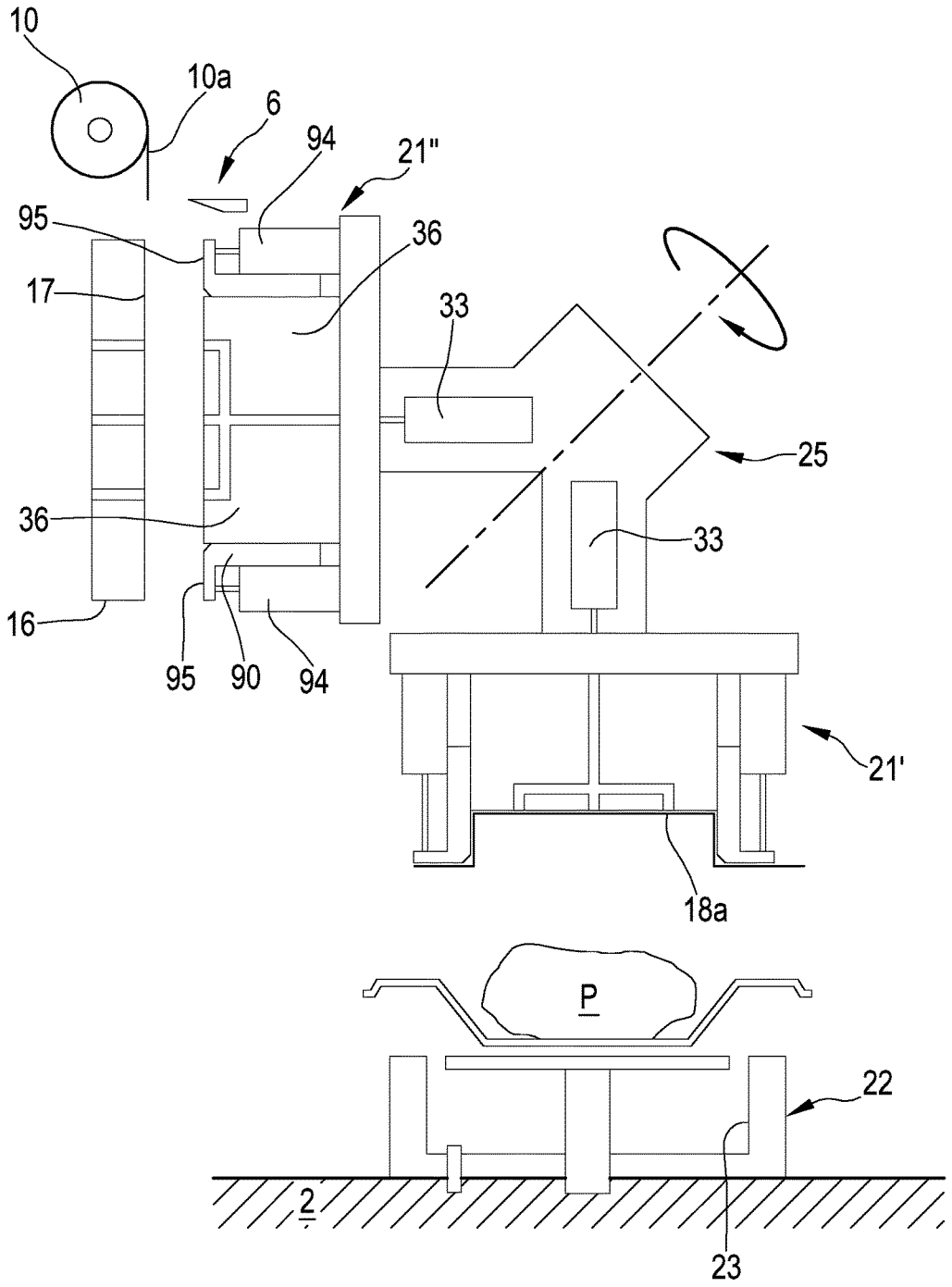

Under the action of its main actuator 33, the upper tool 21' is moved towards the cut film sheet positioned on the backing structure holding surface 17 so that the active surface 37 and the terminal surface 95 are closely approached or come into contact with film sheet 18 (FIG. 10). The control unit 100 is also configured for commanding the heating means so as to keep the head 36 and particularly the active surface 37 of each upper tool 21', 21" at a desirable temperature so that as soon as the film sheet contacts the active surface 37 the film sheet starts to be heated. Then, the main actuator 33 associated to this upper tool 21' and its dedicated actuator 94, or alternatively the dedicated actuator alone, cause the relative motion of the peripheral body 90 with respect to the head 36 in order to define the cavity 40: for instance the control unit may control the main actuator and the dedicated actuator or the dedicated actuator alone to bring and stably keep for several seconds the peripheral body and the head in one of said relative positions such that the cavity 40 is formed and kept unchanged for the time necessary to engage the film sheet 18 to the respective tray or support 4. The control unit 100 is also configured for activating the holding means 38 and is capable of coordinating the relative motion between peripheral body and head with the activation of the holding means 38 such as to cause said film portion 18*a* to move from a substantially flat configuration outside said cavity to a substantially tri-dimensional configuration inside said cavity 40. In accordance with an aspect of the invention, the control unit 100 is configured for commanding—e.g. by controlling the dedicated actuator or the dedicated actuator and the main actuator—the movement of the head 36 relative to the peripheral body 90 from an end stroke position, where a terminal surface 95 of the peripheral body 90 is aligned or substantially aligned with the active surface 37 of the head 36 (FIG. 10), to an operating position, where the terminal surface 94 of the peripheral body is displaced from the active surface by a distance which represents the height Hc of said cavity 40 (FIGS. 11 and 12). In practice, when the peripheral body 90 has the terminal surface 95 aligned with the active surface 37 of the head, then there is no cavity and the terminal surface 37 of the peripheral tool is positioned in prosecution to the active surface defining and overall flat backing, while when the peripheral body or the head are relatively moved (see e.g. FIGS. 11 and 12) a cavity 40 is formed and the terminal surface of the peripheral body is no longer aligned with the active surface of head 36 of upper tool 21'. Of course in case the active surface is already dome shaped than the relative motion above described causes an increase of the size of the cavity. The control unit 100 commands the relative motion of the head 36 of upper tool 21' with respect to the peripheral body after or contemporaneously with activating the holding means 38: in practice suction via the apertures 39 is activated before or contemporaneously with forming of the cavity 40 such that, while the cavity is formed, the film portion 18*a* is pulled and stretched by the holding means moving from a substantially flat configuration to a substantially tri-dimensional configuration inside said cavity.

Alternatively, the control unit 100 may be configured for first commanding the relative motion of the head 36 with respect to the peripheral body 90 and then—once the cavity 40 is partially or totally formed—activating the holding means 38, such that first said cavity is formed and then the film portion is forced to move from a substantially flat configuration to a substantially tri-dimensional configuration inside said cavity.

During pulling of the film portion 18*a* inside the cavity—the terminal surface 95 of the peripheral body 90 constrains a peripheral edge 18*b* of the film sheet 18 against an abutment surface which in FIGS. 10 and 11 is defined by the holding surface 17 constraining the peripheral edge 18*b* of the cut film sheet, which can thereafter be stretched and deformed with no risk of losing its proper position with respect to the upper tool 21'.

Also in the second embodiment, the apparatus 1 may comprise one or more sensors 50, which may be located on the frame 2 and which communicate with the control unit 100. Sensor 50 is configured to detect a value of a parameter which may be the height of the product hosted in or on a support or directly the extent of protrusion Hp of a product beyond a top rim 4*c* of support 4 or the total height support plus product. The sensor 50 is configured to issue a signal for the control unit linked to the detected value of the mentioned parameter and the control unit is configured to receive said signal, and command the relative motion of the peripheral body 90 with respect to the head 36 by distance Hc equal to or greater than said extent of protrusion Hp, in order to configure the cavity 40 with a height at least sufficient to host the protruding portion of the product P.

As explained for the first embodiment, the control unit is configured to warm the active surface 37 up to an operating temperature (see first embodiment in this regard, the heating means 60 in the second embodiment may present same design as those of the first embodiment—obviously heating means 60 are operative both at both upper tools 21' and 21") before initiating the deformation process of the film sheet. In other words, before causing the film portion 18*a* to move inside the cavity 40 and take the said substantially tri-dimensional configuration, the control unit activates the heating means and brings the active surface to the operating temperature appropriate to the film structure and material under deformation. Heating of the film also increases the ability of the film to receive pronounced deformation and causes at least the peripheral film portion to better stick to the terminal surface 95.

As for the first embodiment, the heating means are controlled by the control unit 100 which is configured for regulating the heating means such that the active surface of the head 36 is brought at least to an operating temperature comprised between 150° C. and 260° C., optionally between 180-240° C., more optionally between 200-220° C. One or more temperature sensors or one or more thermal switches may be positioned in correspondence or in proximity of head 36 in order to provide the control unit with a feedback signal and allow control of the active surface temperature within the above ranges. In accordance with a presently preferred aspect, the control unit controls the heating means such that the active surface is kept at said operating temperature during the whole packaging cycle such that as soon as the film touches the active surface it gets immediately and uniformly warmed. In an aspect the control unit 100 is configured for controlling the heating means such that the terminal surface 95 of the peripheral body 90 is kept at a temperature which is always below the operating temperature of said active surface 37: this has the advantage of setting the surface at a temperature which is appropriate for plastic deformation of the film sheet portion 18*a* and at the same time setting the terminal surface at a temperature which is optimal for heat peripheral edge 18*b* to the tray rim 4*c* or to the support without compromising the integrity thereof. In a variant, the heating means may comprise a main heating body 61 (which may take any appropriate shape and a sufficiently big thermic mass and may host a heat source) conductively connected to the head 36 such that the control unit may heat the main heating body which on its turn heats the head 36. The main heating body may be associated to a side of the head opposite the active surface 37, or it may be otherwise thermally connected to the head 36.

The control unit is configured to bring the active surface 37 of head 36 at said operating temperature before initiating the deformation process of the film sheet. In other words, before causing the film portion 18*a* to move inside the cavity 40 and take the said substantially tri-dimensional configuration, the control unit activates the heating means and brings the active surface to the operating temperature appropriate to the film structure and material under deformation. Heating of the film increases the ability of the film to receive pronounced deformation and causes at least the peripheral film portion to stick to the terminal surface 95. As the active surface is kept at a uniform and substantially constant temperature, the film is uniformly heated and brought to optimal conditions for deformation.

Figure 15:
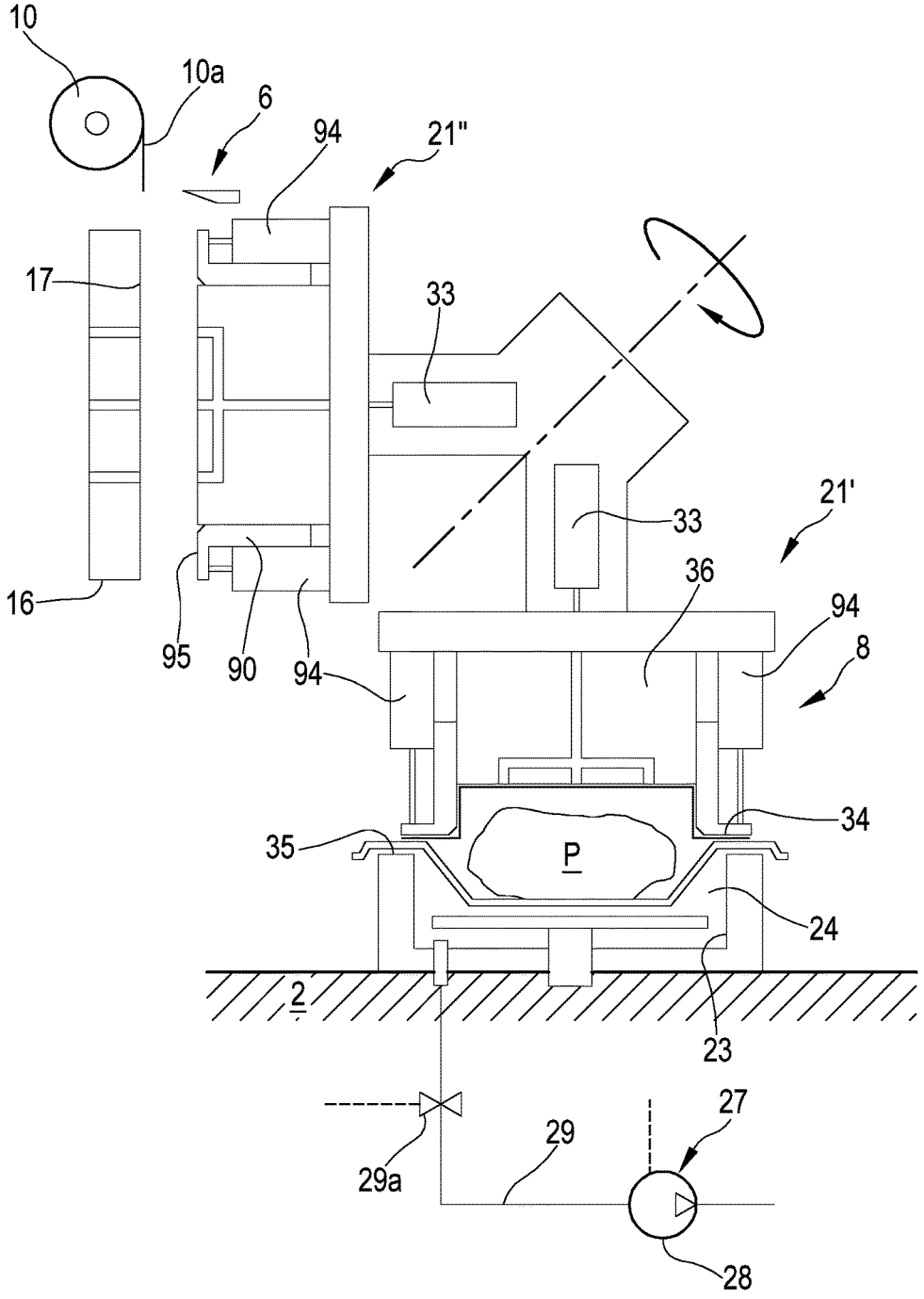

Once the film portion 18*a* has been properly deformed and brought inside the cavity 40, then displacement mechanism may cause—under the control of control unit 100, movement of the upper tool 21' to the position shown in FIG. 15 by imposing a displacement of the upper tool 21' apart from backing structure 16 and then a rotation of the upper tool 21' to the position shown in FIG. 15 where the upper tool 21' is at the packaging assembly while the upper tool 21" has been brought at the cutting assembly 6. Basically the upper tools 21' and 21" switched their position and the upper tool 21" is in FIG. 14 in the same position taken by upper tool 21' in FIG. 8. Then, main actuator 33 acts onto the upper tool 21' under the control of control unit 100 and lowers the upper tool 21' to the lower tool 22 causing movement between said first operating condition, where the upper tool 21' is spaced apart from the lower tool 22 and said packaging assembly 8 is open to receive one or more of said film sheets 18 and one or more trays or supports 4, and said second operating condition (FIG. 16), where a closure surface of the upper tool 21' tightly abuts against a closure surface of the lower tool 22 to form or contribute forming said packaging chamber 24 which is preferably hermetically closed with respect to an atmosphere outside the apparatus. For instance, the closure surface of the upper tool may comprise said terminal surface 95 or another abutting surface surrounding the head 36. The corresponding closure surface of the lower tool may be defined by a top surface of the walls delimiting said seat(s) or by another abutting surface surrounding the seat(s) 23.

Figure 16:
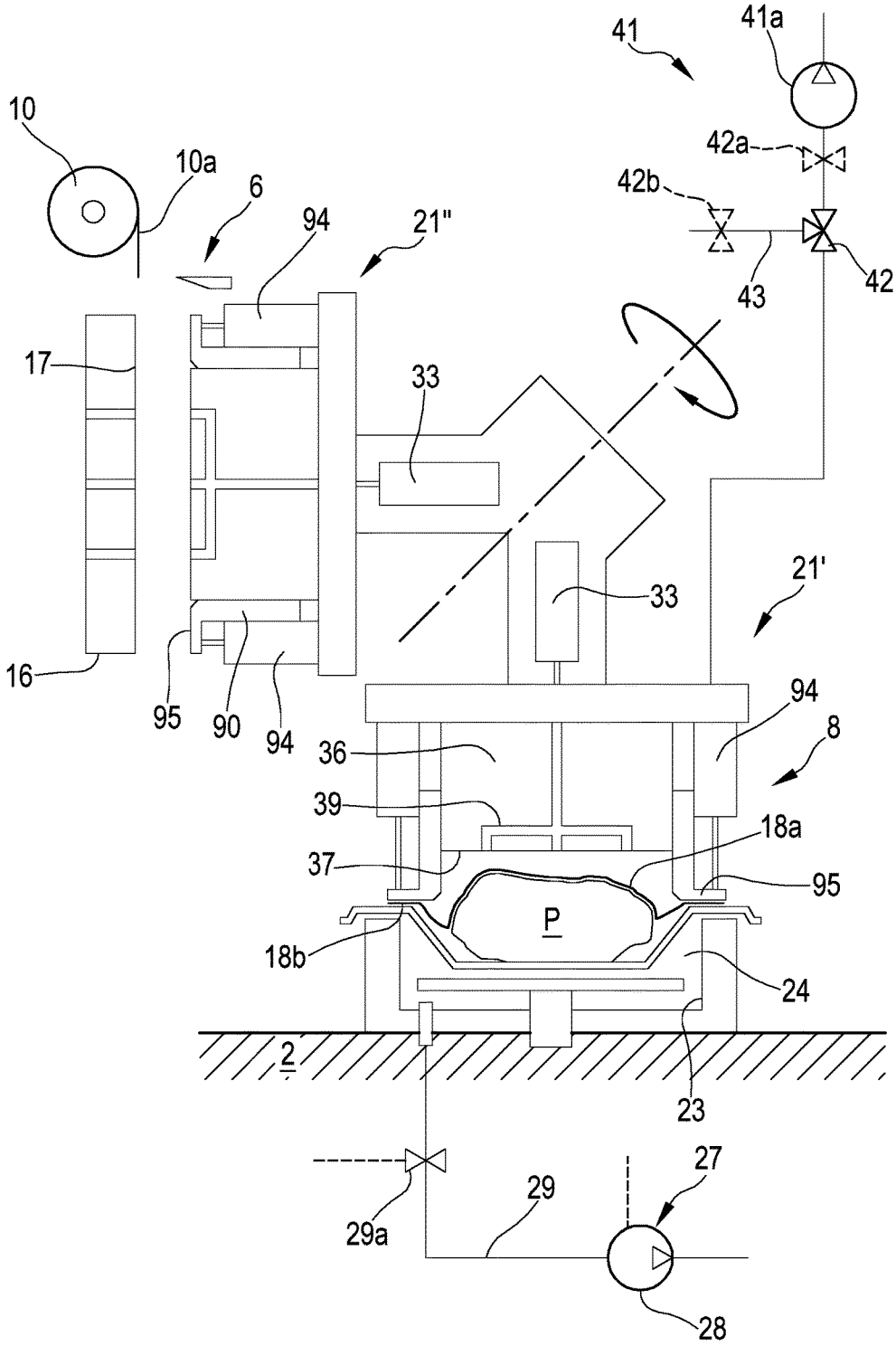
Figure 17:
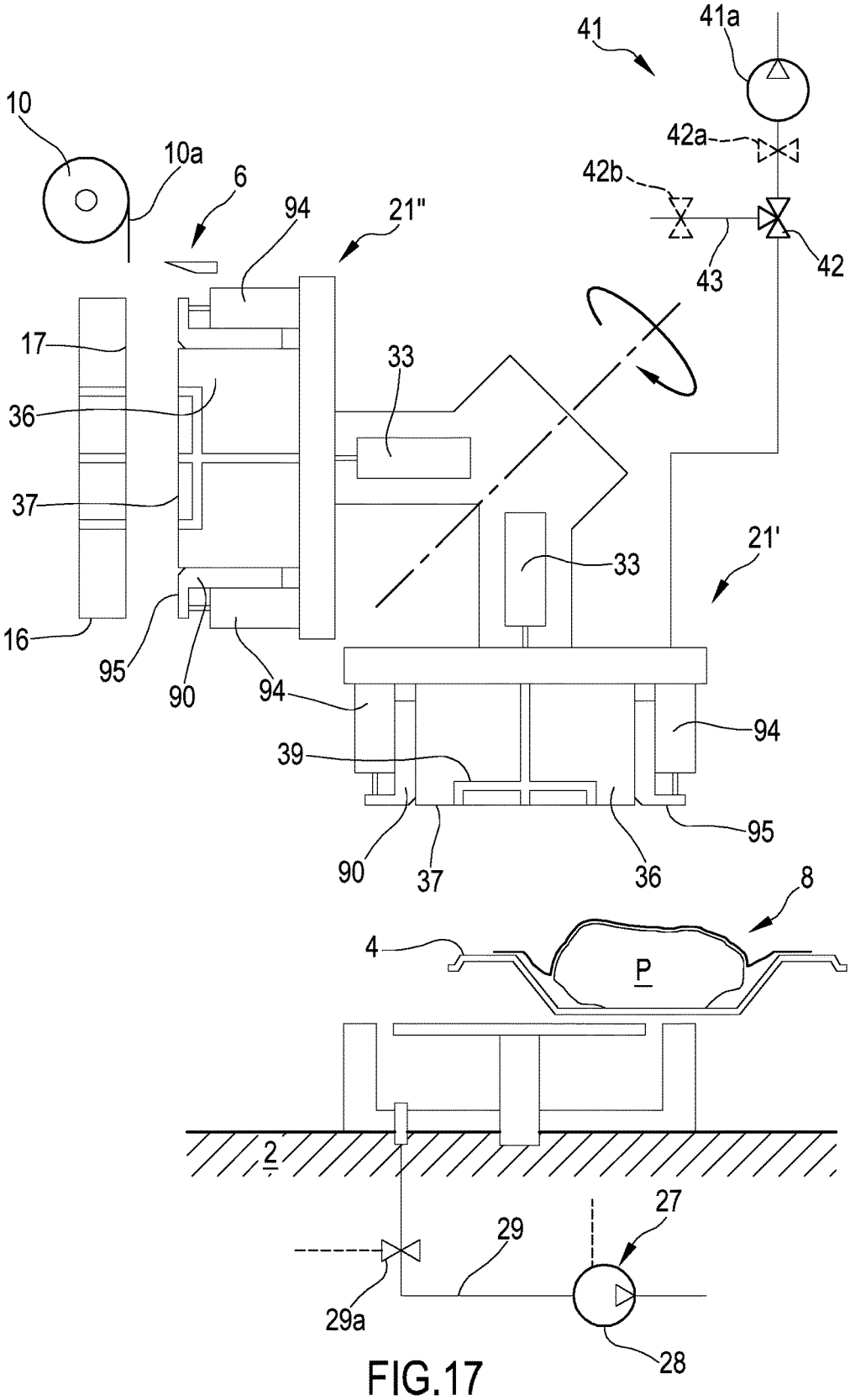

Once the chamber 24 has been closed, a vacuum arrangement 27 may be operated by the control unit (FIGS. 16 and 17). Vacuum arrangement 27 is connected to the packaging chamber 24 and configured for removing gas from inside said packaging chamber; the vacuum arrangement 27 comprises at least at least one vacuum pump 28 and at least one evacuation pipe 29 connecting the inside of said chamber 24 to the vacuum pump; at least one valve 29*a* may also be provided for selectively opening and closing pipe 29; the control unit 100 controls the vacuum pump 28 and/or the valve 29*a* to withdraw gas from said packaging chamber 24 at least when the packaging assembly is in said second operating condition, i.e. with said packaging chamber hermetically closed. In the example shown, the support may include holes located in its side wall which facilitate gas withdrawal from a volume above the tray and under the film sheet 18. Of course, should the tray include no holes then, in order to create a state of vacuum inside the chamber 24 and inside the tray volume, the film sheet 18 is kept separate from the tray or support 4 in one or more points 8 (e.g. by keeping peripheral portion 18*b* slightly apart from tray rim 4*c* when the vacuum chamber is already hermetically closed) while vacuum arrangement 27 is active. In a further aspect, the control unit may be configured to create a vacuum in the packaging chamber 24 (by controlling the vacuum pump 28 to withdraw gas from said packaging chamber 24) until a sufficiently low pressure level is reached (e.g. below 100 mbar or below 50 mbar or below 10 mbar). This pressure level is sufficiently low but not too low so that detachment of the film sheet from the head 36 is avoided (at least during a first phase) as the control unit also creates a pressure level in correspondence of the suction holes 39, by acting on vacuum source 41, below the pressure level reached in the packaging chamber.

Once a desired state of vacuum is reached inside the chamber 24, and after the peripheral portion of the film sheet has been sealingly fixed to the support or tray rim 4*c*, the control unit 100 commands the holding means 38 to release the film portion 18*a*: this may be achieved by commanding selector valve 42 to switch to the vent line 43 (or by appropriately positioning valves 42*a*, 42*b*). The vacuum causes the film 18 to drape down to the tray and to form a skin around the product also attaching to the tray surface not occupied by the product (FIG. 17). At this point the control unit may control again the displacement mechanism 25 and lift the upper tool 21' thereby allowing extraction of the packaged product.

Note while the upper tool 21' is executing the closure of the vacuum chamber and the application of the plastic film sheet to the tray (FIGS. 15-18), the cutting assembly 6 may be operated to cut a new film sheet 18 and the upper tool 21" facing the backing structure 16 may be operated to warm the film sheet, form the cavity, pick the film sheet and configure it into the cavity according to a tri-dimensional shape as described in FIGS. 11-14 for the upper tool 21'. The cycle described above may then be repeated.

Third Embodiment

A third embodiment is shown in FIGS. 19-28.

In this third embodiment, a continuous film 10*a* is fed to the packaging assembly 8 from a film supplying assembly 5, which may include at least one film roll 10. The cutting station 6 is located inside the packaging assembly 8 and in particular it is carried by the upper tool 21: according to this third embodiment the cutting station is configured to cut a portion of film out of the continuous film after said portion of film has been fixed to the respective tray and before the tray is extracted from the assembly 8.

Note that trays or supports 4 are supplied to the packaging assembly 8 by means of a conveyor (not shown) for instance of the type disclosed in connection with FIG. 1. The packaging assembly, the film supply assembly, the cutting station may be mounted on a frame and may be controlled by a control unit 100. A longitudinal portion of the film 10*a* has longitudinal borders which may be guided and longitudinally displaced by displacement means such as pinches carried (e.g. of the type carried by chains or other appropriate transporters).

Figure 25:
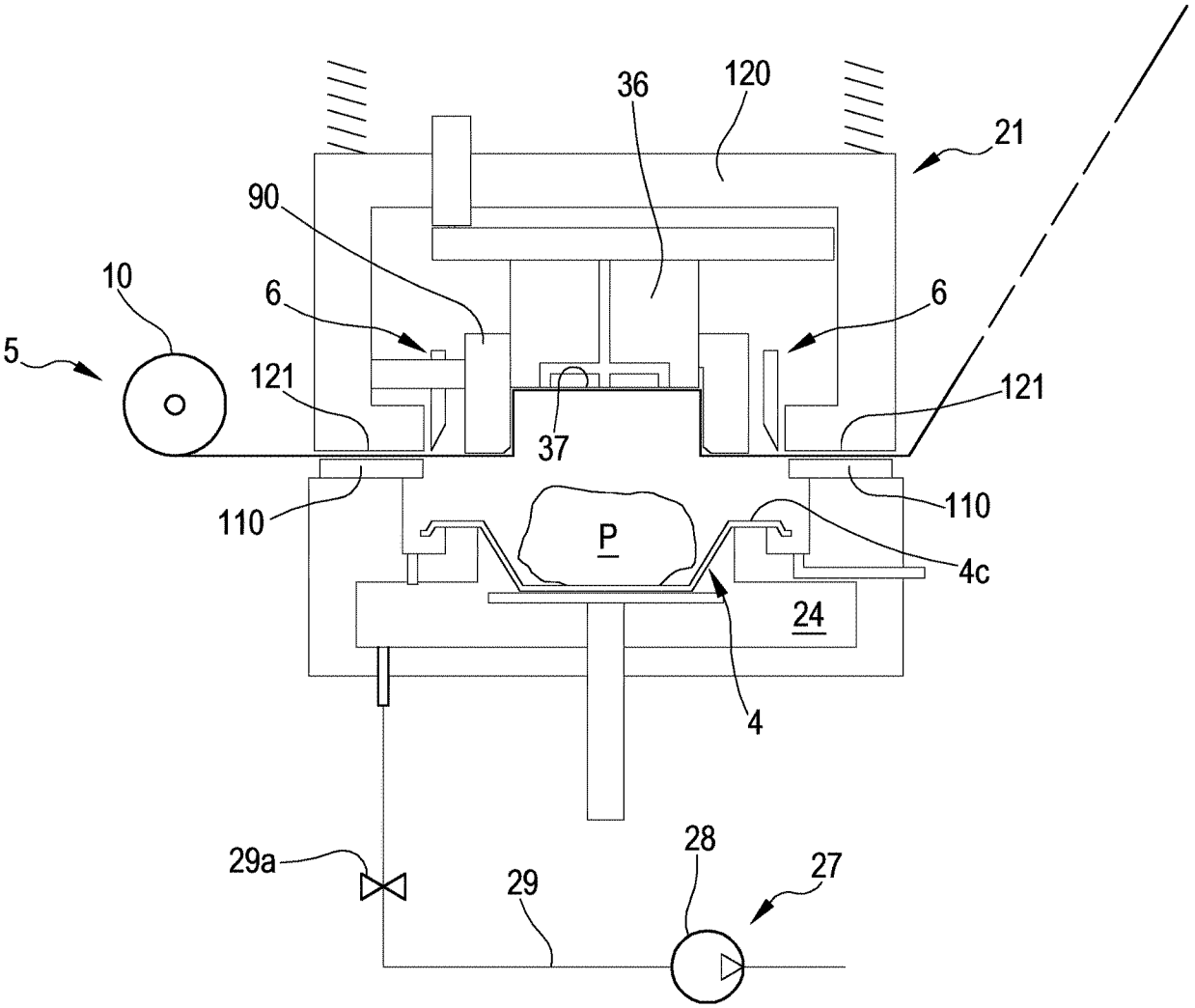
Figure 26:
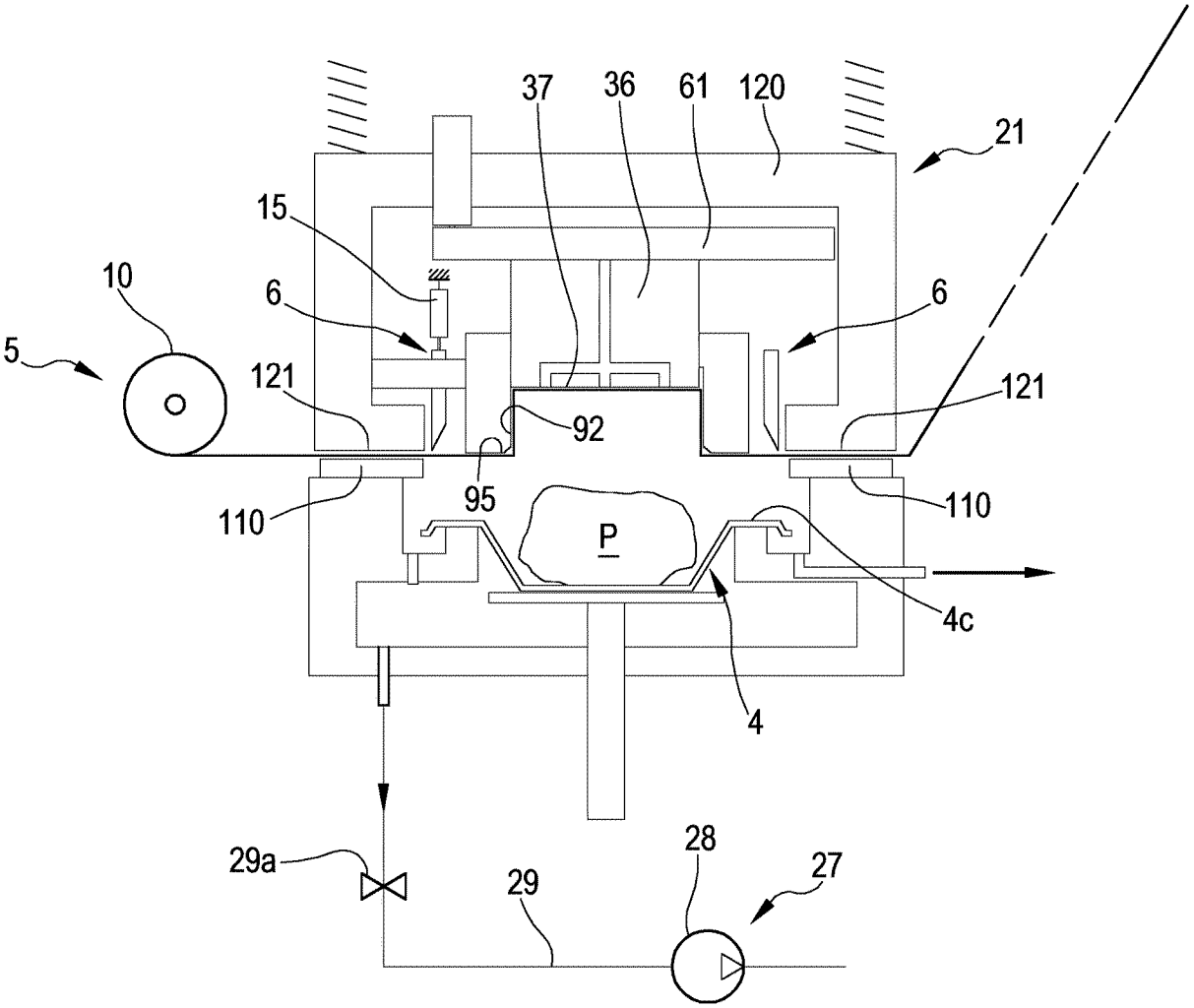
Figure 27:
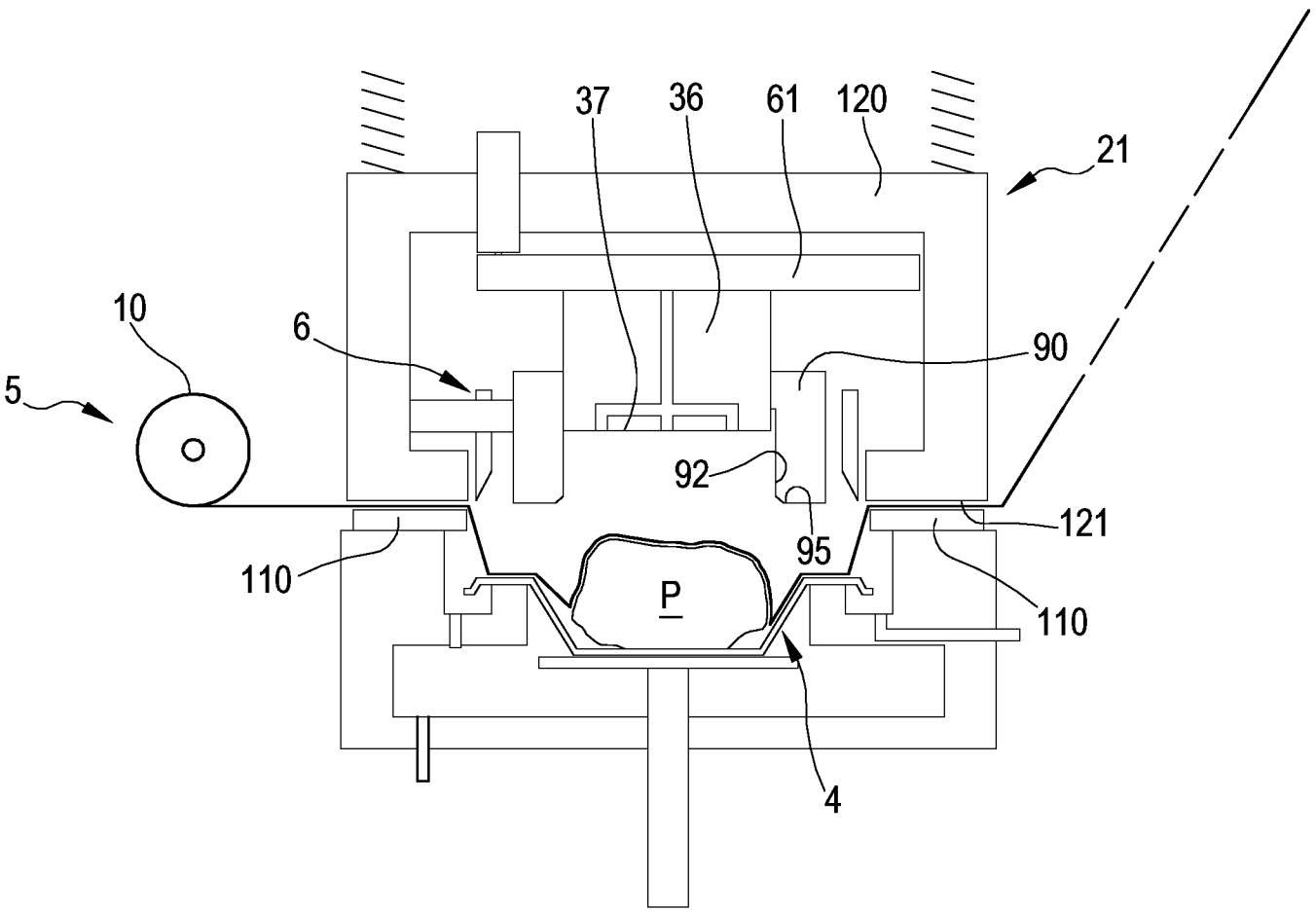

The packaging assembly 8 is configured for tightly closing said one or more supports 4 with said film 10*a* and includes a lower tool 22 comprising a prefixed number of seats 23 for receiving said one or more supports 4, and an upper tool 21 facing the lower tool 22; also in this case the upper tool and the lower tool 21 and 22 are configured to be movable the one relative to the other between at least a first operating condition, where the lower tool and the upper tool are spaced apart and allow positioning of the supports 4 at said seats 23 (see FIG. 19), and a second operating condition, where the lower tool and the upper tool delimit a packaging chamber 24 (see FIGS. 25-27).

The upper tool 21 comprises a housing 120 and head 36 located inside the housing 120 and having a respective active surface 37 configured for receiving a film portion 10*b* of said film 10 (FIG. 21) and a stopper frame 110 interposed between the upper and the lower tools 20, 21. The stopper frame 110 and the upper tool 21 are configured to relatively move from a release condition, where the continuous film 10*a* is allowed to move (FIG. 20), and a stop condition (FIG. 21), where the stopper frame blocks 110 the continuous film 10*a* against an abutting surface 121 of the upper tool 21 and stops said film portion 10*b* above at least one respective support 4. In the example shown the abutting surface is located at the bottom periphery of housing 120. In order to relatively move the stopper frame with respect to the upper tool, a main actuator 33 may be envisaged which is carried by the apparatus frame and which acts, under the control of control unit 100, on one or both the upper tool and the stopper frame. Alternatively an actuator operative between stopper frame and upper tool may be envisaged.

Figure 22:
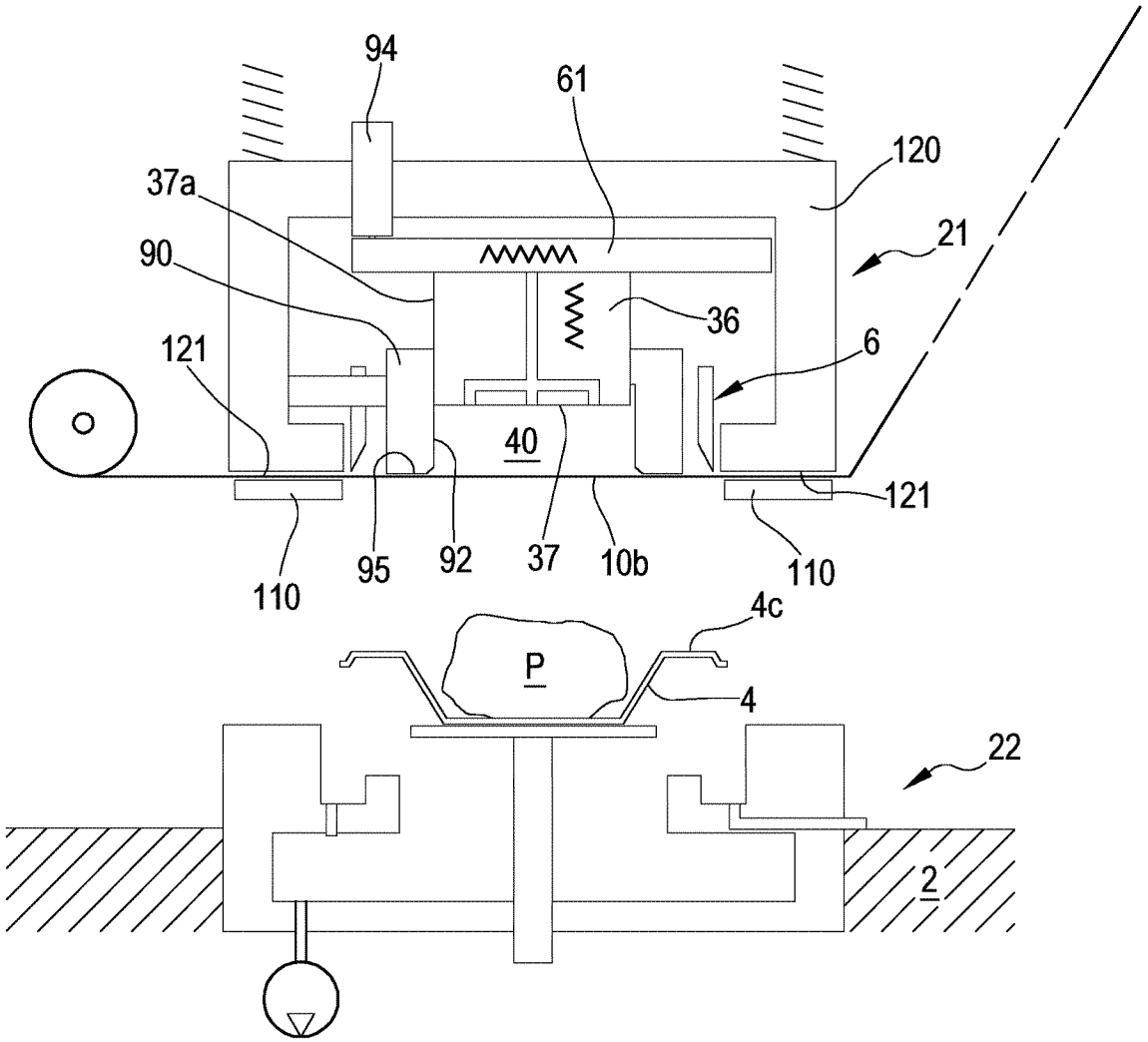

A peripheral body 90, also located in housing 120, is positioned around the head 36. The peripheral body 90 may present an annular conformation and is mounted to the head 36 such that the head 36 and the peripheral body 90 may move one relative to the other. In the example shown the peripheral body stands still during creation of cavity 40, while movement is imparted to the head 36. In practice, after the film portion 10*b* has been blocked by frame 110, the peripheral body 90 is displaced with respect to the head 36 or the head is displaced with respect to the peripheral body (see FIG. 22) so that at least a portion 91 of the peripheral body 90 may protrude beyond the active surface 37 and defines a cavity 40. More in detail, as shown in FIG. 22 a dedicated actuator 94 is configured, under control of control unit 100, to lift the head relative to the peripheral body 90 such that the cavity 40 is formed which is delimited by said active surface 37 and by an inner wall 92 of the protruding portion 91 of the peripheral body 90: the cavity 40 has therefore a volume V the size of which is depending upon the relative positioning of the peripheral body 90 with respect to the holding head 36. As mentioned, the movement of the peripheral body 90 relative to the head 36 is determined by dedicated actuator 94 carried by the upper tool 21 and acting on one or both the peripheral body and the head. In FIGS. 19-28, the dedicated actuator 94 is interposed between the head 36 (or a part rigidly connected to the head 36) and either housing 120 or the apparatus fixed frame 2. The retraction of the head 36 with respect to the peripheral body 90 under the action of dedicated actuator 94 thus determines the formation of cavity 40. On the other hand, the peripheral body 90 in the example of FIGS. 19-28 is instead rigidly carried by the housing and moves vertically together with the housing under the action of the main actuator 33.

As already mentioned the apparatus also includes the control unit 100 which is configured for commanding the main actuator 33 and the dedicated actuator 94 and thus cause the trapping of film 10*a* and then the relative motion of the peripheral body 90 with respect to the head 36 in order to define said cavity 40: for instance the control unit may control the main actuator and/or the dedicated actuator to bring and stably keep for several seconds the peripheral body and the head in one of said relative positions such that the cavity 40 is formed and kept unchanged for the time necessary to apply the film to the respective tray or support 4. The relative movement between the head 36 and the peripheral body 90 is controlled by control unit such as to cause a relative displacement from an end stroke position, where a terminal surface 95 of the peripheral body 90 is aligned or substantially aligned with the active surface 37 of the head 36 (FIG. 21), to an operating position, where the terminal surface 94 of the peripheral body is displaced from the active surface by a distance which represents the height Hc of said cavity 40 (FIG. 24). In practice, when the peripheral body 90 has the terminal surface 95 aligned with the active surface 37 of the head, then there is no cavity and the terminal surface 37 of the peripheral tool is positioned in prosecution to the active surface defining and overall flat backing, while when the peripheral body or the head are relatively moved (see e.g. FIGS. 23 and 24) a cavity 40 is formed and the terminal surface of the peripheral body is no longer aligned with the active surface of head 36.

As shown in the figures the apparatus according to the third embodiment includes holding means 38 (FIG. 21) carried by the upper tool 21. Analogous to the first and second embodiment, the holding means 38 comprises a plurality of suction apertures 39 leading to the active surface 37, at least one vacuum source 41, e.g. comprising a vacuum pump 41*a*, controlled by the control unit 100 and connected to the suction apertures 39, and at least one selector valve 42, also controlled by the control unit 100, selectively connecting said suction apertures 39 either to said vacuum source 41 or to a vent line 43. The control unit may be configured to activate the holding means 38 by switching the selector valve to a position where the valve connects the suction apertures to the vacuum source thereby causing suction of gas through the apertures. Alternatively, two valves 42*a*, 42*b* (see dashed lines in FIG. 21) may be used which may selectively be opened and closed to determine a fluid connection between said apertures either to the vacuum source or to the vent line.

Figure 23:
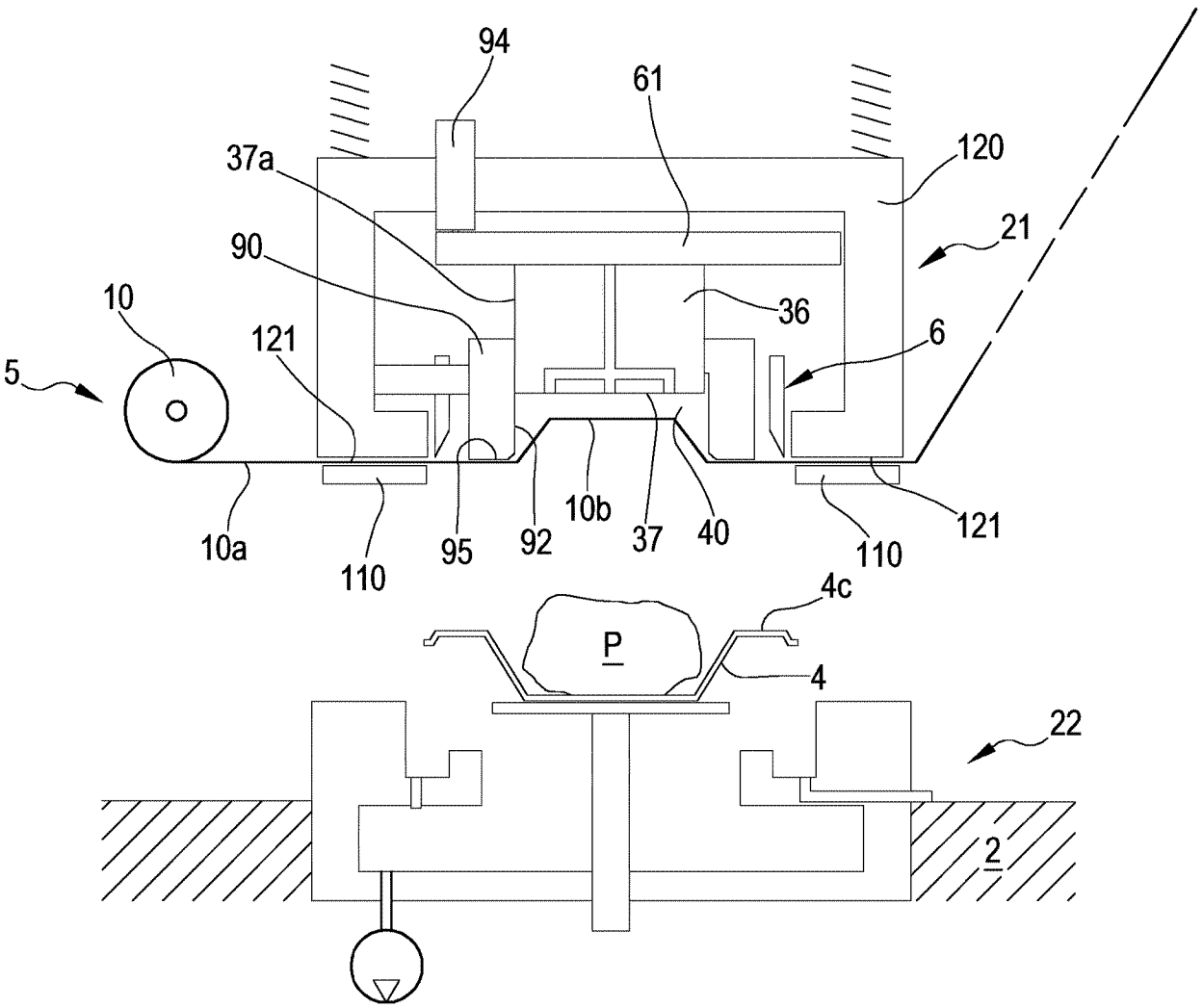
Figure 24:
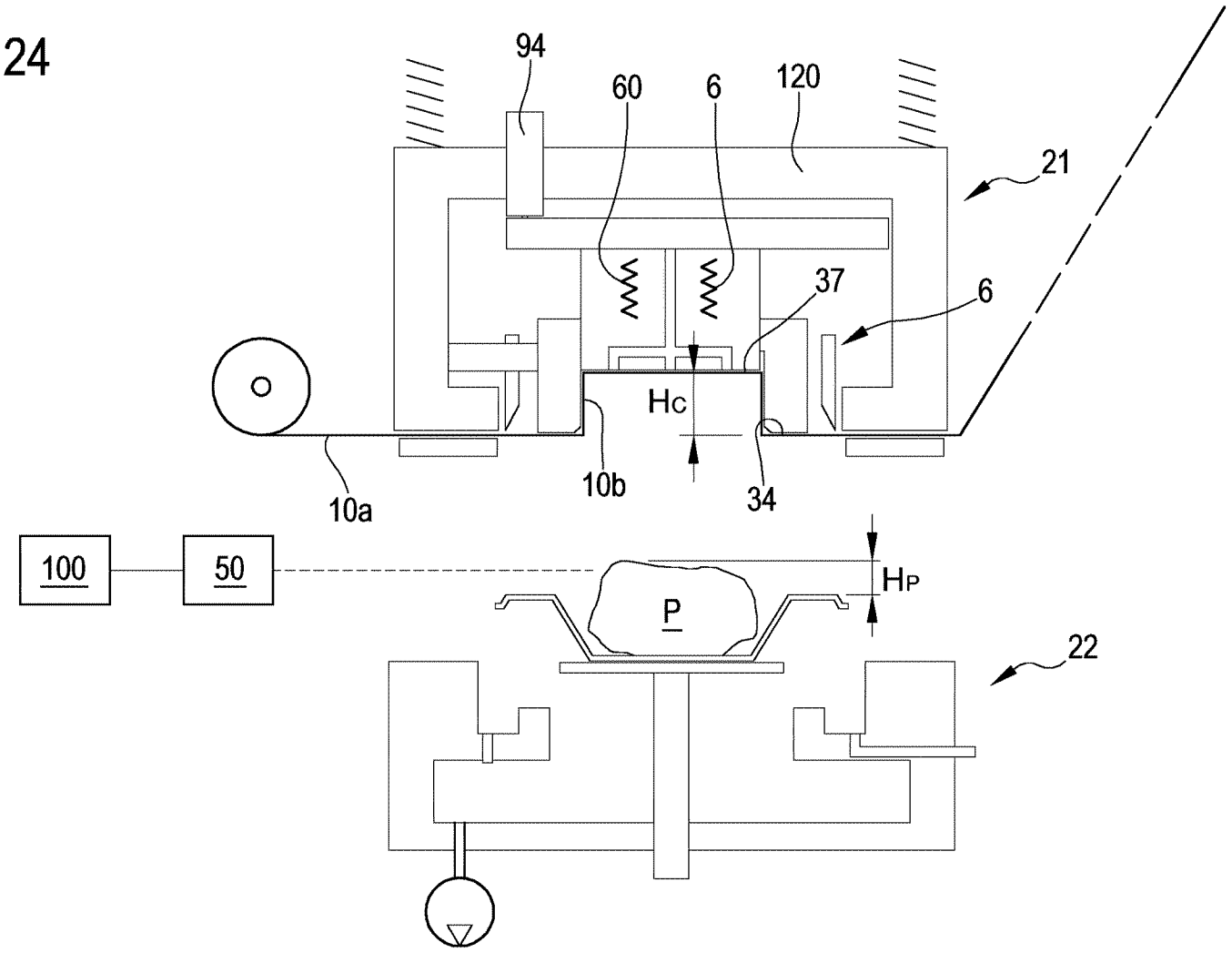

The control unit 100 is configured for activating holding means 38 and is capable of coordinating the relative motion between peripheral body and head with the activation of the holding means 38 such as to cause said film portion 10*b* to move from a substantially flat configuration outside said cavity to a substantially tri-dimensional configuration inside said cavity 40 (see FIGS. 23 and 24). Note that in addition or in alternative to vacuum source 39 the holding means 38 may include other means as already mentioned for the other embodiments.

The control unit 100 commands activation of the holding means 38 before or contemporaneously with forming of the cavity 40 such that, while the cavity is formed, the film portion 10*b* is pulled and stretched by the holding means moving from a substantially flat configuration to a substantially tri-dimensional configuration inside said cavity. Alternatively, as shown in FIGS. 23 and 24, the control unit 100 may be configured for first commanding the relative motion of the head 36 with respect to the peripheral body 90 and then—once the cavity 40 is partially or totally formed—activating the holding means 38, such that first said cavity is formed and then the film portion is forced to move from a substantially flat configuration to a substantially tri-dimensional configuration inside said cavity.

Thus, the control unit 100 may control activation of the holding means 38 such as to cause pulling of said film portion 10*b* inside said cavity 40 and shaping of said film portion 10*b* to the shape of the cavity 40, conferring a quite pronounced deformation to the interested film portion, while the film 10*a* is blocked between frame 110 and abutment surface 120. The head 36 may comprise a flat active surface 37 and a prismatic or cylindrical side surface 37*a* perpendicular to the active surface 37: consequently, as the peripheral body 90 is configured to slide along the head 36, the peripheral body comprises an inner wall 92 with a surface which is shaped as the side surface 37*a* of the head 36, thereby defining a cavity of cylindrical or prismatic shape. Thus, the portion of film sheet undergoing deformation may be compelled to take exactly the shape of the cavity and is therefore substantially stretched and deformed particularly in the area of the film sheet close to terminal surface 95 of the peripheral body.

Also in this third embodiment, the apparatus 1 comprises one or more sensors 50 (see FIG. 24), which may be located on the frame 2 and which communicate with the control unit 100. Sensor 50 is configured to detect a value of a parameter which may be the height of the product hosted in a support or directly the extent of protrusion Hp of a product beyond a top rim 4*c* of support 4, or the total of the height product plus support. The sensor 50 is configured to issue a signal for the control unit linked to the detected value of the mentioned parameter and the control unit is configured to receive said signal, and command the relative motion of the peripheral body 90 with respect to the head 36 by distance Hc equal to or greater than said extent of protrusion Hp, in order to configure the cavity 40 with a height at least sufficient to host the protruding portion of the product P.

According to another aspect, the apparatus 1 includes heating means 60 configured to heat at least the active surface 37 of the head 36. The heating means may include resistances or inductances or printed circuits or other type of heaters located inside the head 36 or in proximity the active surface 37 and controlled by the control unit 100 which is configured for regulating the heating means such that the active surface of the head 36 is brought at least to an operating temperature comprised between 150° C. and 260° C., optionally between 180-240° C., more optionally between 200-220° C. One or more temperature sensors or one or more thermal switches may be positioned in correspondence or in proximity of head 36 in order to provide the control unit with a feedback signal and allow control of the active surface temperature within the above ranges. In an aspect the control unit 100 is configured for controlling the heating means such that the terminal surface 95 of the peripheral body 90 is kept at a temperature which is always below the operating temperature of said active surface: this has the advantage of setting the surface at a temperature which is appropriate for plastic deformation of the film portion 10*b* and at the same time setting the terminal surface at a temperature which is optimal for heat sealing portion 10*b* to the tray rim 4*c* without compromising the integrity thereof. In a variant, as shown in FIGS. 18-29, the heating means comprises a heating body 61 conductively connected to the head 36.

The control unit is configured to bring the active surface at said operating temperature before initiating the deformation process of the film sheet. In other words, at least before causing the film portion 10*b* to move inside the cavity 40 and take the said substantially tri-dimensional configuration, the control unit 100 activates the heating means 60 and brings the active surface to the operating temperature appropriate to the film structure and material under deformation. In accordance with an aspect the control unit 100 is configured to permanently keep the temperature of the active surface at said operating temperature across a plurality of packaging cycles.

Once the film portion 10*b* has been properly deformed and brought inside the cavity 40, then main actuator or a further actuator 130 associated to the lower tool may cause—under the control of control unit 100, movement from said first operating condition (FIG. 24), where the upper tool 21 is spaced apart from the lower tool 22 and said packaging assembly 8 is open, and said second operating condition (FIG. 25), where a the upper tool 21 and the lower tool 22 are brought together to form said packaging chamber 24 which is preferably hermetically closed with respect to an atmosphere outside the apparatus.

Figure 28:
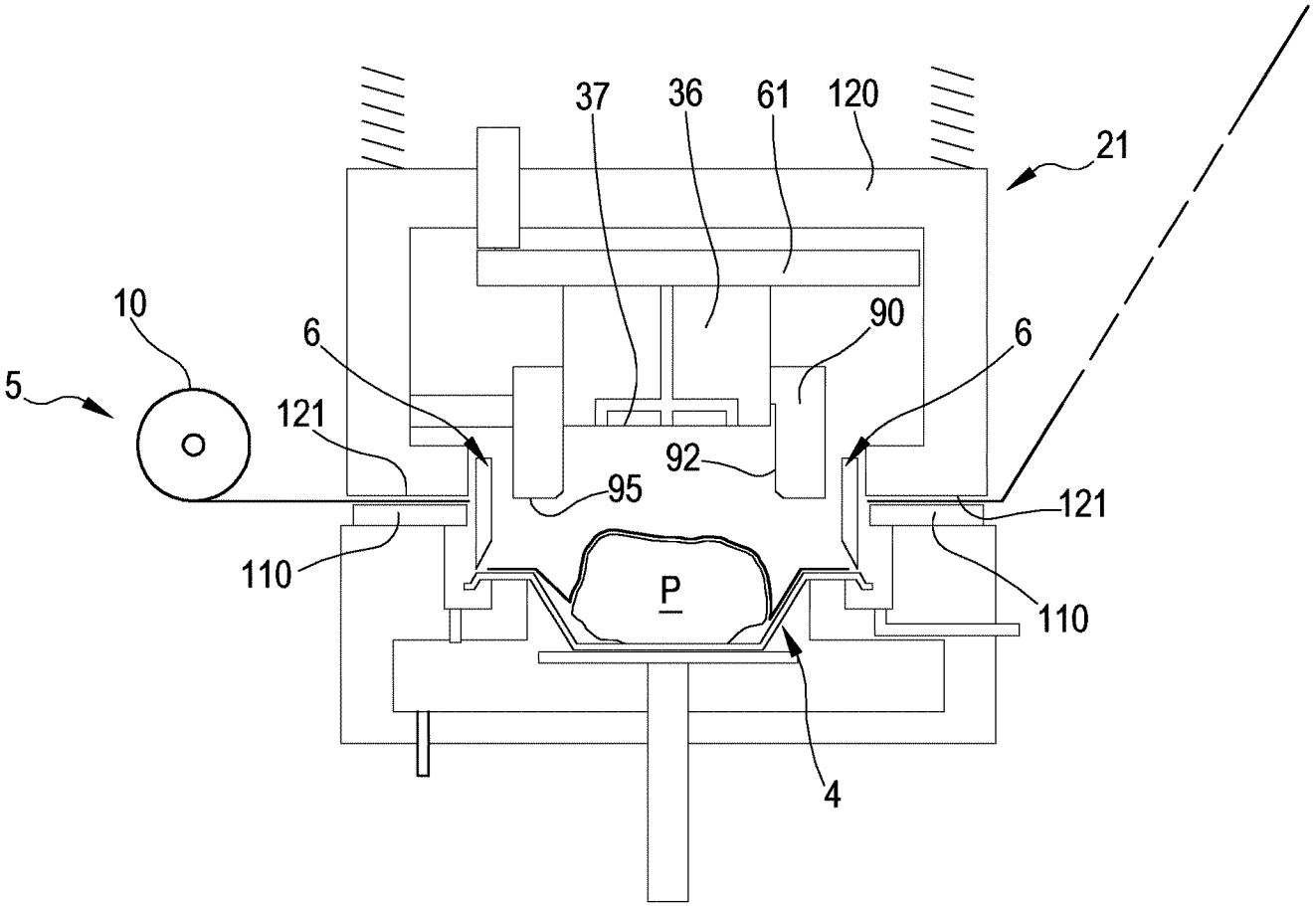
Figure 29:
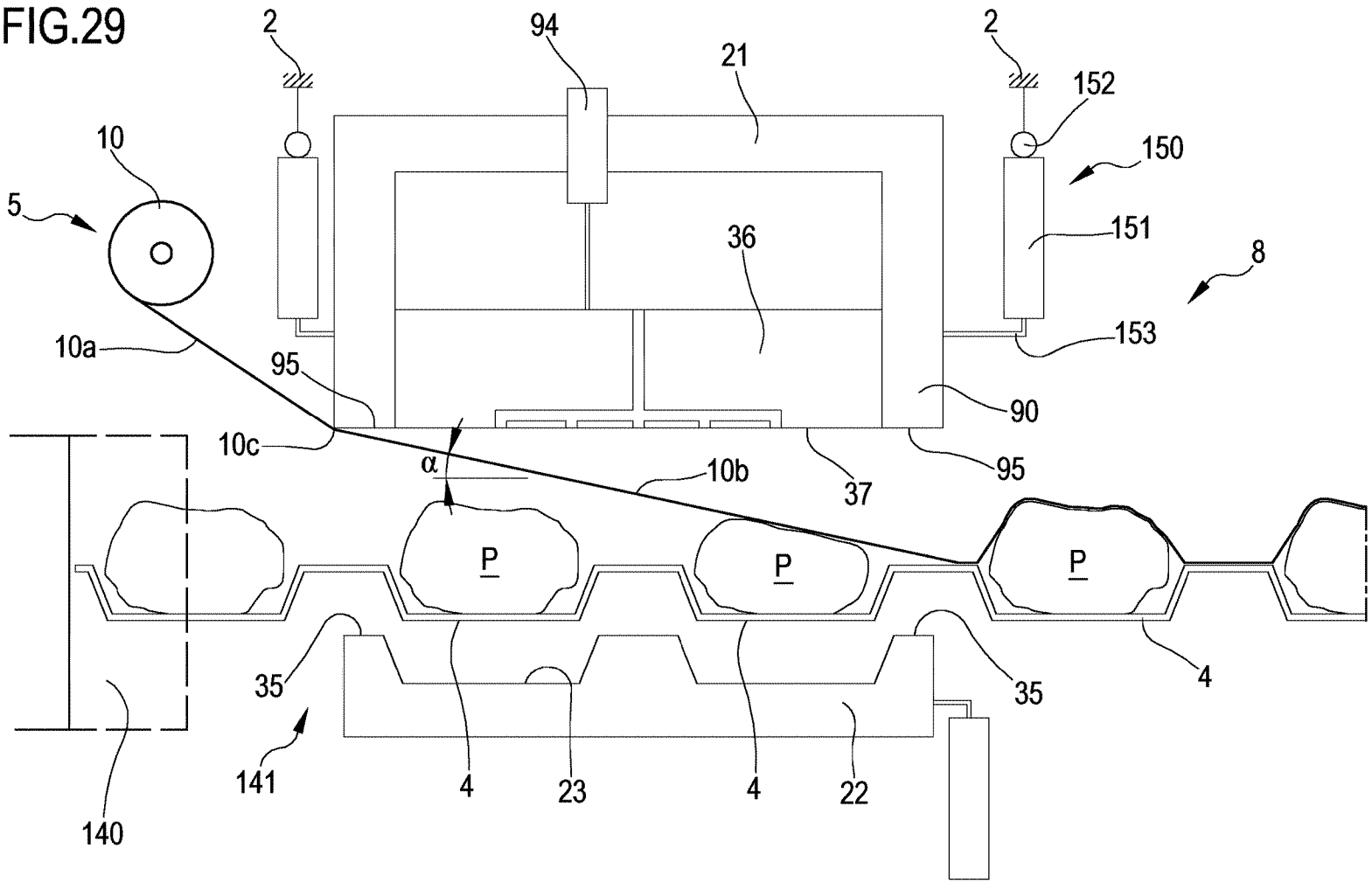
FIG. 29-38 are schematic side views relating to a fourth embodiment of a packaging apparatus according to aspects of the invention. In these figures consecutive phases of a packaging process operated by the apparatus of the third embodiment are shown.
Figure 30:
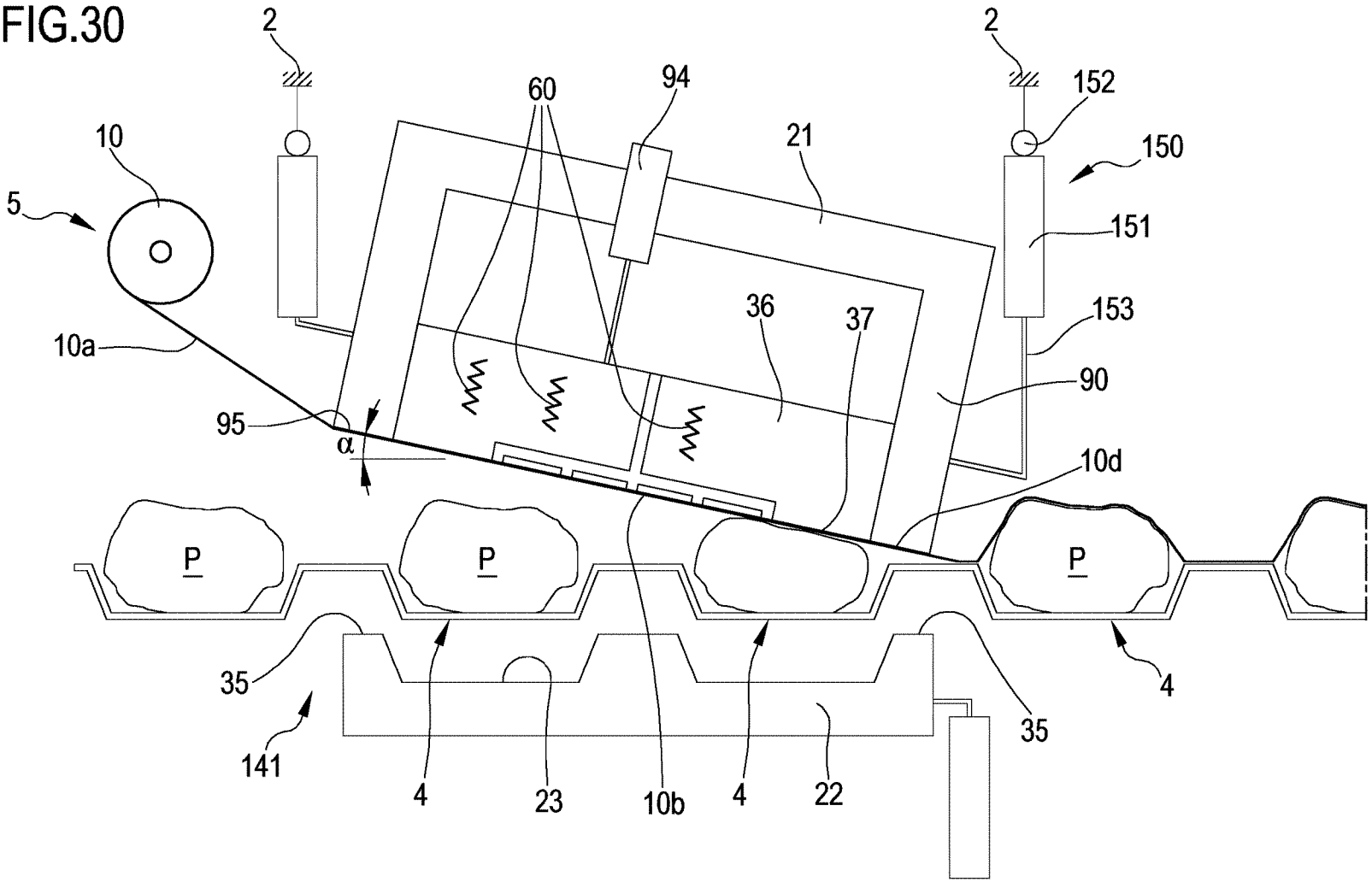

Once the chamber 24 has been closed, a vacuum arrangement 27 may be operated by the control unit (FIG. 25). Vacuum arrangement 27 is connected to the packaging chamber 24 and configured for removing gas from inside said packaging chamber; the vacuum arrangement 27 comprises at least one vacuum pump 28 and at least one evacuation pipe 29 connecting the inside of said chamber 24 to the vacuum pump; at least one valve 29*a* may also be provided for selectively opening and closing pipe 29; the control unit 100 controls the vacuum pump 28 and/or the valve 29*a* to withdraw gas from said packaging chamber 24 at least when the packaging assembly is in said second operating condition, i.e. with said packaging chamber hermetically closed. In the example shown, the support may include holes located in its side wall which facilitate gas withdrawal from a volume above the tray and under the film 10*a*. In a further aspect, the control unit may be configured to create a vacuum in the packaging chamber 24 (by controlling the vacuum pump 28 or a valve on line 29 such as to allow to withdraw gas from said packaging chamber 24) until a sufficiently low pressure has been reached (e.g. below 100 mbar or below 50 mbar or below 10 mbar). This pressure level is sufficiently low but not too low so that detachment of the film sheet from the head 36 is avoided during a first phase as the control unit also creates a pressure level in correspondence of the suction holes 39, by acting on vacuum source 41, below the pressure level reached in the packaging chamber. Once a desired state of vacuum is reached inside the chamber 24, the control unit 100 commands the holding means 38 to release the film portion 18*a*: this is may be achieved by commanding selector valve 42 (or valves 42*a*, 42*b*) to switch to the vent line 43. The vacuum causes the film 18 to drape down to the tray and to form a skin around the product also attaching to the tray surface not occupied by the product (FIGS. 26 and 27) and in particular bonding to tray rim 4*c*. At this point the control unit may control the cutting assembly 6, e.g. acting on blade piston 14, to cause separation of the film portion 10*b* from the film. The assembly 8 may then be opened and the packaged product extracted (FIG. 28).

The cycle described above may then be repeated.

The apparatus 1 of the third embodiment may also, or may alternatively, include a controlled atmosphere arrangement 30 connected to the packaging chamber 24 and configured for injecting a gas stream into said packaging chamber; the controlled atmosphere arrangement comprises at least one injection device including an injection pump and/or one injection valve 31 connecting the inside of said chamber 24 to the source of gas (not shown) which may be located remotely from the apparatus 1; the control unit 100 may be configured to control opening and closing of the injection valve (or activation of the injection pump) to inject said stream of gas at least when the packaging assembly 8 is in said second operating condition, i.e. with said packaging chamber 24 hermetically closed.

Although the apparatus 1 may have one or both the vacuum arrangement 27 and the controlled atmosphere arrangement 30, it is to be understood that the control unit 100 of the apparatus 1 may also be configured to tightly engage the film sheets 18 to the trays without activating the vacuum arrangement or the controlled atmosphere arrangement and thus leaving the normal environment atmosphere within the tray. This may be for instance the case for non perishable products. Thus in a version, the apparatus 1 may be designed without vacuum arrangement and without modified atmosphere arrangement.

Fourth Embodiment

A fourth embodiment is shown in FIGS. 29-38.

In the fourth embodiment, a continuous film 10*a* is fed to the packaging assembly 8 from a film supplying assembly 5, which may include at least one film roll 10. The cutting station is not shown and—if present—may for instance be located downstream the packaging assembly and intervene on the packaged products. A tray supply assembly 140 is configured for supplying a continuous web 141 including a plurality of thermoformed supports 4 in the form of interconnected trays: the tray supply assembly may include a transport means e.g. acting on the longitudinal borders of the web: chains with pincers may be used or driving rollers or other suitable means controlled by the control unit 100. The tray supply assembly, the film supply assembly and the packaging assembly may be carried by a fixed frame 2.

Figure 35:
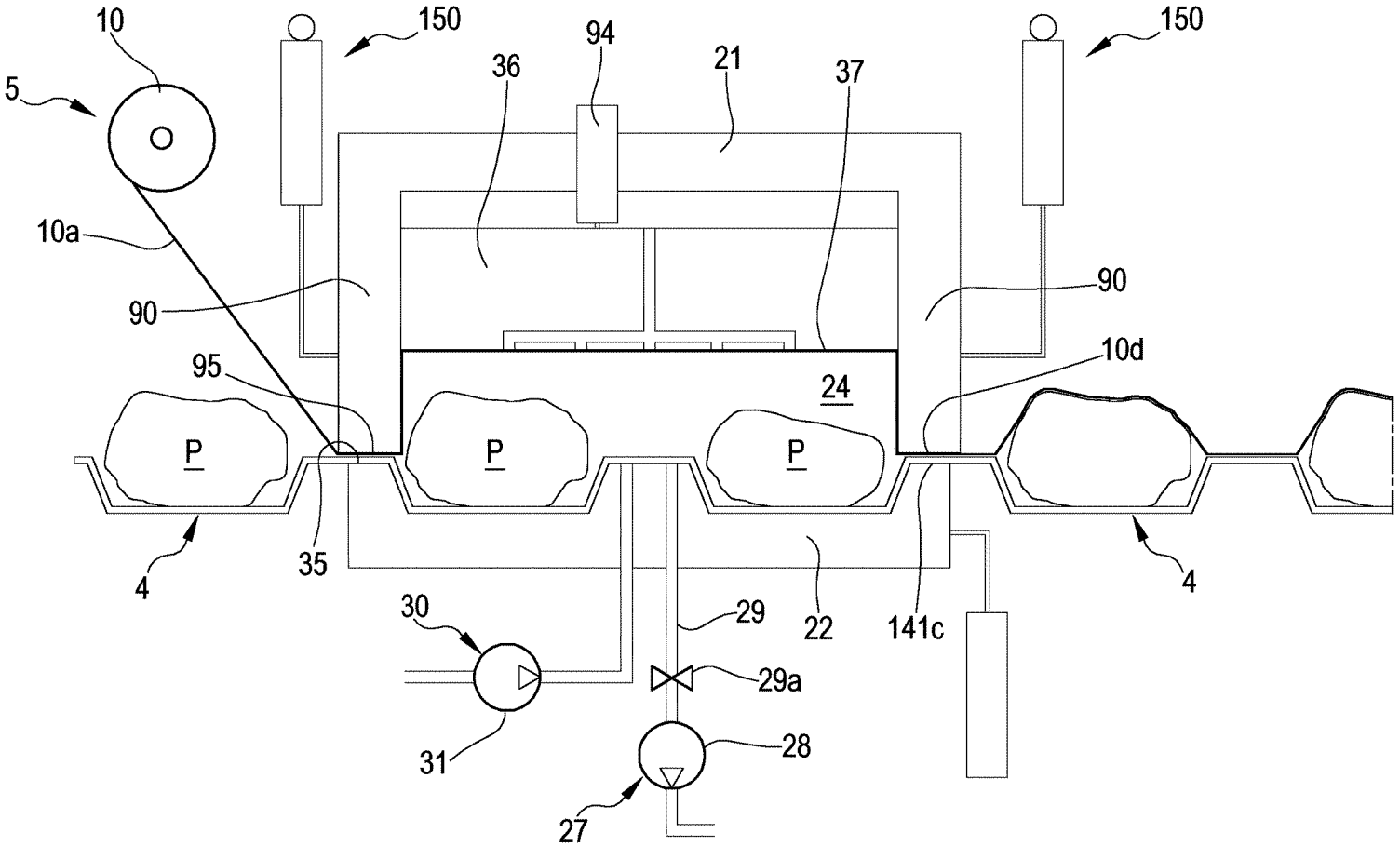
Figure 36:
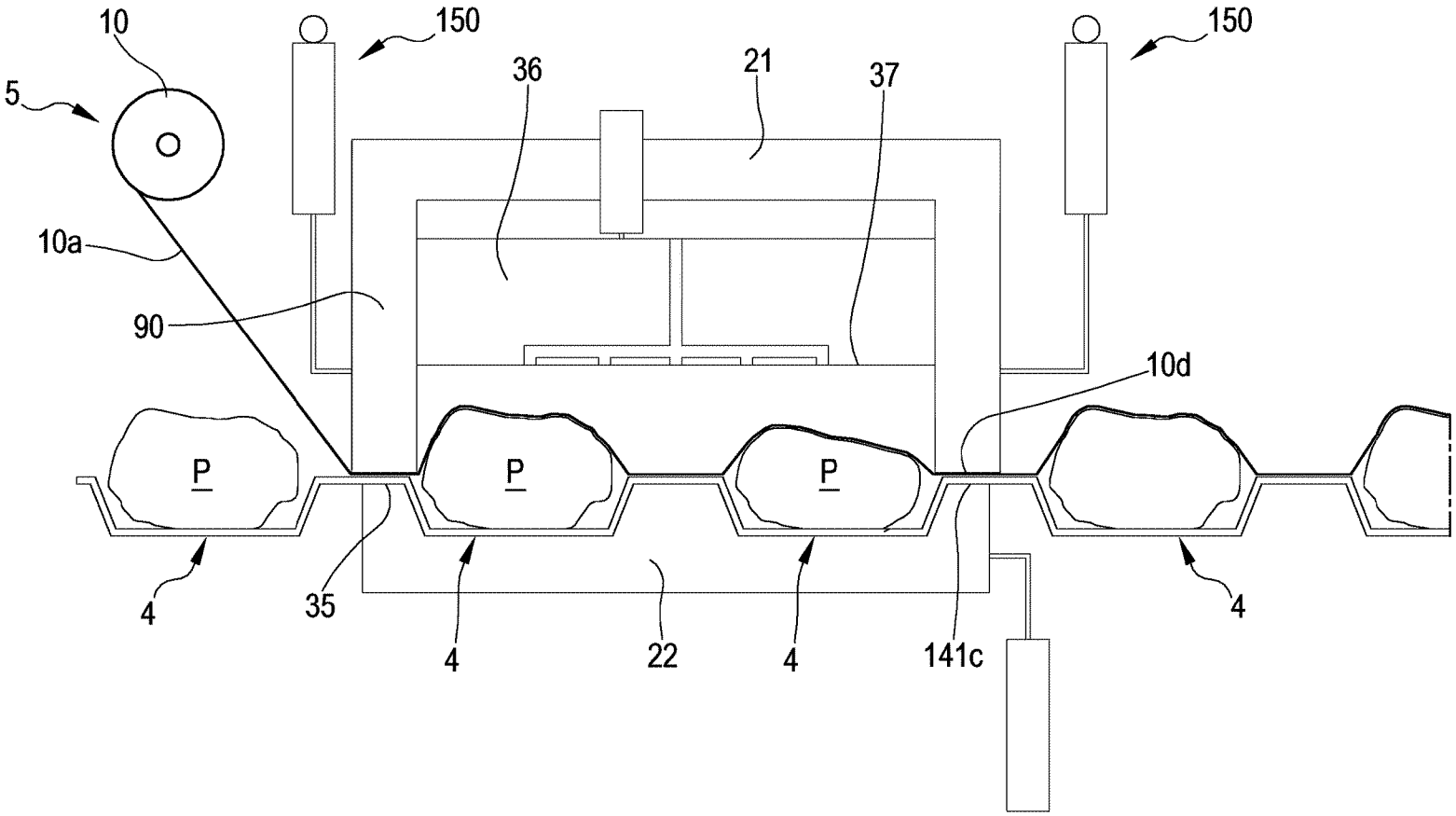
Figure 37:
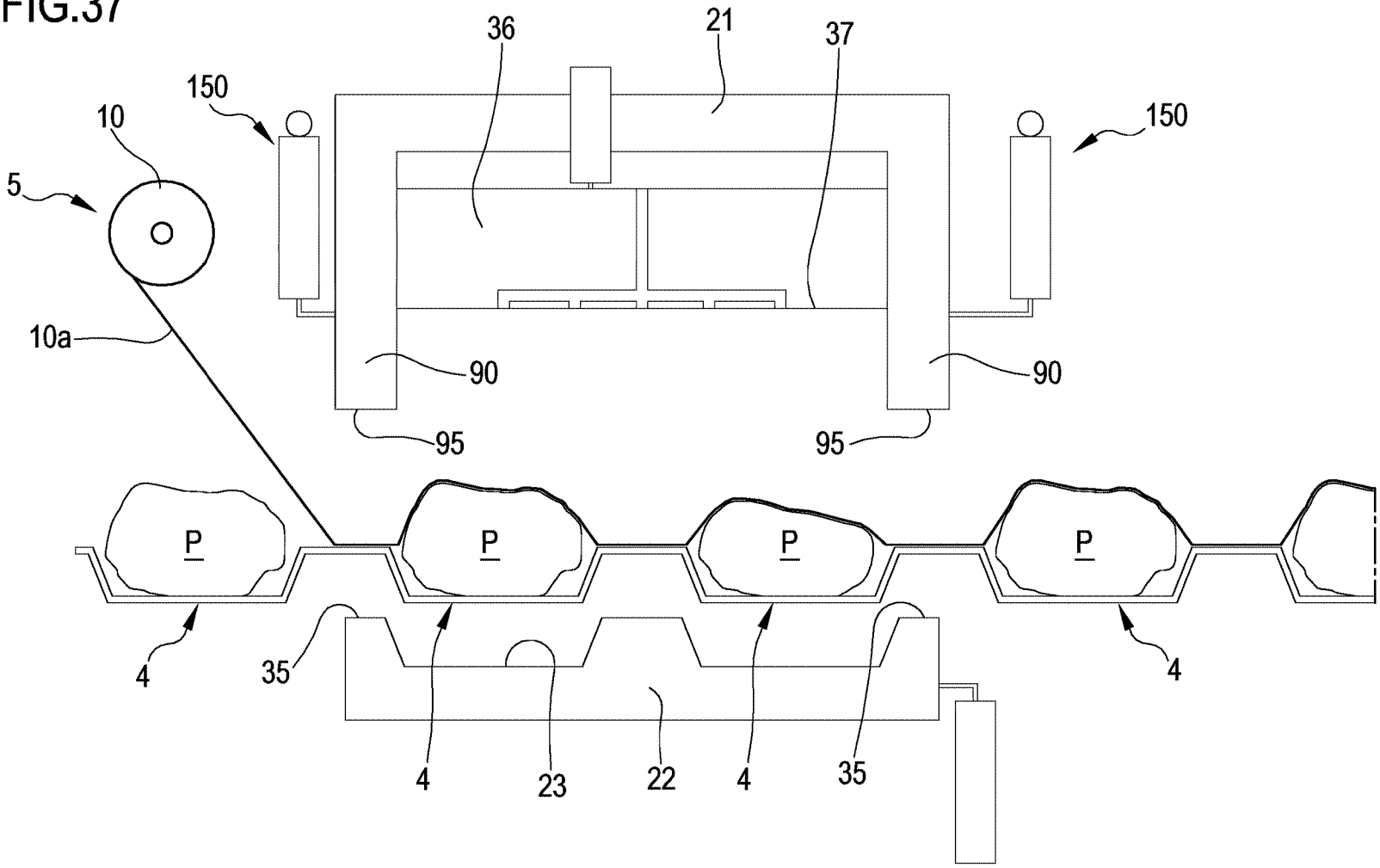
Figure 38:
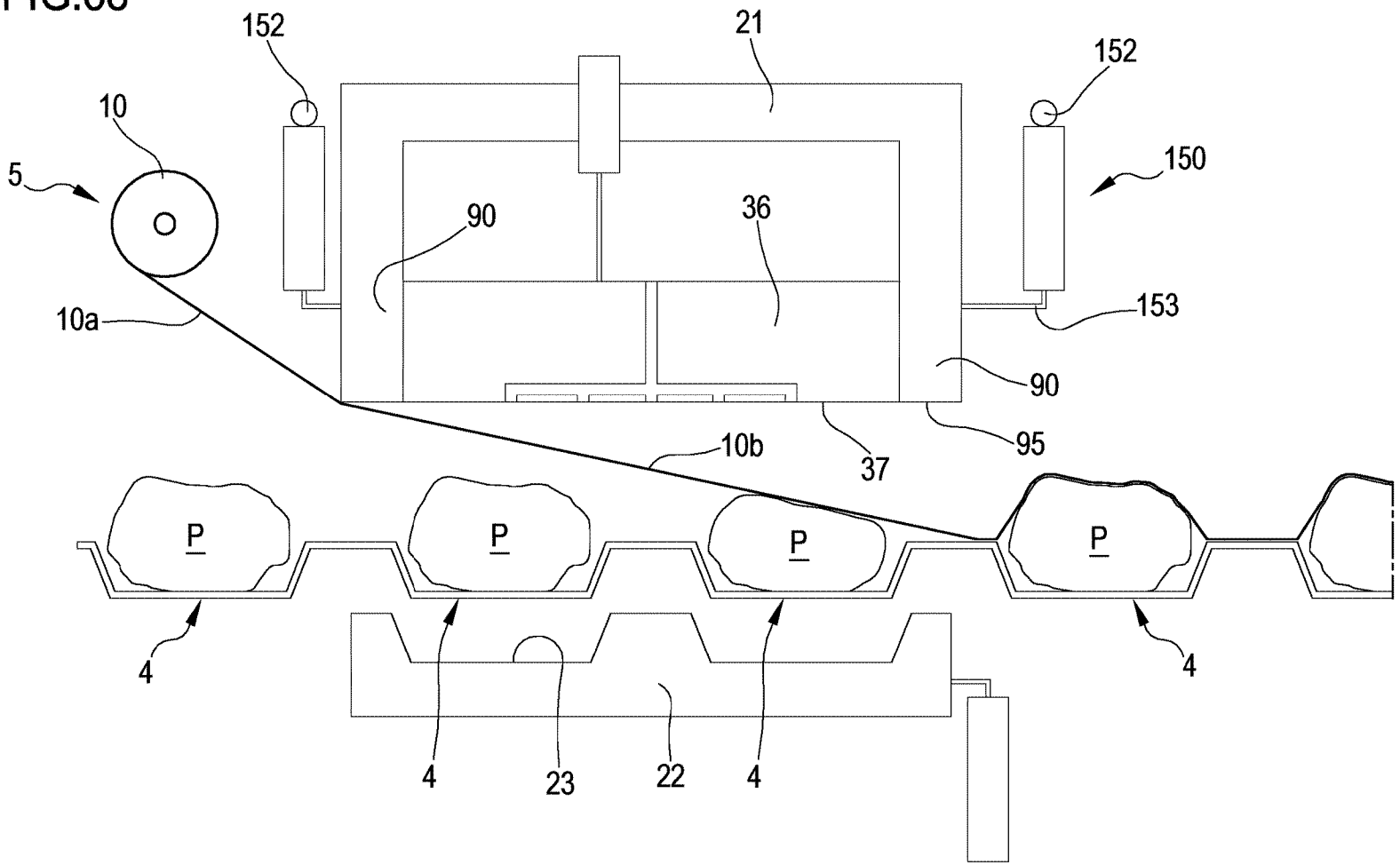

The packaging assembly 8 is configured for tightly closing said supports 4 with said film 10*a* and includes a lower tool 22 comprising a prefixed number of seats 23 for receiving said thermoformed supports 4, and an upper tool 21 facing the lower tool 22; also in this case the upper tool and the lower tool 21 and 22 are configured to be movable the one relative to the other between at least a first operating condition, where the lower tool and the upper tool are spaced apart and allow positioning of the supports 4 inside the packaging assembly, and a second operating condition, where the lower tool and the upper tool delimit a packaging chamber 24 (see FIGS. 35-36).

The control unit 100 is configured to cause the film tray supply assembly to move the continuous web 141 into the packaging assembly 8: as it can be seen a portion of web 141*a* including a plurality of supports 4 is brought at each time inside the packaging assembly between the upper and lower tools 21, 22. At the same time the control unit is configured to move a corresponding film portion or length 10*b* of the continuous film 10*a* into the packaging assembly 8. The film supply assembly 5 and the packaging assembly 8 are configured and relatively positioned such that the film length 10*b* is fed to the packaging assembly 8 at an acute angle $\alpha$ with respect to the horizontal, as shown e.g. in FIG. 29. Furthermore, the upper tool is mounted on a cinematic structure 150 which allows both an angular and a translational, preferably vertical, movement to the upper tool. The cinematic structure 150 may comprise two actuators 151 positioned a respective side of the upper tool and each having one end 152 hinged to the apparatus frame 2 and an opposite end 152 hinged to the upper tool.

The control unit controls the cinematic structure to first bring the upper tool in contact with a leading section 10*c* of the continuous film closer to the film supply assembly compared to the portion 10*b* of film located above the support or trays in the packaging assembly 8, as it is further disclosed herein below.

Figure 31:
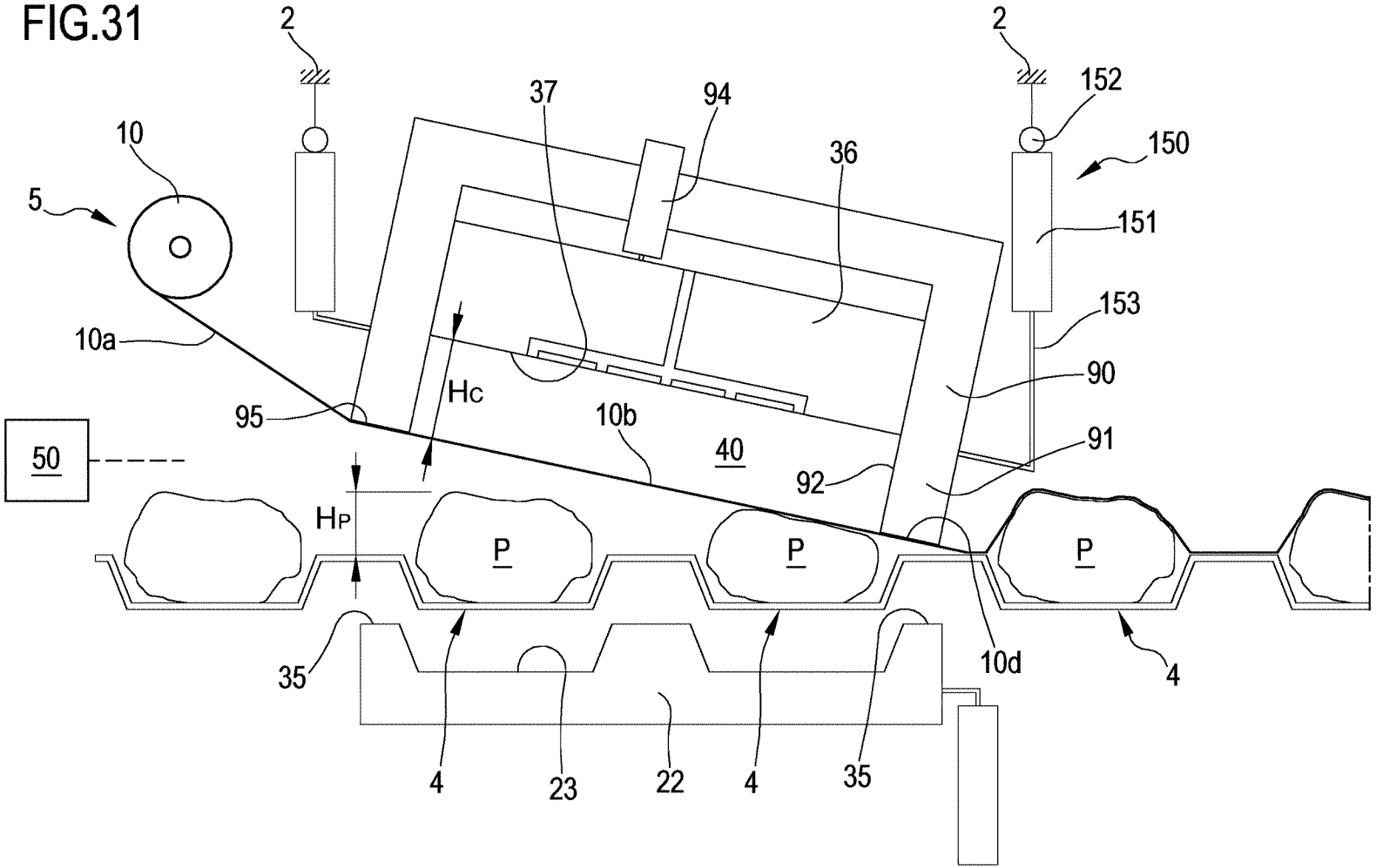

Also in the fourth embodiment, the upper tool 21 comprises head 36 having a respective active surface 37 configured for receiving said film length 10*b* and a peripheral body 90 positioned around the head 36. The peripheral body 90 may present an annular conformation and is mounted to the head 36 such that the head 36 and the peripheral body 90 may move one relative to the other. In practice, after the upper tool—under the action of cinematic structure 150 controlled by control unit 100—is rotated from the position of first contact with the film (FIG. 29) to the position of full contact with the film (FIG. 30), the peripheral body 90 is displaced with respect to the head 36 so that at least a portion 91 of the peripheral body 90 may protrude beyond the active surface 37 and defines a cavity 40. More in detail, as shown in FIG. 31, a dedicated actuator 94 is configured, under control of control unit 100, to lift the head 36 relative to the peripheral body 90 such that the cavity 40 is formed which is delimited by said active surface 37 and by an inner wall 92 of the protruding portion 91 of the peripheral body 90: the cavity 40 has therefore a volume V the size of which is depending upon the relative positioning of the peripheral body 90 with respect to the holding head 36. As mentioned, the movement of the peripheral body 90 relative to the head 36 is determined by dedicated actuator 94 carried by the upper tool 21 and acting on one or both the peripheral body and the head. In FIG. 31 the dedicated actuator 94 is interposed between the head 36 (or a part rigidly connected to the head 36) and either the apparatus fixed frame or the peripheral body 90. The retraction of the head 36 with respect to the peripheral body 90 under the action of dedicated actuator 94 thus determines the formation of cavity 40. The control unit may control the dedicated actuator to bring and stably keep for several seconds the peripheral body and the head in one of said relative positions such that the cavity 40 is formed and kept unchanged for the time necessary to apply the film to the respective trays or supports 4. The relative movement between the head 36 and the peripheral body 90 is controlled by control unit such as to cause a relative displacement from an end stroke position, where a terminal surface 95 of the peripheral body 90 is aligned or substantially aligned with the active surface 37 of the head 36, to an operating position, where the terminal surface 94 of the peripheral body is displaced from the active surface by a distance which represents the height Hc of said cavity 40. In practice, when the peripheral body 90 has the terminal surface 95 aligned with the active surface 37 of the head, then there is no cavity and the terminal surface 37 of the peripheral tool is positioned substantially in prosecution to the active surface defining an overall substantially flat backing, while when the peripheral body or the head are relatively moved (see e.g. FIG. 31) a cavity 40 is formed and the terminal surface of the peripheral body is no longer aligned with the active surface of head 36 (note that in case the active surface 37 is dome shaped then the relative motion of peripheral body and head causes an increase of the size of the cavity linked to the magnitude of the relative stroke of the two parts and thus linked to Hc). Note that the control unit may alternatively control the dedicated actuator 94 and the cinematic structure 150 such that the cavity 40 starts being formed while the upper tool 21 is still rotating from the position of initial contact shown in FIG. 29 to the position of full contact shown in FIG. 30.

Figure 32:
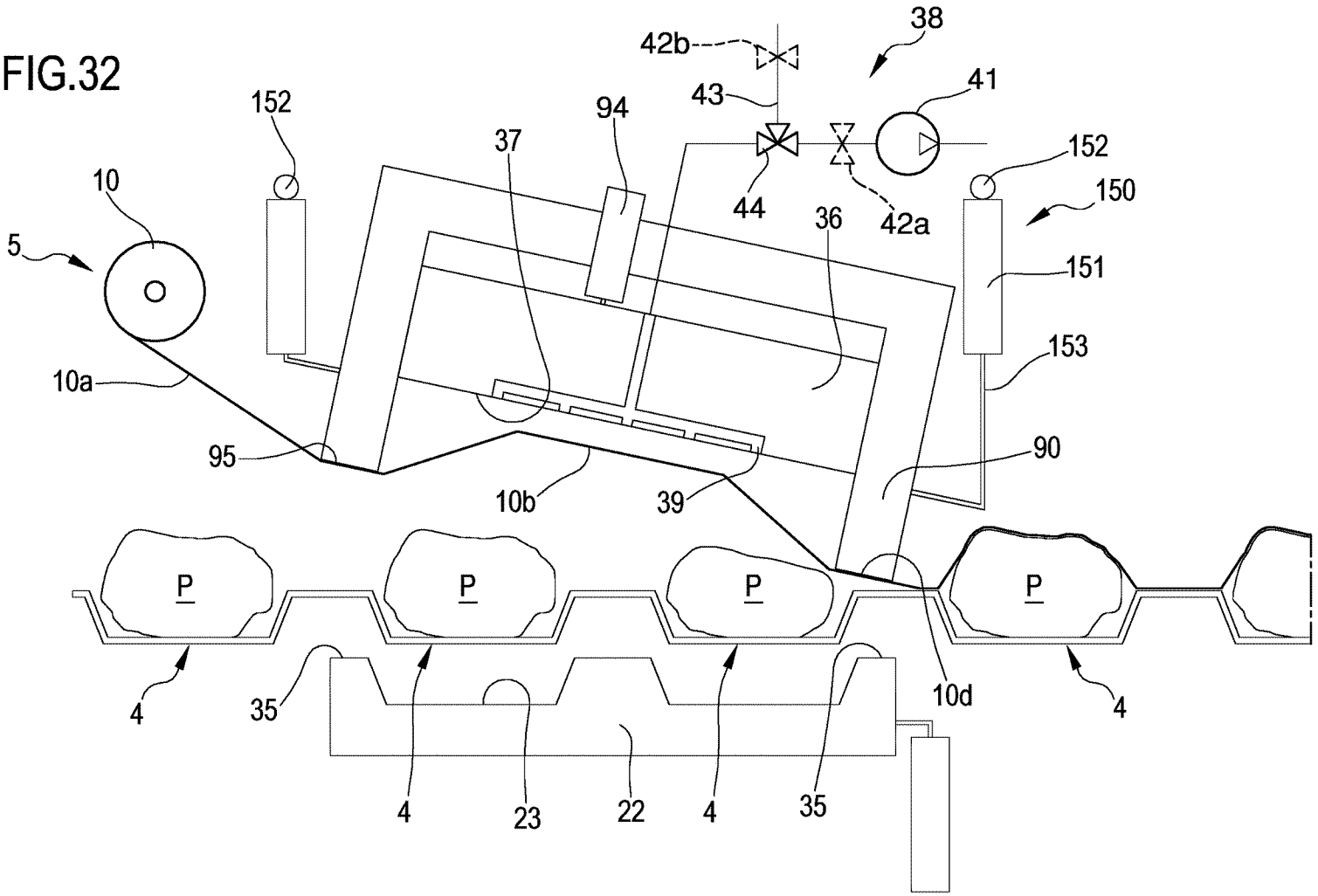

As shown in FIG. 32 the apparatus according to the fourth embodiment includes holding means 38 carried by the upper tool 21. Analogous to the other embodiments, the holding means may comprise a plurality of suction apertures 39 leading to the active surface 37, at least one vacuum source 41 controlled by the control unit 100 and connected to the suction apertures, and at least one selector valve 42, also controlled by the control unit 100, selectively connecting said suction apertures either to said vacuum source 41 or to a vent line 43.

Figure 33:
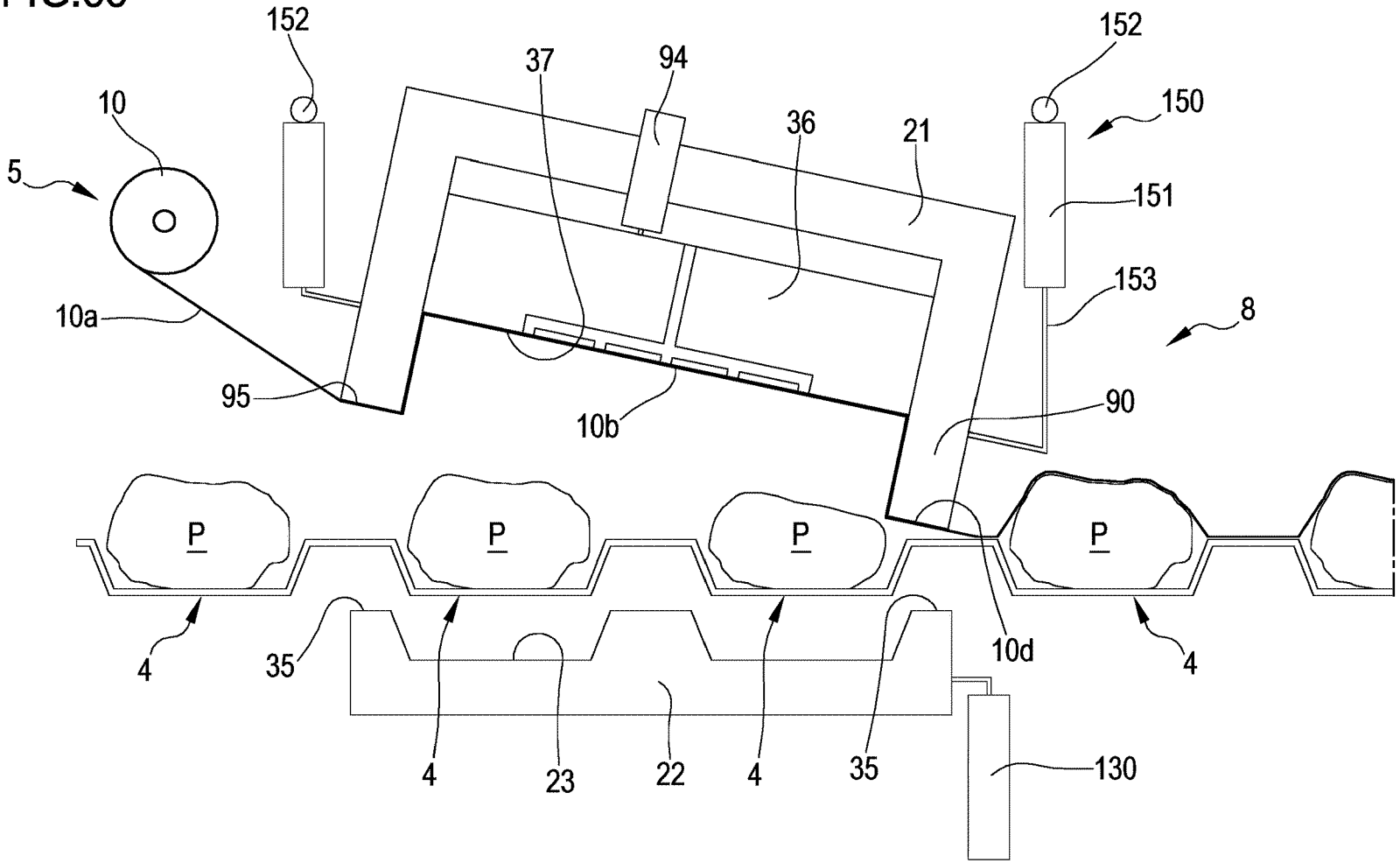
Figure 34:
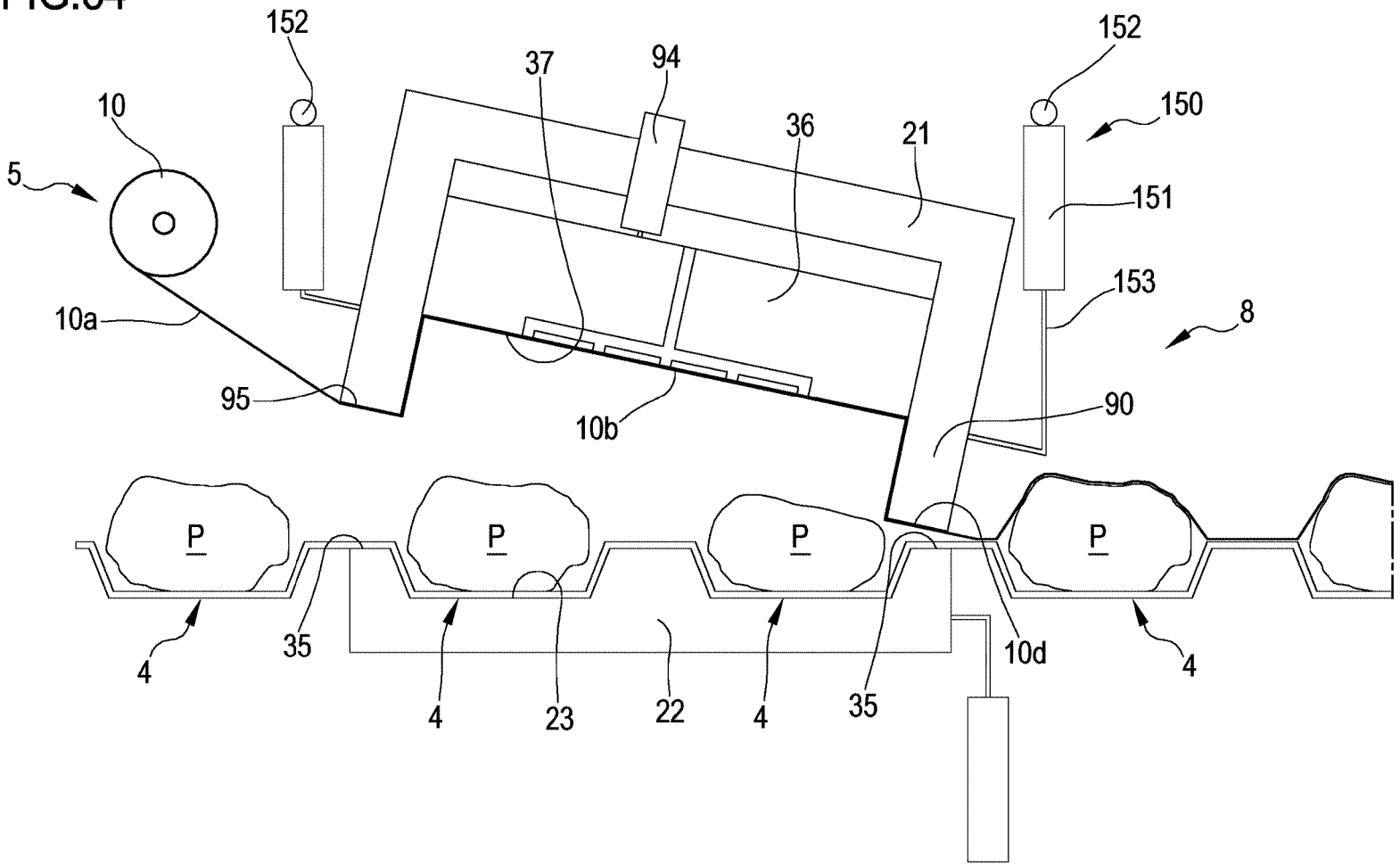

The control unit 100 is configured for activating holding means 38 and is capable of coordinating the relative motion between peripheral body and head with the activation of the holding means 38 such as to cause said film length 10*b* to move from a substantially flat configuration outside said cavity to a substantially tri-dimensional configuration inside said cavity 40 (see FIGS. 32 and 33). Note that in addition or in alternative to vacuum source 39 the holding means 38 may include other means as already mentioned for the other embodiments.

The control unit 100 commands activation of the holding means 38 before or contemporaneously with forming of the cavity 40 such that, while the cavity is formed, the film length 10*b* is pulled and stretched by the holding means moving from a substantially flat configuration to a substantially tri-dimensional configuration inside said cavity. Alternatively, as shown in FIGS. 32 and 33, the control unit 100 may be configured for first commanding the relative motion of the head 36 with respect to the peripheral body 90 and then—once the cavity 40 is partially or totally formed—activating the holding means 38, such that first said cavity is formed and then the film portion is forced to move from a substantially flat configuration to a substantially tri-dimensional configuration inside said cavity.

Thus, the control unit 100 may control activation of the holding means 38 such as to cause pulling of said film length 10*b* inside said cavity 40 and shaping of said film length 10*b* to the shape of the cavity 40, conferring a quite pronounced deformation to the interested film length, while the film 10*a* is blocked as both the film supply assembly is stopped in this phase and as the film, downstream the packaging assembly is stably fixed to the supports. The head 36 may comprise a flat active surface 37 and a prismatic or cylindrical side surface 37*a* perpendicular to the active surface 37: consequently, as the peripheral body 90 is configured to slide along the head 36, the peripheral body comprises an inner wall 92 with a surface which is shaped as the side surface 37*a* of the head 36, thereby defining a cavity of cylindrical or prismatic shape. Thus, the portion of film sheet undergoing deformation may be compelled to take exactly the shape of the cavity and is therefore substantially stretched and deformed particularly in the area of the film sheet close to terminal surface 95 of the peripheral body.

Also in this fourth embodiment, the apparatus 1 may comprise one or more sensors 50 (FIG. 31), which may be located on the frame 2 and which communicate with the control unit 100. Sensor 50 is configured to detect a value of a parameter which may be the height of the product hosted in a support or directly the extent of protrusion Hp of a product beyond a top rim 4*c* of support 4, or the total height support plus product. The sensor 50 is configured to issue a signal for the control unit linked to the detected value of the mentioned parameter and the control unit is configured to receive said signal, and command the relative motion of the peripheral body 90 with respect to the head 36 by distance Hc equal to or greater than said extent of protrusion Hp, in order to configure the cavity 40 with a height at least sufficient to host the protruding portion of the product P.

According to another aspect, the apparatus 1 includes heating means 60 configured to heat at least the active surface 37 of the head 36. The heating means may include resistances or inductances or printed circuits or other type of heaters located inside the head 36 or in proximity the active surface 37 and controlled by the control unit 100 which is configured for regulating the heating means such that the active surface of the head 36 is brought at least to an operating temperature comprised between 150° C. and 260° C., optionally between 180-240° C., more optionally between 200-220° C. One or more temperature sensors or one or more thermal switches may be positioned in correspondence or in proximity of head 36 in order to provide the control unit with a feedback signal and allow control of the active surface temperature within the above ranges. In an aspect the control unit 100 is configured for controlling the heating means such that the terminal surface 95 of the peripheral body 90 is kept at a temperature which is always below the operating temperature of said active surface: this has the advantage of setting the surface at a temperature which is appropriate for plastic deformation of the film sheet portion 10*b* and at the same time setting the terminal surface at a temperature which is optimal for heat sealing without compromising the support integrity.

The heating means are preferably activated by the control unit such as to constantly keep the active surface at said operating temperature. Thus, the control unit 100 activates the heating means 60 and brings the active surface to the operating temperature appropriate to the film structure and material under deformation before starting the packaging cycles and typically makes sure the active surface remains at said operating temperature. Heating of the film increases the ability of the film to receive pronounced deformation and causes at least the peripheral film portion to stick to the terminal surface 95.

Once the film portion 10*b* has been properly deformed and brought inside the cavity 40, then cinematic structure 150 or a further actuator 130 associated to the lower tool may cause—under the control of control unit 100—movement from said first operating condition (FIG. 33), where the upper tool 21 is at least angularly spaced apart from the lower tool 22 and said packaging assembly 8 is open, and said second operating condition (FIG. 34), where a the upper tool 21 and the lower tool 22 are brought together to form said packaging chamber 24 which is preferably hermetically closed with respect to an atmosphere outside the apparatus. In this position a peripheral portion or section 10*d* of the film 10*a* located at the periphery of said film length 10*b* and a corresponding portion 141*c* of said web are constrained between an abutment surface of the upper tool (in this case formed by terminal surface 95) and an opposite closure surface 35 of the lower tool.

Once the chamber 24 has been closed, a vacuum arrangement 27 may be operated by the control unit (FIG. 35). Vacuum arrangement 27 is connected to the packaging chamber 24 and configured for removing gas from inside said packaging chamber; the vacuum arrangement 27 comprises at least one vacuum pump 28 and at least one evacuation pipe 29 connecting the inside of said chamber 24 to the vacuum pump; at least one valve 29*a* may also be provided for selectively opening and closing pipe 29; the control unit 100 controls the vacuum pump 28 and/or the valve 29*a* to withdraw gas from said packaging chamber 24 at least when the packaging assembly is in said second operating condition, i.e. with said packaging chamber hermetically closed. In the example shown, the support may include holes located in its side wall which facilitate gas withdrawal from a volume above the tray and under the film 10*a*. In a further aspect, the control unit may be configured to create a vacuum in the packaging chamber 24 (by controlling the vacuum pump 28 to withdraw gas from said packaging chamber 24) until a sufficiently low pressure has been reached (e.g. below 100 mbar or below 50 mbar or below 10 mbar). This pressure level is sufficiently low but not too low so that detachment of the film sheet from the head 36 is avoided during a first phase as the control unit also creates a pressure level in correspondence of the suction holes 39, by acting on vacuum source 41, below the pressure level reached in the packaging chamber. Once a desired state of vacuum is reached inside the chamber 24, the control unit 100 commands the holding means 38 to release the film portion 10*b*: this may be achieved by commanding selector valve 42 to switch to the vent line 43 (or appropriately switching valves 42*a* and 42*b*). The vacuum causes the film 18 to drape down to the tray and to form a skin around the product also attaching to the tray surface not occupied by the product (FIGS. 35 and 36) and in particular bonding to tray rims 4*c*. At this point the control unit may control the assembly 8 to be opened and the packaged product extracted acting on the tray supply assembly or on other conveyors pulling the packaged tray from downstream the packaging assembly.

The cycle described above may then be repeated.

The apparatus 1 of the fourth embodiment may also, or may alternatively, include a controlled atmosphere arrangement 30 connected to the packaging chamber 24 and configured for injecting a gas stream into said packaging chamber; the controlled atmosphere arrangement comprises at least one injection device including an injection pump and/or one injection valve 31 connecting the inside of said chamber 24 to the a source of gas (not shown) which may be located remotely from the apparatus 1; the control unit 100 may be configured to control opening and closing of the injection valve (or activation of the injection pump) to inject said stream of gas at least when the packaging assembly 8 is in said second operating condition, i.e. with said packaging chamber 24 hermetically closed.

Although the apparatus 1 may have one or both the vacuum arrangement 27 and the controlled atmosphere arrangement 30, it is to be understood that the control unit 100 of the apparatus 1 may also be configured to tightly engage the film sheets 18 to the trays without activating the vacuum arrangement or the controlled atmosphere arrangement and thus leaving the normal environment atmosphere within the tray. This may be for instance the case for non perishable products. Thus in a version, the apparatus 1 may be designed without vacuum arrangement and without modified atmosphere arrangement.

Control Unit of Apparatus 1

The apparatus according to the invention has at least one control unit.

The control unit 100 (schematically represented in FIG. 1) may comprise a digital processor (CPU) with memory (or memories), an analogical type circuit, or a combination of one or more digital processing units with one or more analogical processing circuits. In the present description and in the claims it is indicated that the control unit 100 is "configured" or "programmed" to execute certain steps: this may be achieved in practice by any means which allow configuring or programming the control unit. For instance, in case of a control unit 100 comprising one or more CPUs, one or more programs are stored in an appropriate memory: the program or programs containing instructions which, when executed by the control unit, cause the control unit 100 to execute the steps described and/or claimed in connection with the control unit. Alternatively, if the control unit 100 is of an analogical type, then the circuitry of the control unit is designed to include circuitry configured, in use, to process electric signals such as to execute the control unit steps herein disclosed.

In general terms the control unit 100 acts on and controls the active components present in the apparatuses of any one of the above described embodiments, namely (where present) the transport assembly 3, the film cutting assembly 6, the transfer device, the packaging assembly 8 and particularly the upper and/or lower tools 21, 22, the vacuum arrangement 27, the controlled atmosphere arrangement 30 and the other actuators described above.

The control unit may also be configured for controlling the apparatus 1 in order to execute any one of the packaging processes described above or claimed in the appended claims.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and the scope of the appended claims.

For instance, the specific nature of the actuators described is exemplificative and alternative types of actuators may be used provided the type of motion imposed to the mobile parts on which said actuators are operating is the same. Also note that although the described embodiments show a single packaging being produced per time in embodiments 1-3, multiple packaging assemblies may be used in parallel in order to optimize productivity.

The invention claimed is:

1. An apparatus for packaging a product arranged on one or more supports, said one or more supports optionally having a base wall and a side wall, said apparatus comprising:

- a film supplying assembly configured to supply at least one film;
- a packaging assembly configured to tightly close said one or more supports with said film, the packaging assembly including:
  - at least one lower tool comprising a prefixed number of seats for receiving said one or more supports, and
  - at least one upper tool cooperating with the lower tool and configured to hold at least a film portion of said film, wherein the upper tool and the lower tool are configured to be movable relative to each other between at least a first operating condition and a second operating condition, wherein the lower tool and the upper tool allow positioning of the one or more supports at said seats in the first operating condition, and wherein the lower tool and the upper tool delimit a packaging chamber in the second operating condition, wherein the upper tool comprises:

a head having a respective active surface facing the one or more supports and configured to receive the film portion of said film, a holder associated to the head and configured to attract the film portion of said film towards said active surface, a peripheral body positioned around the head, the head and the peripheral body being mounted to permit relative motion with respect to each other among a plurality of relative positions and being configured to define a cavity delimited by said active surface and by an inner wall of said peripheral body; and a control unit connected to the packaging assembly and configured to:

command relative motion of the peripheral body with respect to the head in order to define said cavity, activate the holder, and coordinate commanding the relative motion and activating the holder to cause said film portion to move from a substantially flat configuration to a substantially tri dimensional configuration inside said cavity.

2. The apparatus of claim 1, wherein:

the control unit is configured to command the relative motion by commanding relative motion of the peripheral body with respect to the head from an end stroke position, wherein a terminal surface of the peripheral body is aligned or substantially aligned with the active surface of the head, to an operating position, wherein the terminal surface of the peripheral body is displaced from the active surface by a distance which represents a height of said cavity, the cavity having a volume, a size of which is depending upon the relative positioning of the peripheral body with respect to the head, and either the control unit is configured to first command the relative motion and then activate the holder such that said cavity is formed before said film portion is moved from a substantially flat configuration to a substantially tri-dimensional configuration inside said cavity, or the control unit is configured to command the relative motion after or contemporaneously with activation of the holder such that said cavity is formed together with movement of said film portion from a substantially flat configuration to a substantially tri-dimensional configuration inside said cavity.

3. The apparatus of claim 2 wherein said peripheral body is slidingly and tightly guided along a side surface of said head and wherein the apparatus comprises at least one of:

a dedicated actuator carried by the upper tool and mounted to act on one or both the peripheral body and the head to determine said relative motion, said control unit being configured to control the dedicated actuator to bring and stably keep the peripheral body and the head in one of said plurality of relative positions defining said cavity, or one or more springs interposed between the peripheral body and the upper tool, the one or more springs being positioned and configured to bias the peripheral body at said end stroke position, wherein a terminal surface of the peripheral body is aligned or substantially aligned with the active surface of the head, and a main actuator active on said upper tool under the control of the control unit, said control unit being configured to control the main actuator to bring and stably keep the peripheral body and the head in one of said relative positions defining said cavity.

4. The apparatus of claim 1, wherein the control unit is configured to at least control activation of the holder to cause pulling of said film portion inside said cavity and shaping of said film portion to the shape of the cavity, and wherein the peripheral body comprises an inner wall which surface is shaped as a head side surface thereby defining a cavity of cylindrical or prismatic shape.

5. The apparatus of claim 1, further comprising:

at least one sensor communicating with said control unit and configured to detect a value taken by at least one parameter in the group of:

an extent of protrusion of a product beyond a top of one of said one or more supports, a parameter from which the extent of protrusion is capable of being determined;

wherein the at least one sensor is further configured to issue a signal for said control unit linked to a detected value for the parameter, wherein the control unit is configured to:

receive said signal, and command the relative motion of the peripheral body with respect to the head by a distance equal to or greater than said extent of protrusion to define said cavity with a height at least sufficient to host a protruding portion of said product.

6. The apparatus of claim 1, wherein said holder comprises:

a plurality of suction apertures leading to the active surface, at least one vacuum source controlled by the control unit and connected to the suction apertures, and at least one valve controlled by the control unit and configured to selectively connect said suction apertures either to said vacuum source or to a vent line.

7. The apparatus of claim 1, wherein the packaging assembly further comprises:

at least one of a main actuator or a cinematic structure, wherein the at least one of the main actuator or the cinematic structure is active on at least one of said upper and lower tool and is configured to be controlled by the control unit, wherein the control unit is configured to act on at least one of the main actuator or the cinematic structure and to cause relative movement of the upper and lower tool between said first operating condition, wherein the upper tool is spaced apart from the lower tool, and said second operating condition, wherein a closure surface of the upper tool or a terminal surface of the peripheral body tightly abuts against a closure surface of the lower tool to close said packaging chamber with respect to an atmosphere outside the apparatus.

8. The apparatus of claim 1, further comprising:

heater configured to heat at least the active surface of the head and controlled by the control unit, the control unit being configured to control the heater such that the active surface of the head is brought at least to an operating temperature in a range between 150° C. and 260° C.

9. The apparatus of claim 8, wherein the heater is further configured to heat a terminal surface to allow heat bonding of the film portion to the one or more supports, wherein the control unit is configured to control the heater such that the terminal surface of the peripheral body is kept at a temperature equal or below the operating temperature of said active surface.

10. The apparatus of claim 8, wherein the control unit is configured to bring the active surface at said operating temperature before causing said film portion to move to said substantially tri dimensional configuration inside said cavity.

11. The apparatus of claim 10, further comprising:

a film supplying assembly configured to supply a continuous film, a film cutting assembly active on the continuous film and configured to cut film sheets of prefixed length from said continuous film, wherein the film cutting assembly is located outside said packaging chamber;

a backing structure having a flat holding surface adapted to receive the at least one or more of said film sheets cut by the film cutting assembly, a displacement mechanism active on the packaging assembly and configured to displace the upper tool between a first position, wherein the upper tool is positioned in correspondence of the backing structure and configured to pick up from the backing structure the one or more cut film sheets, and at least a second position, wherein the upper tool is aligned to the lower tool and configured to position at least one film sheet above said one or more supports, and a vacuum arrangement connected to the packaging chamber, wherein the control unit is further configured to:

activate the displacement mechanism to position the upper tool at said first position in correspondence of the backing structure, command the relative motion of the peripheral body with respect to the head to define said cavity and trap a peripheral edge of said cut film sheet between a terminal surface of the peripheral body and the holding surface of the backing structure, activate the holder and pulling the film portion of the cut film sheet inside the cavity conferring said tri-dimensional configuration to said cut film sheet, activate the displacement mechanism to position the upper tool holding the cut film sheet at said second position such that the at least one cut film sheet having the tri dimensional configuration is brought above the respective one or more supports, cause the upper and lower tools to move to the second operating condition and trap the peripheral edge of said cut film sheet between a support and said terminal surface of the peripheral body, and operate the vacuum arrangement to cause a prefixed level of vacuum being formed in the packaging chamber and the cut film sheet to drape down and form a skin onto the support and onto the product.

12. The apparatus of claim 1, further comprising:

a film supplying assembly configured to supply a continuous film;

a film cutting assembly located inside said packaging chamber and presenting a blade positioned radially outside said peripheral body;

a stopper frame interposed between the upper and the lower tools and configured to move relative to the upper tool from a release condition, wherein the continuous film is allowed to move, and from a stop condition, wherein the stopper frame blocks the continuous film against an abutting surface of the upper tool and stops said film portion above at least one of the one or more supports; and a vacuum arrangement connected to the packaging chamber;

wherein the control unit is further configured to:

position the stopper frame in said stop condition, command the relative motion between the peripheral body and the head in order to define said cavity, activate the holder and pulling at least part of said film portion of film inside the cavity conferring said tri-dimensional configuration, cause the upper and lower tools to move to the second operating condition, trap a film section, located peripherally to said film portion, between a support top rim and a terminal surface of the peripheral body, operate the vacuum arrangement to cause a prefixed level of vacuum being formed in the packaging chamber and the film portion to drape down and form a skin onto the support and onto the product, and operate the film cutting assembly to cut the film portion from the continuous film.

13. The apparatus of claim 1, further comprising:

a film supplying assembly configured to supply a continuous film;

a tray supply assembly configured to supply a continuous web including a plurality of thermoformed supports in the form of interconnected trays; and a vacuum arrangement connected to the packaging chamber;

wherein the control unit is further configured to:

cause the tray supply assembly to move a portion of the continuous web having a prefixed number of supports defined therein into the packaging assembly between the upper tool and lower tool, cause the film supply assembly to move said portion of the continuous film into the packaging assembly between the upper tool and lower tool, bring the upper tool in contact with the continuous film, command the relative motion between the peripheral body and the head to define said cavity, activate the holder and pulling at least said film portion inside the cavity conferring said tri-dimensional configuration, cause the upper and lower tools to move to the second operating condition, trap a section of the film located at the periphery of said film portion and a corresponding portion of said web between a terminal surface of the peripheral body and an opposite closure surface of the lower tool, and operate the vacuum arrangement to cause a prefixed level of vacuum being formed in the packaging chamber and the film portion to drape down and form a skin onto the prefixed number of supports.

14. The apparatus of claim 13, wherein said portion of the continuous web moved into the packaging assembly comprises a plurality of supports and wherein the portion of the continuous film moved into the packaging assembly is configured at an acute angle with respect to horizontal, further wherein the step of bringing the upper tool in contact with the continuous film comprises bringing the upper tool in contact first with a leading section of the continuous film closer to the film supply assembly and then said portion.

15. The apparatus of claim 13, wherein the vacuum arrangement connected to the packaging chamber and configured to remove gas from said packaging chamber comprises at least one vacuum pump and at least one evacuation pipe connecting the inside of said packaging chamber to the vacuum pump, said control unit being further configured to control the vacuum arrangement to withdraw gas from said packaging chamber at least when the packaging assembly is in said second operating condition with said packaging chamber hermetically closed.

16. A method of packaging a product arranged on a support, the method comprising:

supplying a plastic film, supplying a plurality of supports to a packaging assembly, each of the plurality of supports hosting or supporting a product which has a portion protruding above a support side, the packaging assembly having:

a lower tool comprising a number of seats configured to receive one or more of the plurality of supports, and an upper tool movable relative to the lower tool between at least a first operating condition, wherein the lower tool and the upper tool are spaced apart, and a second operating condition, wherein the lower tool and the upper tool define a packaging chamber, wherein the upper tool comprises:

a head with a respective active surface configured to contact at least a film portion of the film, and a peripheral body positioned around the head, the head and the peripheral body being mounted for relative motion with respect to each other among a plurality of relative positions;

relatively moving one of the peripheral body and the head with respect to the other, in order to form a cavity delimited by said active surface and by an inner wall of said peripheral body;

pulling the film portion of said film inside the cavity to confer a tri dimensional configuration to said pulled film portion;

moving the upper and lower tools to the second operating condition;

closing the packaging chamber with the protruding portion of the product being received inside said cavity below the pulled film portion;

at least one of withdrawing gas from the packaging chamber to cause at least the film portion to drape down and form a plastic skin onto the product and the support or injecting a gas mixture of prefixed composition into the packaging chamber;

heat bonding at least the film portion to the one or more of the plurality of supports to form one or more packages; and moving the one or more packages out of the packaging assembly.

17. The method of claim 16, further comprising:

cutting the film into film sheets outside the packaging chamber at a station remote from the location where the film sheets are coupled to the plurality of supports, wherein supplying the film to the packaging assembly comprises supplying cut film sheets, further wherein the plurality of supports comprises a rim radially emerging from said side wall and delimiting a mouth of one of the plurality of supports, and wherein the film sheet is cut to a size to tightly close the mouth of one of the plurality of supports and sealingly engage a top surface of the rim.

18. The method of claim 16, further comprising:

heating the active surface of said head to cause heating of said film portion at least before pulling the same film portion inside said cavity, wherein relatively moving the peripheral body with respect to the head in order to define the cavity comprises displacing the peripheral body with respect to the head from an end stroke position, wherein a terminal surface of the peripheral body is aligned or substantially aligned with the active surface of the head, to an operating position, wherein the terminal surface of the peripheral body is displaced from the active surface by a distance which represents a height of said cavity, and wherein causing said film portion to move from a substantially flat configuration to a substantially tri-dimensional configuration inside said cavity takes place after or contemporaneously with formation of said cavity.

19. The method of claim 16, further comprising:

detecting or calculating at least one of:

an overall height of the product hosted in a support, a height of the protruding portion of said product; and forming said cavity with a height equal to or greater than a height of said protruding portion, wherein, after formation of said cavity, the same cavity is kept unchanged at least until heat sealing of the film portion to the support, and wherein said film portion during or at least at an end of a deformation contacts the inside wall of said cavity.

20. The method of claim 16, wherein supplying a plastic film comprises supplying a continuous plastic film, further wherein the method comprises:

cutting the continuous film into film sheets of prefixed length at a cutting station located outside of the packaging chamber;

positioning the upper tool in correspondence of the cutting station;

forming said cavity;

pulling the film portion of the cut film sheet inside the cavity conferring said tri dimensional configuration to said cut film sheet;

positioning the upper tool holding the cut film sheet at the packaging assembly such that the cut film sheet having the tri dimensional configuration is brought above the respective support;

causing the upper and lower tools to move to the second operating condition, and trapping a peripheral edge of said cut film sheet between a support top and a terminal surface of the peripheral body;

bonding, in particular heat bonding the peripheral edge of said cut film sheet to the support top; and at least one of causing a prefixed level of vacuum being formed in the packaging chamber for the cut film sheet to drape down and form a skin onto the support and onto the product or injecting a predetermined gas mixture in the packaging chamber.

21. The method of claim 16, wherein supplying a plastic film comprises supplying a continuous plastic film, further wherein the method further comprises:

blocking the continuous film against an abutting surface of the upper tool and stopping said film portion above at least one respective support;

forming said cavity, pulling said film portion of film inside the cavity conferring said tri dimensional configuration, causing the upper and lower tools to move to the second operating condition, bonding, in particular heat bonding, the peripheral edge of said film portion to a top of the support, at least one of causing a prefixed level of vacuum being formed in the packaging chamber for the film portion to drape down and form a skin onto the support and onto the product or injecting a predetermined gas mixture in the packaging chamber, and after the at least one of the vacuum formation or the gas mixture injection, cutting the film portion from the continuous film.

22. The method of claim 16, further comprising:

supplying a plastic film comprises supplying a continuous plastic film between the upper and lower tools;

supplying a prefixed number of supports comprises supplying a continuous web including a plurality of thermoformed supports in the form of interconnected trays;

bringing the upper tool in contact with the continuous film;

forming said cavity;

pulling said film portion inside the cavity conferring said tri dimensional configuration;

causing the upper and lower tools to move to the second operating condition;

trapping a peripheral edge of said film portion between a support top rim and a terminal surface of the peripheral body;

bonding the peripheral edge of said film portion to the support top rim, and at least one of causing a prefixed level of vacuum being formed in the packaging chamber for the film portion to drape down and form a skin onto the supports and onto the products or injecting a predetermined gas mixture in the packaging chamber.

* * * * *